US006978103B2

(12) United States Patent
Miura et al.

(10) Patent No.: US 6,978,103 B2
(45) Date of Patent: Dec. 20, 2005

(54) IMAGE FORMING APPARATUS WITH IMPROVED IMAGE QUALITY AND MAINTENANCE WORKABILITY

(75) Inventors: Tetsuroh Miura, Tokyo (JP); Takeshi Saitou, Hachiouji (JP)

(73) Assignee: Ricoh Co., Ltd., Tokyo (JP)

( * ) Notice: Subject to any disclaimer, the term of this patent is extended or adjusted under 35 U.S.C. 154(b) by 115 days.

(21) Appl. No.: 10/351,410

(22) Filed: Jan. 27, 2003

(65) Prior Publication Data

US 2003/0161656 A1 Aug. 28, 2003

(30) Foreign Application Priority Data

| | | |
|---|---|---|
| Feb. 8, 2002 | (JP) | 2002-032210 |
| Feb. 19, 2002 | (JP) | 2002-041595 |
| Feb. 19, 2002 | (JP) | 2002-041596 |
| Feb. 25, 2002 | (JP) | 2002-016417 |
| Dec. 24, 2002 | (JP) | 2002-371550 |
| Dec. 24, 2002 | (JP) | 2002-371685 |
| Dec. 26, 2002 | (JP) | 2002-376778 |

(51) Int. Cl.[7] ..... G03G 15/02
(52) U.S. Cl. ..... 399/116
(58) Field of Search ..... 399/107, 110, 399/111, 112, 113, 114, 115, 116, 119, 298, 299, 302, 306, 308, 309

(56) References Cited

U.S. PATENT DOCUMENTS

| | | | | |
|---|---|---|---|---|
| 4,559,519 A | | 12/1985 | Matsumoto et al. | |
| 4,908,655 A | | 3/1990 | Takagi | |
| 6,061,542 A | * | 5/2000 | Minami et al. | 399/299 |
| 6,453,135 B1 | * | 9/2002 | Sameshima et al. | 399/110 |
| 6,636,711 B1 | * | 10/2003 | Katahira | 399/82 |
| 2001/0028810 A1 | | 10/2001 | Yamaguchi et al. | |

FOREIGN PATENT DOCUMENTS

| | | |
|---|---|---|
| JP | 56-96436 | 7/1981 |
| JP | 60-21057 | 2/1985 |

(Continued)

OTHER PUBLICATIONS

U.S. Appl. No. 10/351,410, filed Jan. 27, 2003, Mura et al.
U.S. Appl. No. 10/653,097, filed Sep. 3, 2003, Kimura et al.

*Primary Examiner*—Hoan Tran
(74) *Attorney, Agent, or Firm*—Oblon, Spivak, McClelland, Maier & Neustadt, P.C.

(57) ABSTRACT

An image forming apparatus is disclosed including at least a plurality of image bearing members, a plurality of image forming units each including plural image forming members for operating image forming steps onto each of the image bearing members, and a further image bearing member, which are held collectively on an image bearing member holding component, image forming unit holding component and second image bearing member holding component, respectively. By further providing a contact/detach mechanism adapted to detaching movements, within said image forming apparatus, of the image bearing member holding component and the second image bearing member holding component in relation to the image forming unit holding component, the mechanism is greatly simplified with relatively simple and less expensive construction of the mechanism disclosed herein, through eliminating plural contact/detach mechanisms separately provided for the noted holding components and also providing one integrating power sources for use in driving plural units in common. As a result, the previously known disadvantage in image forming apparatus such as contact residue images which are unduly caused by continual contact of the photoreceptors to image forming units and intermediate transfer belt can be obviated, as an example.

153 Claims, 53 Drawing Sheets

FOREIGN PATENT DOCUMENTS

| | | |
|---|---|---|
| JP | 4-31749 | 3/1992 |
| JP | 4-148754 | 5/1992 |
| JP | 4-151678 | 5/1992 |
| JP | 4-221662 | 8/1992 |
| JP | 04 221662 | 8/1992 |
| JP | 6-19256 | 1/1994 |
| JP | 06 019256 | 1/1994 |
| JP | 9-166898 | 6/1997 |
| JP | 09 166898 | 6/1997 |
| JP | 9-304994 | 11/1997 |
| JP | 11 161113 | 6/1999 |
| JP | 11-161113 | 6/1999 |
| JP | 11-231729 | 8/1999 |
| JP | 2000-53275 | 2/2000 |
| JP | 2000-79745 | 3/2000 |
| JP | 2001-154507 | 6/2001 |
| JP | 2001 154507 | 6/2001 |
| JP | 2001-255804 | 9/2001 |
| JP | 2001 255804 | 9/2001 |
| JP | 2001 281952 | 10/2001 |
| JP | 2001-281952 | 10/2001 |

* cited by examiner

CONTACT MODE

DETACHED MODE

IMAGE FORMING APPARATUS WITH IMPROVED IMAGE QUALITY AND MAINTENANCE WORKABILITY

BACKGROUND

1. Field

This patent specification relates to an electrophotographic image forming apparatus in general and, in particular, to such apparatus incorporating a contact and detachment mechanism for facilitating maintenance and parts exchange workability in addition to the improvement in image qualities.

2. Discussion of the Background

The electrophotographic image forming process is well known. In image forming apparatuses such as a copying machine, printer and facsimile apparatus, the formation of the images is generally carried out through the electrophotographic process steps of forming electrostatic latent images on an image bearing member or photoreceptor, which is provided with several image forming process members such as a charging unit, developing unit and so on in the circumference of the photoreceptor.

In the charging unit, a charging roller is included more often recently which is formed to be brought into contact with the photoreceptor in a similar manner to a developing roller in the developing unit.

In case of a color image forming apparatus, the tandem-type structure is often adopted among several methods for implementing color image forming process steps, in which a photoreceptor and image forming process members associated thereto is provided for each of the color components, Y (yellow), M(magenta), C(cyan) and Bk(black).

The steps of latent image formation, development and image transfer are carried out for respective color components so as to be in proper timing with the revolution of the respective photoreceptors. As a result, a full color image can be formed in a manner of proper registration, on a transfer member (second image bearing member) utilized in common to these colors.

The thus formed full color image on the transfer member is subsequently transferred onto a recording member such as, for example, a sheet of copy paper.

In such image forming apparatus, several disadvantages are encountered such as for example, the appearance of contact residual images which is caused in formed images as the remainder of continual contact between the photoreceptor and the image forming process members such as transfer belt, charging unit and developing unit, and which is likely to degrade image quality.

In another example, when image formation on a large number of sheets of paper is carried out continuously, the temperature increases in the vicinity of image forming unit and this increase may reach such a level that causes a thermal expansion in the sheet member, thereby resulting in change in resultant images (for example, undue image expansion and/or image slippage).

This change may become evident in cold district, in particular, where is subjected to severe decrease during night hours and increase in succeeding morning hours, thereby making it hard for the units in the apparatus to properly follow the temperature, and also causing dew condensation with relative ease. As a result, the quality of resultant images may again be degraded.

In order to obviate such difficulties, several improvements can be made such as, for example, respective photoreceptors are provided detachably with respect to, and then removed arbitrary from, the transfer belt.

However, because of further parts to be included in the detachable mechanism, for example, this measure may result in more complicated structure and costs increase. In addition, this attempt may decrease workability on the apparatus of a maintenance and/or parts exchange for a user or service personnel, whereby another difficulty may arise.

As to the image forming apparatus attributed servicing and replacement feasibility, there have been previously known are those with maintenance and parts exchange capability by a user, in which photoreceptor and developing unit are formed integrally and provided detachably from the apparatus, such as called as the process cartridge type (or process unit type), as disclosed previously in Japanese Laid-Open Patent Application No. 11-161113.

The process cartridge type offers several advantages such as, for example, the ease of maintenance and parts exchange operations on arriving at operating life because of the above noted integral construction formation. At the same time, this results a disadvantage as well, in which the cartridge has to be replaced in its entirety when any one of the constituent units arrives at its life and even when some of constituent unit are still usable, to thereby decreases recycling efficiency for respective constituents. As a result, this may result in costs increase and additional burden to the environment.

In addition, as disclosed in Japanese Laid-Open Patent Application No. 11-161113, mishandling may occur during parts exchange steps with regard to plural image forming units, in which a unit for a certain color may erroneously be replaced by that of different color. Although it is therefore desirable to provide the means for obviating such mishandling, this may cause additional increase in machine costs for the image forming apparatus.

After these feature and feasibility of the cartridge-type structure, a trend is becoming more versatile, that is, the trend to replace each of constituents up to individual operation life, called durable disassembly type, from the previous unit disposable type.

The durable disassembly type of construction, however, may encounter several difficulties such as, for example, because of an increased number of parts in the full color image forming apparatus of the tandem type, in particular, operations of maintenance and/or parts exchange become quite complicated and difficult for the user or service personnel.

It is therefore an object of the present disclosure to provide a relatively simple, less expensive contact/detach mechanism for an image forming apparatus of the tandem type construction having a plurality of image bearing members. The contact/detach mechanism is capable of obviating undue effect from continual contact such as, for example, contact residual images. The mechanism also facilitates to improve the workability on the apparatus of a maintenance and/or parts exchange for the user or service personnel by handling a plurality of units simultaneously, when necessary, to thereby reducing the frequency and/or labor hours for the handling the units.

In regard to the units feasible of being replaced by a user or service personnel, there may be cited are the aforementioned photoreceptor and the image forming process members such as developing unit, charging unit, and so on, and in combination thereof as a process unit. In addition, further units are also cited among the above units for image forming apparatus in particular such as a sheet feeding unit and fixing unit, which are suffered more often by jamming of the sheets of paper than other units.

In case when any maintenance and/or parts exchange work is needed for the units above mentioned, the apparatus is designed to designate specific unit(s) on a display device provided on operation panel of the image forming apparatus, whereby the user is urged, for example, to take necessary measures for the maintenance or parts exchange.

As to the display devices, Japanese Patent Application No. 2000-79745 discloses a device for movie displays, Japanese Laid-Open Patent Application No. 11-231729 a display device for instructing operation steps and the sequence thereof, and Japanese Patent Application No. 2000-53275 both overall and detailed images of the portion to be subjected to the operation steps.

The user can generally carry out necessary operation steps by recognizing the display contents shown and then implementing necessary maintenance and/or parts exchange operation steps according to the contents.

In the course of the operation for the maintenance and/or parts exchange, although the user may memorize once the display contents and then carry out operation steps according to own recollection, one may not be able to either find the exact location, recall the specific content, or follow the exact sequence.

In another instance, a schematic diagram displayed on the panel may not show the correlation to the actual parts in the apparatus clearly enough to implement necessary operation steps smoothly and thoroughly.

It is therefore another object of the present disclosure to provide display means for an image forming apparatus, capable of clearly displaying the location to be presently subjected to maintenance and/or parts exchange operation, and also instructing operation steps and the sequence thereof, if necessary, in a manner clearly recognized and easily correlated to the actual parts in the image forming apparatus.

SUMMARY

Accordingly, there provided in the present disclosure is an electrophotographic color image forming apparatus, for example, of the tandem-type structure, provided with a contact and detachment mechanism as well as display means, having most, if not all, of the advantages and features of similar employed apparatuses, while eliminating many of their disadvantages.

The following brief description is a synopsis of only selected features and attributes of the present disclosure. A more complete description thereof is found below in the section entitled "Description of the Preferred Embodiments"

An image forming apparatus is disclosed herein includes at least a plurality of image bearing members adapted for bearing thereon electrostatic latent images corresponding to image data, and image forming members provided in a circumference of the plurality of image bearing members having different capabilities, in which the plurality of image bearing members are unitized as an image bearing unit.

The image forming apparatus is also characterized by unitizing image forming members having similar capability out of the noted image forming members as image forming units, also unitizing at least three of the image forming members having similar capability as the image forming unit, and providing each of the image forming members having similar capability included in the image forming units being situated approximately equally spaced each other.

According to another aspect, the image forming apparatus disclosed herein includes at least a plurality of image forming subsystems, each having plural kinds of image forming members and each being configured to perform image formation, in which at least two image forming units are included in each of the plurality of image forming subsystems, each including a plurality of image forming units having similar capability.

In addition, the plurality of image forming subsystems are configured to perform color image formation, and a further image forming subsystem configured to perform black image formation is provided, separately from the plurality of image forming subsystems, including plural kinds of image forming members having different capabilities.

Furthermore, the noted image forming units are each provided slidably out of main chases of the image forming apparatus, and the image forming members held on the image forming units may be provided to be replaceable either individually or as a unit.

According to still another aspect, the image forming apparatus includes at least a plurality of image bearing members, an image bearing member holding component for holding the plurality of image bearing members collectively, a plurality of image forming units for operating image forming steps onto each of the image bearing members, an image forming unit holding component for holding the plurality of image forming units collectively, and a contact/detach mechanism for carrying out detaching movements, within the image forming apparatus, of the image bearing member holding component in relation to the image forming unit holding component.

The image forming apparatus is also characterized for the plurality of image bearing members be held parallel to each other detachably on the image bearing member holding component, and for at least one of the image bearing member holding component and image forming unit holding component be each provided slidably out of the main chases of the image forming apparatus.

In addition, the image bearing member holding component and image forming unit holding component each include respective positioning parts for carrying out positioning one another by engaging the positioning part of the image forming unit holding component with that of image bearing member holding component.

Furthermore, the contact/detach mechanism carries out detachment movements through displacement of the image forming unit holding in relation to image bearing member holding component, and the direction of the displacement is vertical in relation to the image bearing member holding component.

The image forming apparatus may further include a second image bearing member provided in common for being transferred by images born by the plurality of image bearing members, a second image bearing member holding component for holding the second image bearing member; and a second contact/detach mechanism for carrying out detaching movements, within the image forming apparatus, of the second image bearing member holding component in relation to the image bearing member holding component, in which a linkage mechanism additionally provided for carrying out detaching movements of both the image forming unit holding component in relation to the image bearing member holding component and the second image bearing member holding component in relation to the image bearing member holding component, simultaneously.

Furthermore, the image forming apparatus may further include a third image bearing member for being transferred by images born by the second image bearing member, and a third image bearing member holding component for holding the third image bearing member, in which the second and third image bearing member holding components each include respective positioning parts for carrying out positioning in relation to one another by engaging the positioning part of the third image forming unit holding component with that of the second image bearing member holding component.

According to another aspect, the image forming apparatus includes at least a plurality of image bearing members, an image bearing member holding component for collectively holding the plurality of image bearing members with a certain degree of positional allowance, a plurality of image forming units for operating image forming steps onto each of the image bearing members, and an image forming unit holding component for holding the plurality of image forming units collectively, in which the plurality of image bearing members are each positioned in relation to the main chases of the image forming apparatus after placing the image bearing member holding component at a predetermined location in the main chases, and the plurality of image forming units held on the image forming unit holding component are each subsequently positioned in relation to the plurality of image bearing members positioned previously.

The image forming apparatus may further include an image bearing member holding component restricting member for placing the plurality of image bearing members at respective predetermined locations in the main chases; an image bearing member positioning mechanism for positioning the plurality of image bearing members, placed at respective predetermined locations on the image bearing member holding component, in relation to the main chases; an image forming unit positioning mechanism for positioning the plurality of image forming units held on the image forming unit holding component in relation to the plurality of image bearing members; and a contact/detach mechanism for carrying out detaching movements of the image bearing member holding component in relation to the image forming unit holding component.

The image forming apparatus is characterized for the plurality of image bearing members to be held parallel to each other detachably on the image bearing member holding component and to be detachably mounted from above on the image bearing member, and for at least one of the second image bearing member holding component and image forming unit holding component to be each provided slidably out of the main chases of the image forming apparatus.

Furthermore, at least one of the second image bearing member holding component, image forming unit holding component, and second image bearing member holding component is each provided slidably out of the main chases of the image forming apparatus; contact/detach movements are carried out in the same direction for image bearing member, image forming unit and second image bearing member, held on the image bearing member holding component, image forming unit holding component and second image bearing member holding component, respectively; and sliding-out movements are carried out horizontally for image bearing member holding component, image forming unit holding component and second image bearing member holding component; and contact/detach movements are carried out vertically for image bearing member, image forming unit and second image bearing member.

According to another aspect, the image forming apparatus configured to perform image formation corresponding to image data, includes at least a plurality of objects to be subjected to parts exchange and/or maintenance operation, a display unit for indicating the plurality of objects or the locations thereof, a cover openably provided for covering the plurality of objects, a display unit provided at the locations of either the cover or corresponding thereto for indicating the cover covering the plurality of objects to be subjected to parts exchange and/or maintenance operation; a detecting means for detecting the need for the parts exchange and/or maintenance operation for the plurality of objects, and a display means for instructing for both the display unit for indicating either the plurality of objects and the locations thereof, and the display unit provided at the locations of either the cover and corresponding thereto for indicating the cover covering the plurality of objects to be subjected to the parts exchange and/or maintenance operation, to thereby display pertinent information based on detection results on the plurality of objects detected by the detecting means, in which the plurality of objects are selected from the group consisting of the plurality of image bearing members, image bearing unit, image bearing member holding component, image forming members, and image forming members, recited in earlier parts in this summary.

In addition, a light emitting unit as the display unit, a light emitting source, and means for transmitting light beams emanated by the light emitting source, are provided to properly display pertinent information based on detection results on the plurality of objects detected by the detecting means in the image forming apparatus.

The present disclosure and features and advantages thereof will be more readily apparent from the following detailed description and appended claims when taken with drawings.

DESCRIPTION OF THE PREFERRED EMBODIMENTS

In the detailed description which follows, specific embodiments primarily on contact and detachment mechanisms are described, which are adapted to separation movements of several holding components for holding unitized image forming members included in an electrophotographic image forming apparatus.

It is understood, however, that the present disclosure is not limited to these embodiments, and it is appreciated that the mechanisms and method therefor disclosed herein may also be adaptable to any system for achieving proper placement and positioning through contact, detachment and linkage operations, to thereby facilitating maintenance and parts exchange workability in addition to the improvement in system performance.

There described herein below is an image forming apparatus according to one embodiment in the present disclosure referring to FIGS. 1 through 20.

The image forming apparatus is herein adapted to a full color printer of the tandem type capable of printing on both sides at approximately the same time.

Figure 1:
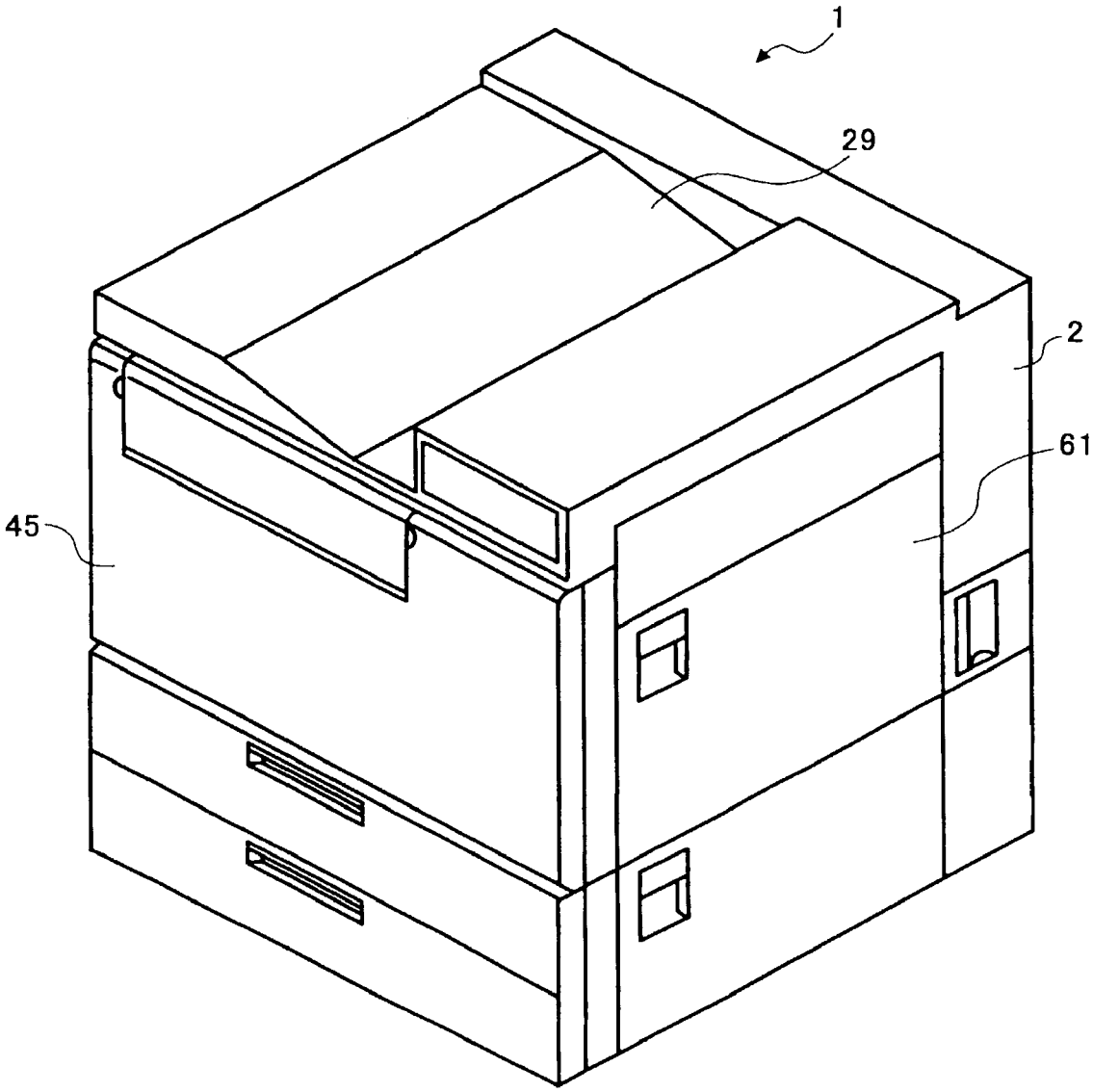
FIG. 1 is a perspective view illustrating the overall view of the full color printer according to one embodiment disclosed herein.
Figure 2:
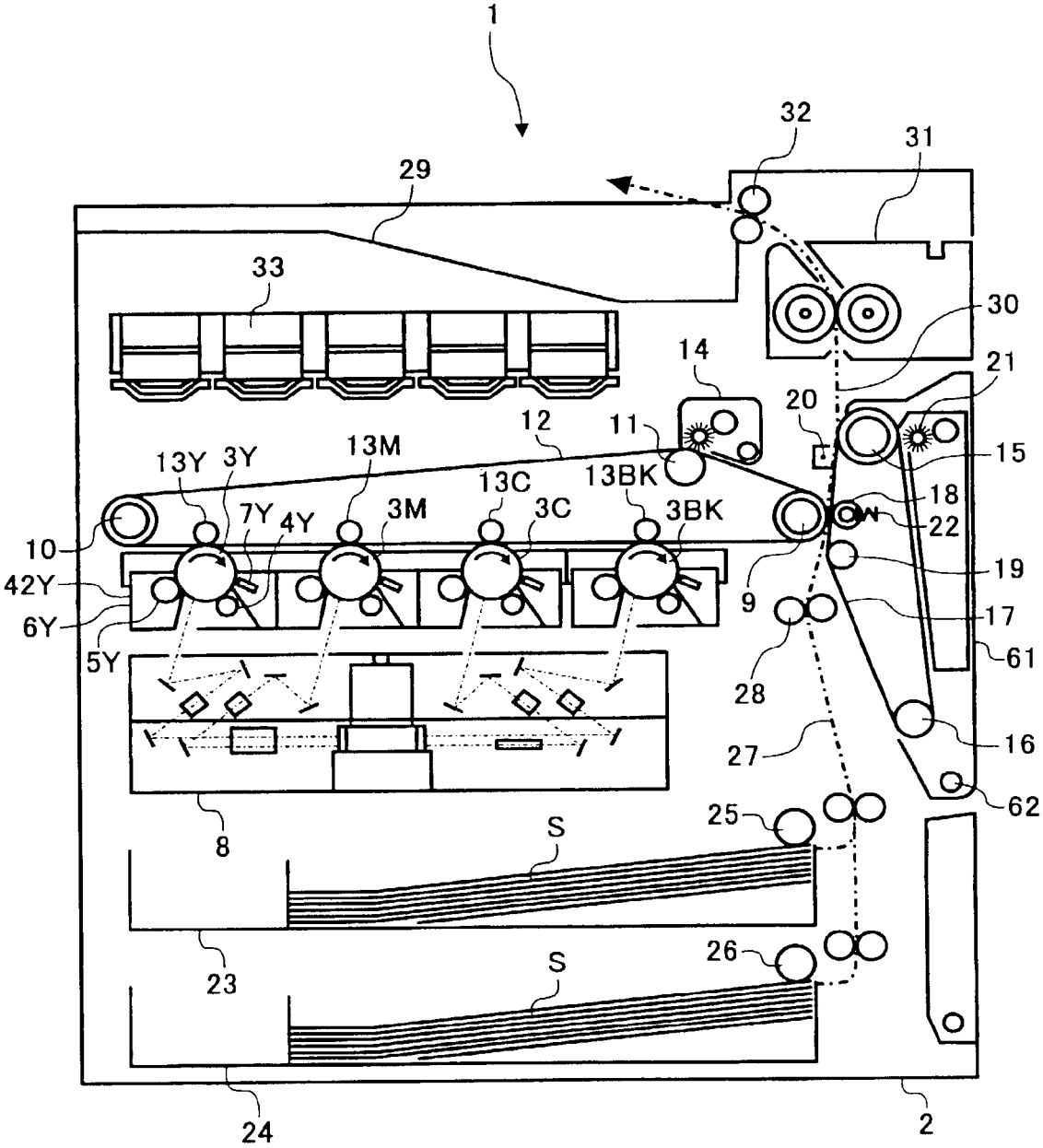
FIG. 2 is a cross sectional view illustrating the structure of the full color printer according to one embodiment disclosed herein.

FIG. 1 is a perspective view illustrating the overall view of the full color printer 1 and FIG. 2 is a side view illustrating the structure thereof according to one embodiment disclosed herein.

Referring now to FIG. 2, approximately in the middle of its main chases 2, the full color printer 1 is provided with at least four photoreceptor units, 3Y, 3M, 3C and 3Bk, of the drum type as image bearing members, housed horizontally from left to right in the drawing in approximately equal separation each other. It may be added the letters, Y, M, C and Bk, designate yellow, magenta, cyan and black, respectively.

Looking closer into the unit 3Y for forming yellow colored images, for example, this photoreceptor unit 3Y has a cylindrical structure made of aluminum, for example, with a diameter ranging from 30 to 100. The surface of the aluminum cylindrical structure is then provided with the layer of an organic semiconductor material as a photoconductive substance.

The photoreceptor unit 3Y is provided to be rotatably operated in clockwise as viewed in the drawing by a driving means (not shown). In addition, there provided to implement electrophotographic process steps are several units for forming electrophotographic images such as charging roller 4Y, developing unit 6Y provided with a developing roller 5Y, and cleaning unit 7Y, in that order.

Several additional units are also provided for other respective photoreceptor units, 3M, 3C and 3Bk, in a similar manner as above under the provision for adopting respective toners different only in color-wise. In place of the drum type structure of the photoreceptor units, other types may alternatively used such as the belt-type, for example.

An exposure unit 8 is further provided below the photoreceptor units, 3Y, 3M, 3C and 3Bk, as also shown in FIG. 2, to scan illuminate laser beams corresponding to respective color images onto the photoreceptor units, 3Y, 3M, 3C and 3Bk, which are previously uniformly charged, so as to form electrostatic latent images.

In addition, narrow openings are provided between the charging rollers 4 and the corresponding developing rollers 5 to serve as slits for allowing the passage of laser beams of the respective colors to be incident onto the photoreceptor units, 3Y, 3M, 3C and 3Bk.

Although exposure unit is shown herein above as the combination of a laser light source and polygonal mirror, other systems may alternatively be used such as, for example, one utilizing an LED (light emitting diode) array and appropriate focusing means.

Above photoreceptor units, 3Y, 3M, 3C and 3Bk, an intermediate transfer belt 12 is provided as the second image bearing member, which is supported by plural rollers 9, 10 and 11, and rotatably operated anticlockwise as viewed in FIG. 2.

The intermediate transfer belt 12 is adapted to serve in common the photoreceptor units, 3Y, 3M, 3C and 3Bk, and provided approximately flat and horizontally at the locations at which the portions of respective photoreceptor units following developing steps come into contact with the belt 12. On the inner periphery of intermediate transfer belt 12, transfer rollers, 13Y, 13M, 13C and 13BK, are provided opposing to respective photoreceptor units, 3Y, 3M, 3C and 3Bk.

A cleaning unit 14 is further provided on the outer periphery of intermediate transfer belt 12 at the location such as, for example, one opposing to the roller 11. The cleaning unit 14 is adapted to remove disused toner residual on the surface of the transfer belt 12.

It may be added that the intermediate transfer belt 12 is formed of such a material as a film of resinous material or rubber, for example, preferably having a thickness ranging from 50 to 600 $\mu$m and a resistance suitable for transferring toner images previously formed on the photoreceptor units, 3Y, 3M, 3C and 3Bk.

Furthermore, on the right-hand side of the belt 12, another intermediate transfer belt 17 is provided as the third image bearing member, which is supported by rollers 15 and 16, and rotatably operated clockwise. The intermediate transfer belt 17 is provided approximately flat and vertically so as to come into contact with the belt 12 to thereby be able to form a transfer nip portion in a predetermined manner.

The intermediate transfer belt 17 is formed in a similar manner to the transfer belt 12 with such a material as a film of resinous material or rubber, for example, preferably having a thickness ranging from 50 to 600 $\mu$m and a resistance suitable for transferring toner images previously formed on the transfer belt 12. Accordingly, it is requisite for the transfer belt 17 to have a circumferential length capable of bearing toner images, which is adequate to complete the image formation onto transfer sheets of at least the maximum size warranted by the full color printer presently disclosed.

On the inner periphery of intermediate transfer belt 17, there provided are a transfer roller 18 and a guide roller 19 opposing to the roller 9 in use for transferring toner images. On the outer periphery of intermediate transfer belt 17, there provided are a charger 20 for transferring toner images onto transfer sheets and another cleaning unit 21 in use for removing disused toner residual on the surface of the transfer belt 17.

The intermediate transfer belt 17 is arranged to be pressed against the transfer belt 12 by a pressurizing force generated by a coiled spring 22 through the transfer roller 18.

Being situated under the exposure unit 8 in the main housing 2 of the full color printer 1, plural stages of transfer sheet feeding trays, or two stages of the trays 23, 24, for example, are movably provided for being inserted in or withdrawn from the main machine housing.

Transfer sheets, S, supported in stacked arrangement on the feeding trays 23 or 24 are then fed selectively by either feed roller 25 or 26, which is provided corresponding to the trays 23 and 24, respectively. These transfer sheets are directed to a sheet transport path 27 which is housed approximately horizontally, and then forwarded to the image transfer portion formed by adjoining the intermediate transfer belt 17 and the transfer belt 12.

In addition, a registration roller pair 28 is provided right before the image transfer portion along the sheet transport path 27 to set timing for properly feeding transfer sheets to the transfer portion.

Furthermore, a sheet transport/output path 30 is provided above the image transfer portion, which is continuous to the sheet transport path 27 and leading to a sheet collecting stack 29 by way of the transfer belt 17 and the charger 20.

Also provided along the sheet transport/output path 30 are a fixing unit 31 employing a fixing roller pair and a sheet output roller pair 32.

In addition, under the sheet output stack portion 29 in the main housing 2, further provided is a toner container 33 capable of storing and then supplying on demand toner particles of several colors to be in use for respective photoreceptor units, 3Y, 3M, 3C and 3Bk.

With the construction mentioned above, the process steps will be described first on forming images on both sides of a transfer sheet S, i.e., duplex printing.

By means of the developing unit 8, the surface of the photoreceptor drum 3Y is first uniformly charged by a charging roller 4Y. Thereafter, by illuminating laser beams corresponding to yellow colored images on the surface of the thus charged photoreceptor 3Y, electrostatic latent images are formed.

Subsequently, the thus formed latent images are rendered visible with yellow toner through developing process steps carried out by the developing roller 5Y, and then the yellow images are transferred by means of transfer roller 13Y on the intermediate transfer belt 12, of which movement is controlled to be in proper timing with the revolution of the photoreceptor 3Y.

These steps of latent image formation, development and image transfer, are carried out in similar manner for other photoreceptors, 3M, 3C and 3Bk, respectively, again so as to be in proper timing with the revolution of the respective photoreceptors.

As a result, a full color image can be formed, in a manner of proper registration, on the intermediate transfer belt 12 as a sequential overlap of color toner images of yellow Y, magenta M, cyan C and black Bk colors, in that order from the bottom, which is forwarded to the following steps with the above overlap sustained.

The thus formed full color image on the intermediate transfer belt 12 is then transferred by means of transfer roller 18 on the intermediate transfer belt 17, of which movement is controlled to be in proper timing with the revolution of the belt 12.

As a result, the full color image formed on the intermediate transfer belt 17 is securely sustained as one to be transferred to one side, or the first side of transfer sheet S.

At the intermediate transfer belt 12, the surface thereof is cleaned by a cleaning unit 14, whereby the transfer belt 12 is prepared for the next copying cycle steps.

Subsequently when the intermediate transfer belt 12 advances to a predetermined location, another set of image forming steps are initiated for the other side or the second side of the transfer sheet S. In a similar manner to those for the above described full color image forming steps, another full color image is formed on the intermediate transfer belt 12 and securely sustained.

Thereafter, the transfer sheet S is advanced to a transfer position by means of the registration roller 28 in proper timing, the thus formed full color image on the intermediate transfer belt 12 is transferred onto the second side of the transfer sheet S. Subsequently by means of transfer charger 20, the full color image sustained on the transfer belt 17 is transferred to the first side of the transfer sheet S.

Thus, image transfer is accomplished on the both sides of the transfer sheet at almost the same time at respective transfer positions.

Incidentally, it may be added, since the polarity of toner particles for the image on the photoreceptor 3 is rendered to be negatively charged in the present embodiment, the toner particles on the photoreceptor 3 are transferred to intermediate transfer belt 12 by positive charges supplied to the transfer roller 13.

In addition, by supplying positive charges onto the transfer roller 18, toner images held on the intermediate transfer belt 12 are then transferred to either intermediate transfer belt 12 (in use for transferring to the first side of transfer sheet) or onto the second side of the transfer sheet.

Furthermore, by supplying positive charges by the transfer charger 20, negatively charged toner images held on the transfer belt 17 are attracted and then transferred to the first side of the transfer sheet.

The transfer sheet S, on which image transfer is accomplished on the both sides thereof at almost the same time, is subsequently subjected to fixing steps at the fixing unit 31, and directed to a sheet output tray 29 through a sheet output roller 32.

With the unit construction as illustrated in FIG. 2, the copied sheet is output to the sheet tray 29 with the side thereof faced down, on which the image is formed later, i.e., formed directly by transferring from the intermediate transfer belt 12.

This makes proper page sorting feasible, when the image on the second page is formed first and sustained for a while on the transfer belt 17, while the image on the first page is formed and then directly transferred from the intermediate transfer belt 12 to the sheet S.

In addition, the light exposure for forming the above images is carried out such that the image to be transferred from the intermediate transfer belt 12 to the sheet S is formed as a real image on the photoreceptor 3, and that the image to be transferred from the transfer belt 17 is formed as a reflected image.

These steps for proper page sorting can be carried out with relative ease by utilizing several techniques known in the area such as ones for storing image data in storage memory devices and others of image processing for the light exposure accompanied by switching from real image to reflected (or mirrored) images.

In addition to the image formation onto the both sides of transfer sheet, there described herein below is the formation on one side of the sheet.

Although two ways are broadly considered for this image formation, one by transferring from the intermediate transfer belt 12 to the sheet, and the other using additionally the transfer belt 17 as well, thereby transferring from the transfer belt 17, the former case utilizing the intermediate transfer belt 12 alone will be detailed herein below since the use of the transfer belt 17 can be eliminated.

First, by means of the developing unit 8, the surface of the photoreceptor drum 4Y is uniformly charged by a charging roller 4Y. Thereafter, by illuminating laser beams corresponding to the data of yellow colored images on the surface of the thus charged photoreceptor 3Y, electrostatic latent images are formed.

Subsequently, the thus formed latent images are rendered visible with yellow toner through developing process steps carried out by the developing roller 5Y, and then the yellow images are transferred by means of transfer roller 13Y on the intermediate transfer belt 12, of which movement is controlled to be in proper timing with the revolution of the photoreceptor 3Y.

These steps of latent image formation, development and image transfer, are carried out in similar manner for other photoreceptors, 3M, 3C and 3Bk, respectively, again so as to be in proper timing with the revolution of the respective photoreceptors.

As a result, a full color image can be formed, in a manner of proper registration, on the intermediate transfer belt 12 as a sequential overlap of color toner images of yellow Y, magenta M, cyan C and black Bk colors, in that order from the bottom, which is forwarded to the following steps with the above overlap sustained.

The thus formed full color image on the intermediate transfer belt 12 is then transferred by means of transfer roller 18 on a transfer sheet. The transfer sheet S, on which image transfer is completed, is subsequently subjected to fixing steps at the fixing unit 31, and then directed to a sheet output tray 29 through a sheet output roller 32, to be disposed with image carrying side thereof downward.

At the intermediate transfer belt 12, the surface thereof is cleaned by a cleaning unit 14, whereby the transfer belt 12 is prepared for the next copying cycle steps.

Incidentally, the charger 20 is non operative during these process steps.

Although the process steps for printing on either one side or both sides of the transfer sheet are described herein above with respect to full color images, these steps are quite similar for the cases of either in a specific color or in monochrome (i.e., black) with the exception that some of the photoreceptors not corresponding to that specific color is not activated in the steps.

Figure 3:
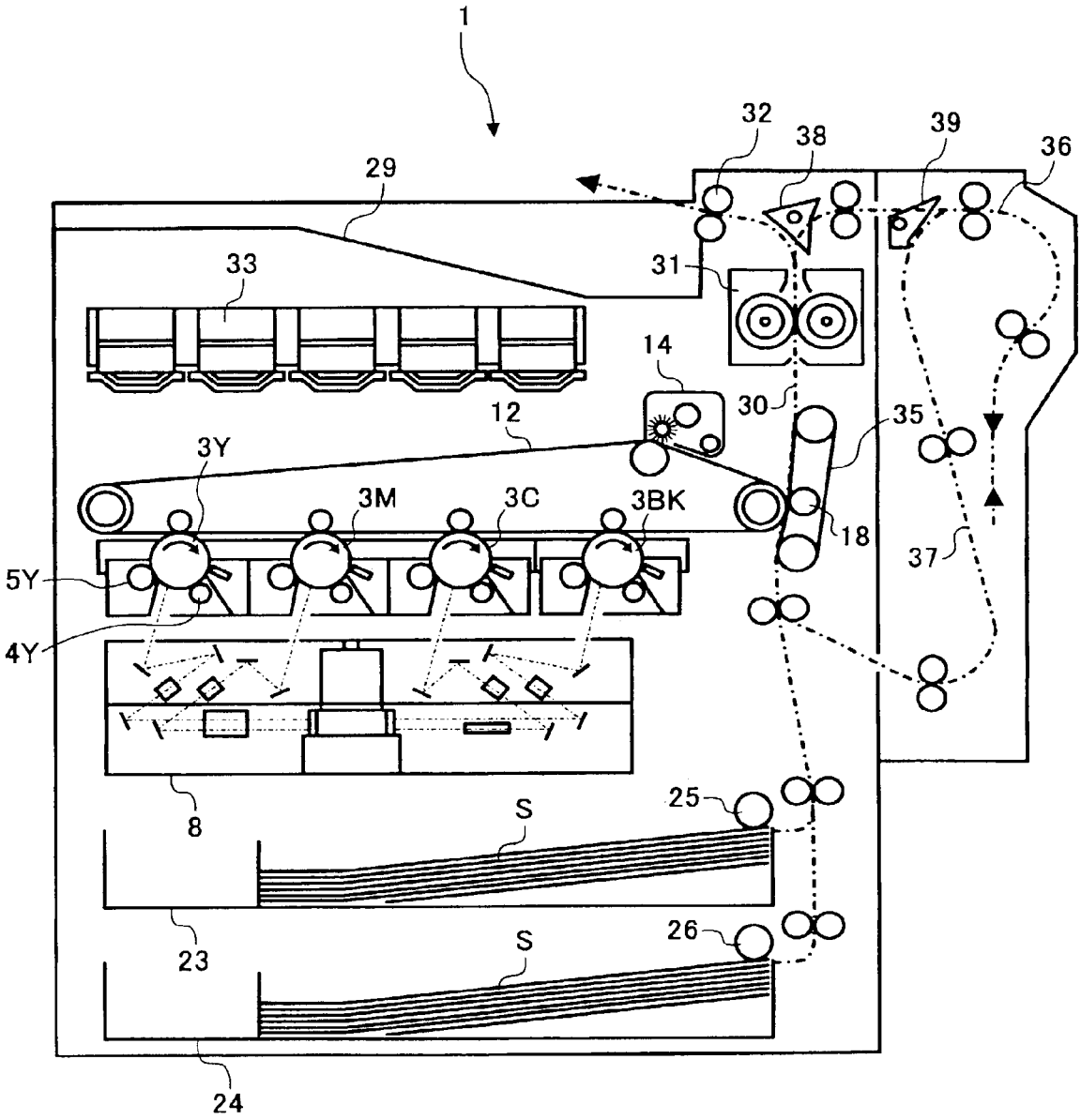
FIG. 3 is a cross sectional view illustrating the structure of the full color printer according to another embodiment disclosed herein.

In addition, when approximately simultaneous double-sided printing through single sheet feeding is not needed, an alternative method of sheet transport can be available. That is, a double-sided sheet transport path 37 may alternatively be formed as shown in FIG. 3 by providing a transfer belt 35 in place of the transfer belt 17 and the transfer charger 20. There additionally provided herein is a sheet reversal path 36 placed on the side of the sheet transport/output path 30, which is capable of sheet reversing and re-feeding a transfer sheet previously image formed on one side thereof, then forwarding to the transfer position one more time. The parts 38, 39 also shown in FIG. 3 are nails, or fluke finger for properly switching the sheet path.

After having described broadly on the construction of the full color printer, several features thereof characteristic to the present disclosure will be detailed herein below.

In one aspect of the present disclosure, an image bearing member holding component 41 is provided for detachably holding photoreceptors 3Y, 3M, 3C and 3Bk.

There also provided herein is an image forming unit holding component 43 for detachably holding image forming units, 42Y, 42M, 42C and 42Bk, each of which may be handled as a unit 42 in the present embodiment including several constituents such as the charging roller 4, developing unit 6 having developing roller 5 and cleaning unit 7.

Furthermore, a transfer unit holding component 44 is additionally provided as the second image bearing member holding component for detachably holding an intermediate transfer belt 12.

Figure 4A:
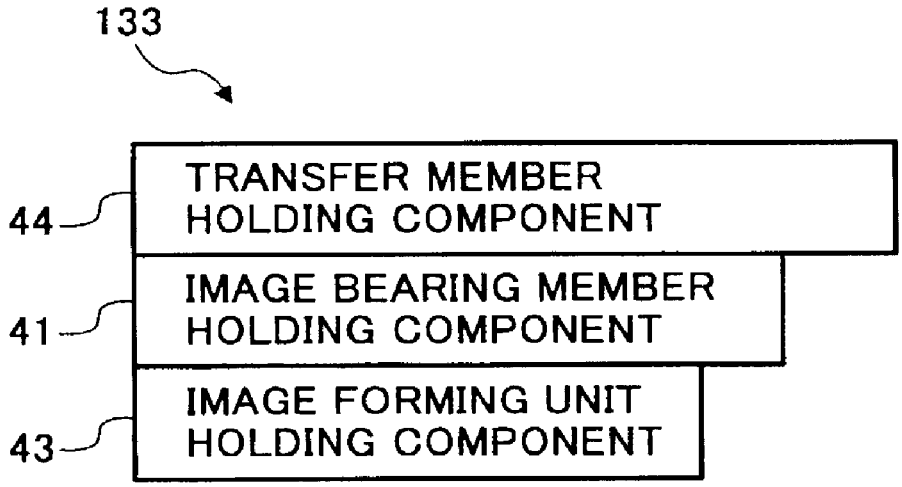
FIG. 4A is a drawing illustrating the holding components pressed against, or brought into close proximity to, each other during the period of image formation.

In the present embodiment including the holding components, 41, 43, and 44, the full color printer is adapted at least during the period of image formation such that the holding components 43, 44 are pressed against, or brought into close proximity to, the image bearing member holding component 41, to thereby be able to properly carry out the image formation, as illustrated in FIG. 4A in an abbreviated manner.

Figure 4B:
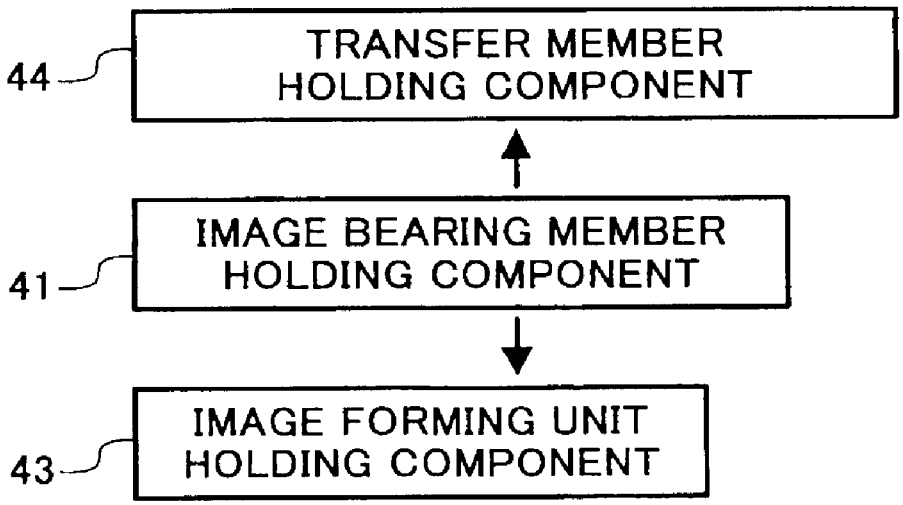
FIG. 4B is a drawing illustrating the holding components separated each other by means of a detaching mechanism.

In contrast, during the period other than image formation, it is adapted such that the holding components 43, 44 can be made separable from the image bearing member holding component 41, as illustrated in FIG. 4B, by means of a detaching mechanism.

As to the timing for the holding components 43, 44 be detached from the image bearing member holding component 41 during the period other than image formation, there may be cited several ways for timing such as, for example, one immediately after the completion of image forming steps, and the other a predetermined period of time after the completion.

If the timing immediately after the completion of image forming steps is adopted, for example, the holding components 43 and 44 are detached from the image bearing member holding component 41 for a relatively prolonged period of time, and previous disadvantages such as contact residue images unduly caused by continual contact can be obviated to the full extent. In contrast, the timing is adopted as a predetermined period of time after the completion of image forming steps, the holding components 43 and 44 are detached from the holding component 41 for a period of time which does not affect the image formation and the disadvantage again can be obviated.

In the present embodiment, the timing is adopted as a predetermined period of time after the completion of image forming steps and the moment at which the energy-saving mode start for the operation of the system, to thereby a movement for the separation be automatically initiated.

In addition, even when the energy-saving mode is not initiated, the timing herein may also include further cases such as the time at which either an outer cover 45 (or more practically an inner cover 46 of FIGS. 5 and 6) is released to open, or a power switch is turned off by a user or service personnel for a maintenance and/or parts exchange purpose, to thereby concomitant process steps be automatically initiated so that the holding components 43, 44 can be detached from the image bearing member holding component 41.

That is, the initiation of the separation steps is set so as to correspond to the result of the logical sum (OR) of the start of energy-saving mode, opening of the outer cover 45, and turning off the power supply switch.

As an example, the separation steps of the holding components 43, 44 from the image bearing member holding component 41 is therefore initiated once the outer cover 45 is opened even in the case of immediately after the completion of image forming steps and the energy-saving mode has not initiated yet.

In the case where the printer of the present model is not provided with outer cover 45, the present embodiment may further include an alternative means, in which the steps for the separation be initiated by an appropriate device such as, for example, a switch provided on a operation panel.

By the separation of the holding components 43, 44 from the image bearing member holding component 41, in either case described above, the constituents in the image forming unit holding component 42, 42Y, 42M, 42C and 42Bk, such as the charging roller 4, developing unit 6 having developing roller 5 and cleaning unit 7, and intermediate transfer belt 12, are detached from photoreceptors 3Y, 3M, 3C and 3Bk, previously be in contact therewith.

Figure 7:
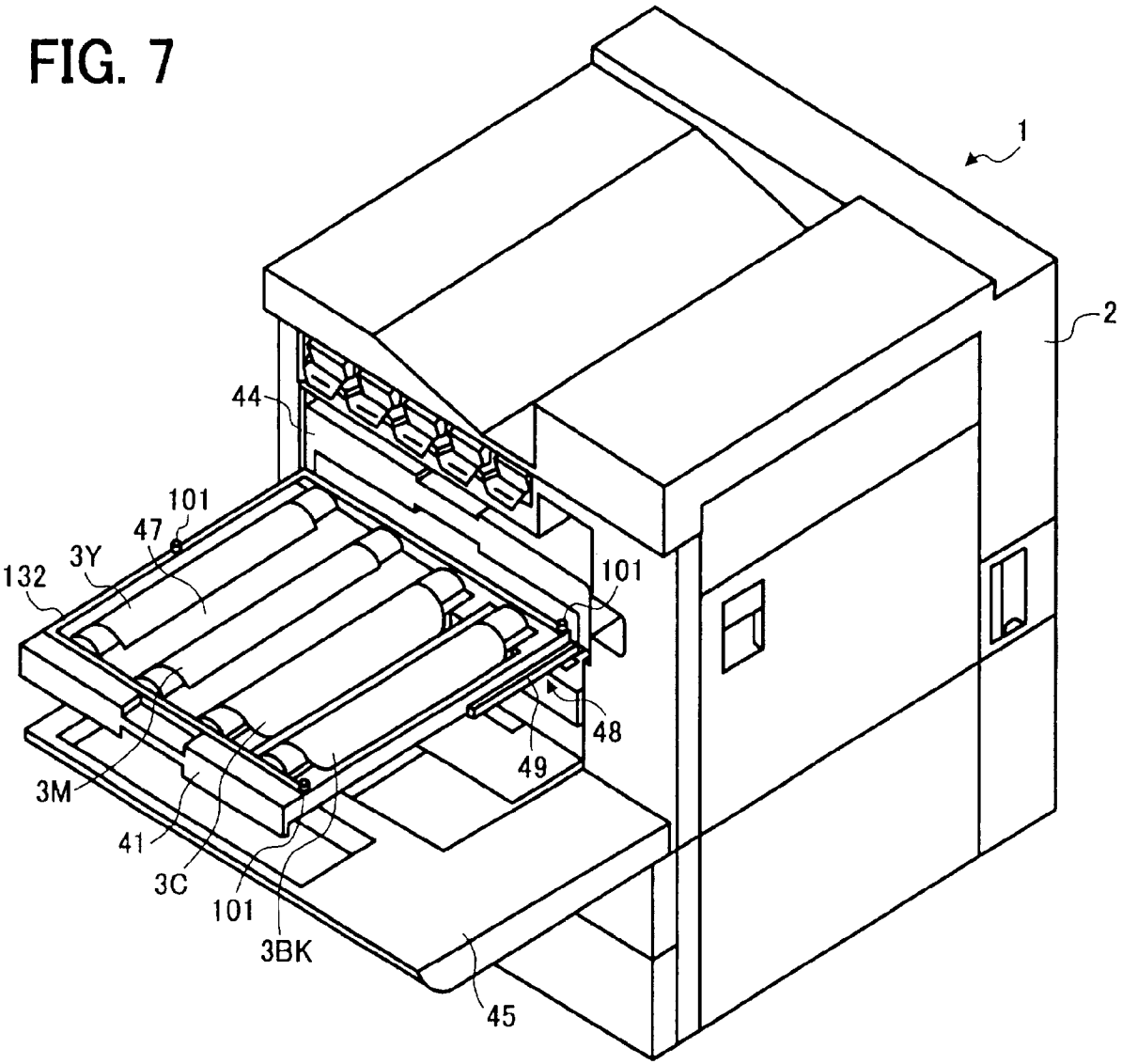
FIG. 7 is a drawing illustrating the image bearing member holding component formed in the shape of a rectangular frame such that the photoreceptors are simply placed thereon from above to be parallel to each other.
Figure 8:
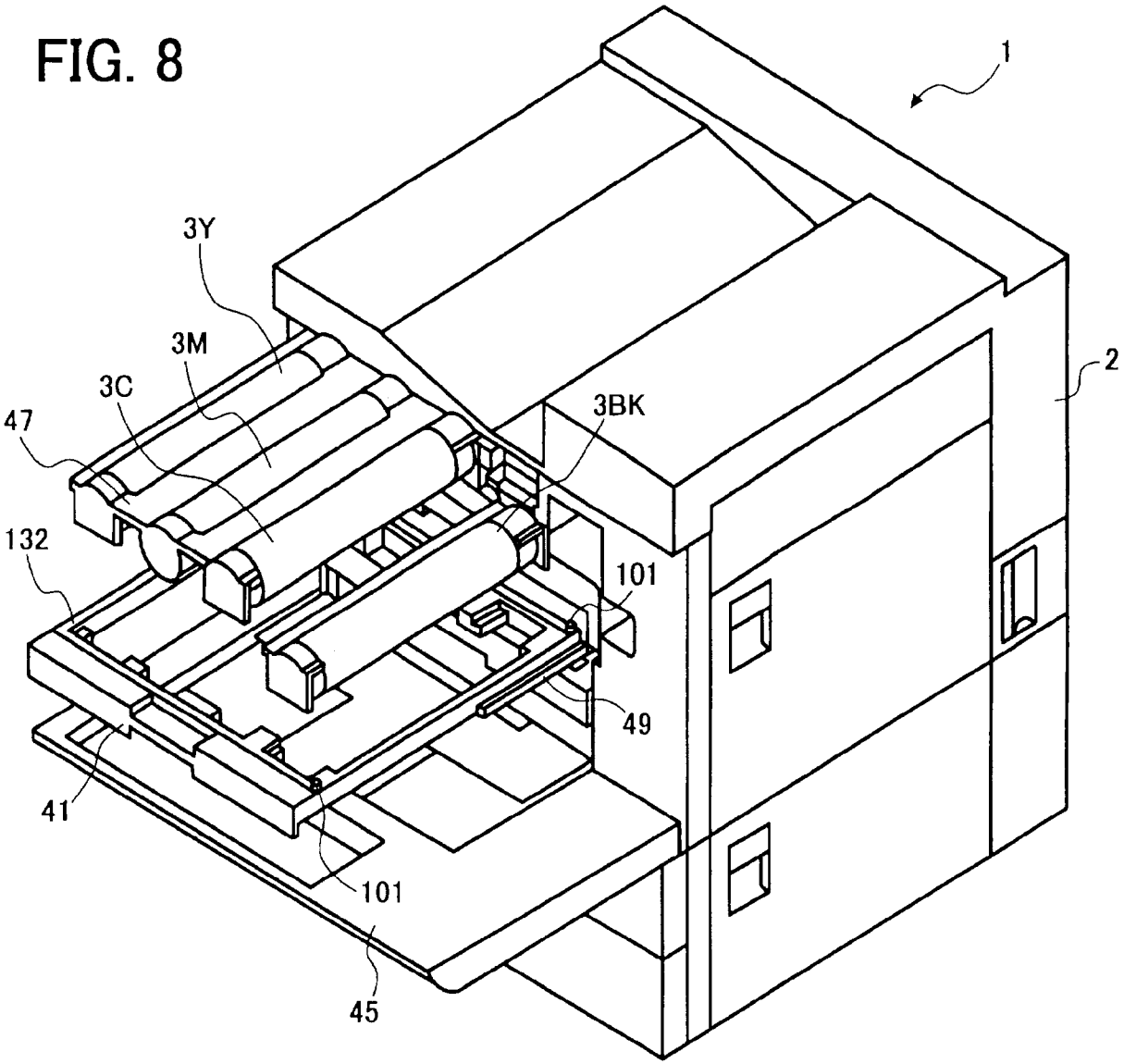
FIG. 8 a drawing illustrating the image bearing member holding component formed in the shape of a rectangular frame such that the photoreceptors are held detachably thereto.

With reference to FIGS. 7 and 8, the image bearing member holding component 41 disclosed herein is formed in the shape of a rectangular frame such that the photoreceptors 3Y, 3M, 3C and 3Bk, are simply placed thereon from above to be parallel to each other, and held detachably thereto.

In addition, from the practical consideration that photoreceptors 3Y, 3M, and 3C in use for forming color images differ in the operating frequency from photoreceptor 3Bk for black images (i.e., the photoreceptor 3Bk for black images used more frequently when monochrome printing is considered), the former photoreceptors 3Y, 3M, and 3C are taken in the present embodiment to be unified as a photoreceptor unit 47. Therefore, the thus formed photoreceptor unit 47 is made to be held detachably onto the image bearing member holding component 41.

In addition, the image bearing member holding component 41 is slidably mounted into and out of the main chases 2 by means of rail mechanisms 48 provided on both left and right sides thererof.

The part 49 shown also in the drawings is an accuride as a constituent of the rail mechanism 48 attached to the image bearing member holding component 41.

Figure 9:
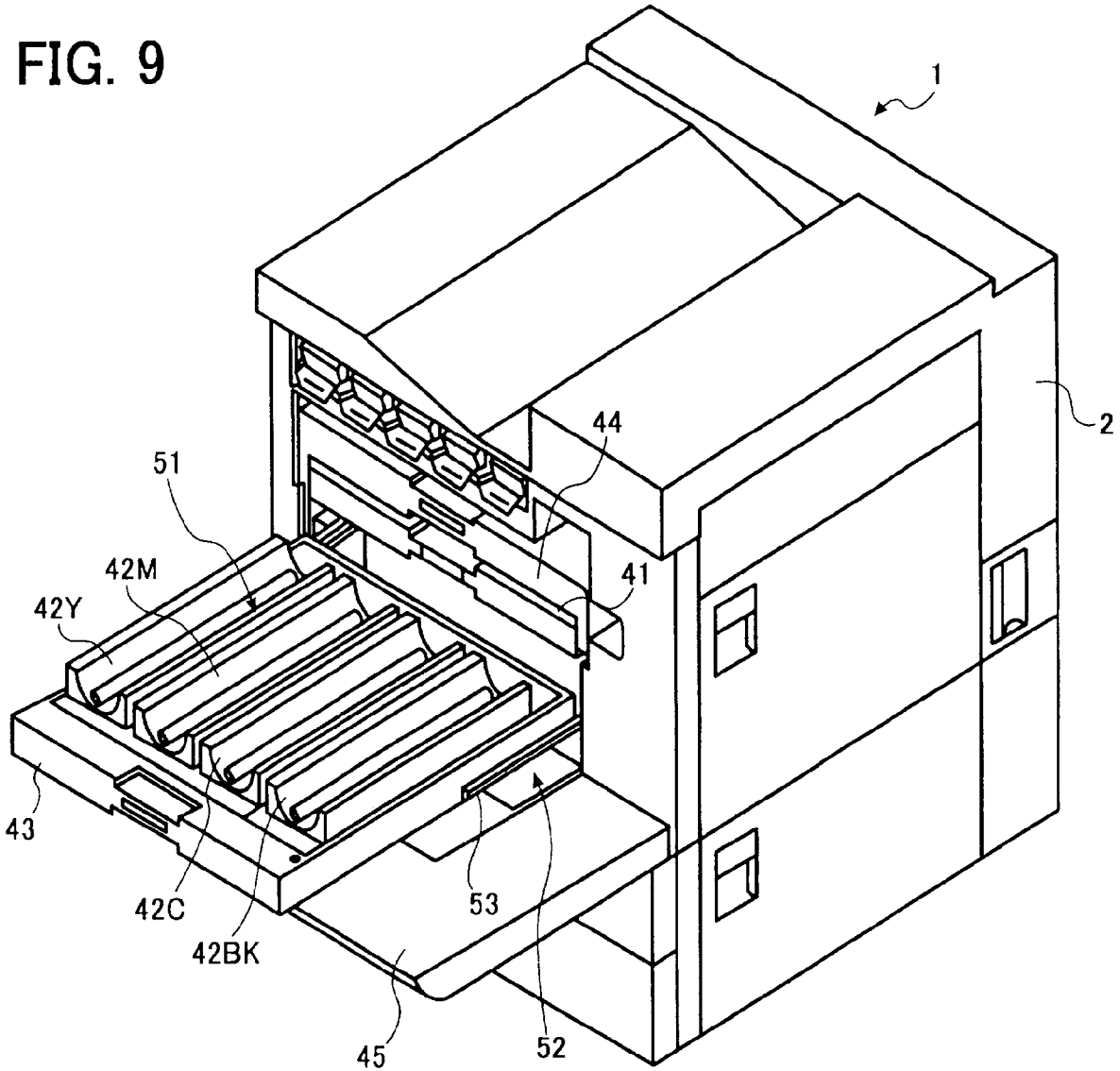
FIG. 9 is a drawing illustrating the image forming unit holding component formed in the shape of a rectangular frame such that the image forming units are simply placed thereon from above to be parallel to each other.
Figure 10:
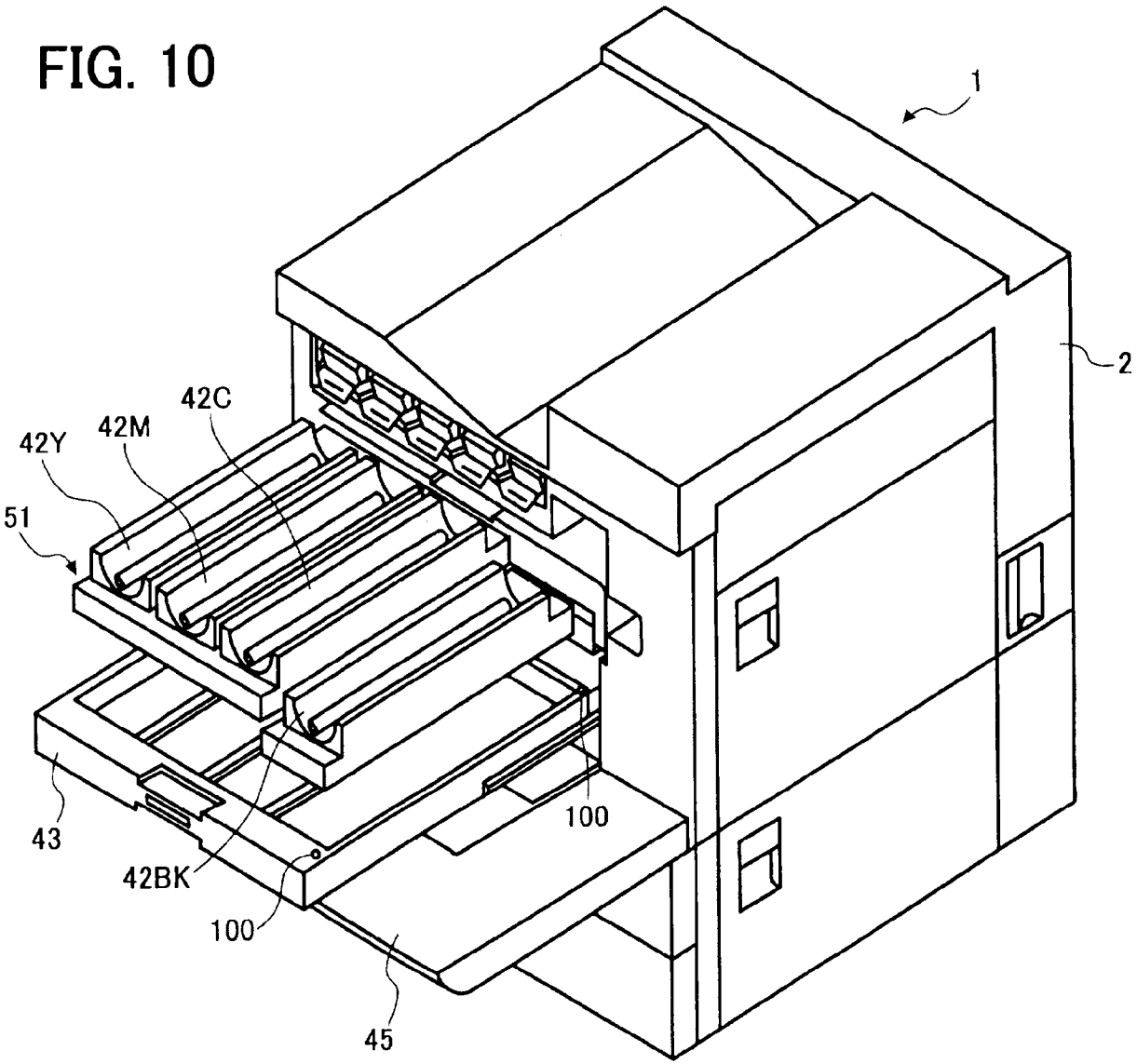
FIG. 10 is a drawing illustrating the image forming unit holding component formed in the shape of a rectangular frame such that the image forming units are held detachably thereto.

Now, with reference to FIGS. 9 and 10, the image forming unit holding component 43 disclosed herein is formed in the shape of a rectangular tray such that the image forming units 42Y, 42M, 42C and 42Bk, are simply placed thereon from above to be parallel to each other, and held detachably thereto.

In addition, corresponding the practical consideration made earlier with respect to the operating frequency of the photoreceptors 3Y, 3M, 3C and 3Bk, the image forming units 42Y, 42M and 42C are taken in the present embodiment to be unified as a color image forming unit 51 separately from the black image forming unit 42Bk. Therefore, the thus formed color image forming unit 51 is made to be held detachably onto image forming unit holding component 43.

Further, the image forming unit holding component 43 is slidably mounted into and out of the main chases 2 by means of rail mechanisms 52 provided on left and right sides thereof.

The part 53 shown also in the drawings is an accuride as a constituent of the rail mechanism 52 attached to image forming unit holding component 43.

Moreover, although not specifically illustrated in the drawings, narrow slit-shaped openings (or light transparent portions) are provided on the image forming unit holding component 43 and respective image forming units, 42Y, 42M, 42C and 42Bk, to serve as slits for allowing the passage of laser beams of the respective colors.

Figure 11:
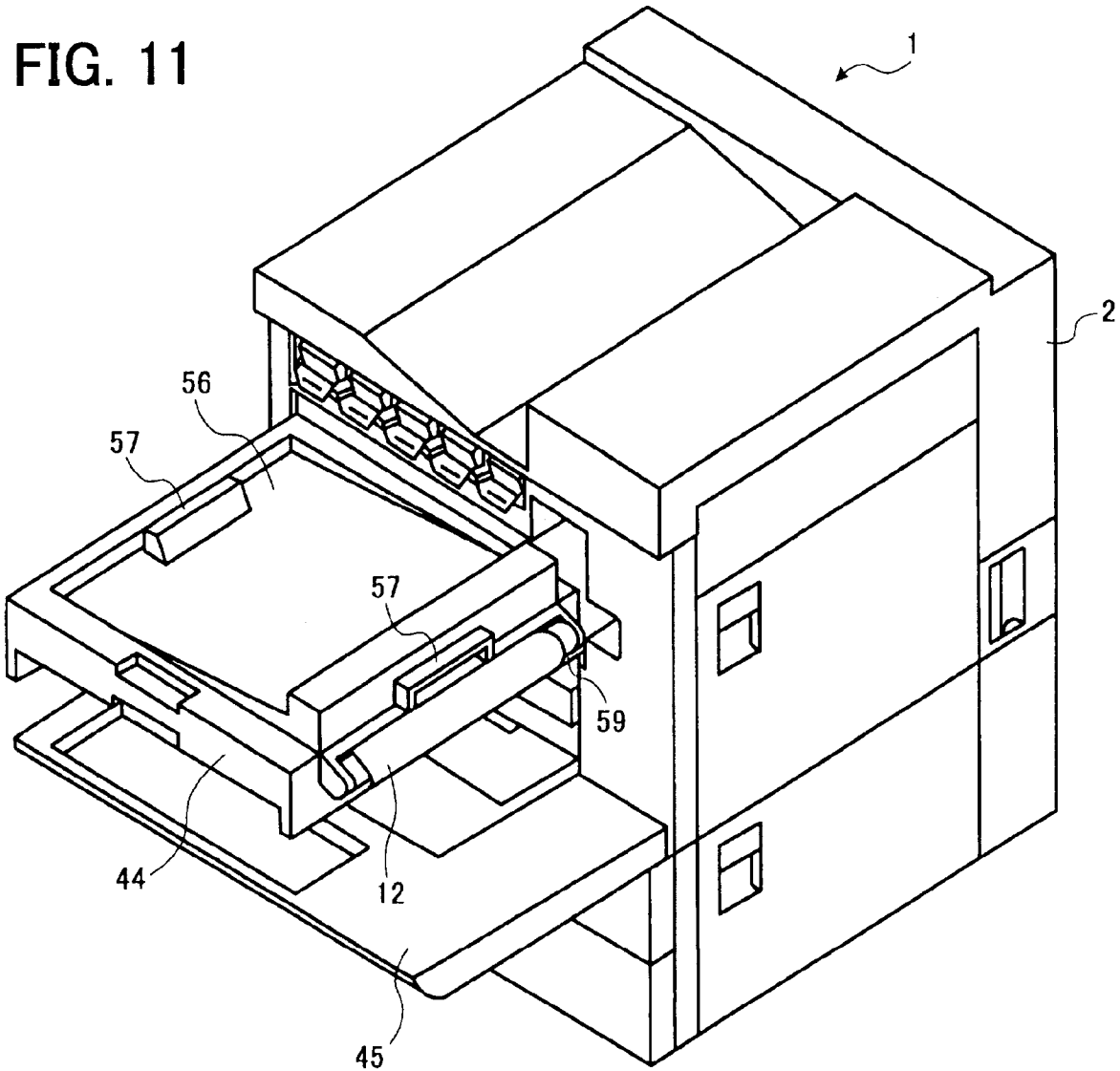
FIG. 11 is a drawing illustrating the transfer unit holding component formed in the shape of a rectangular frame such that the intermediate transfer belt together with a protection cover are simply placed thereon from above to be parallel to each other.
Figure 12:
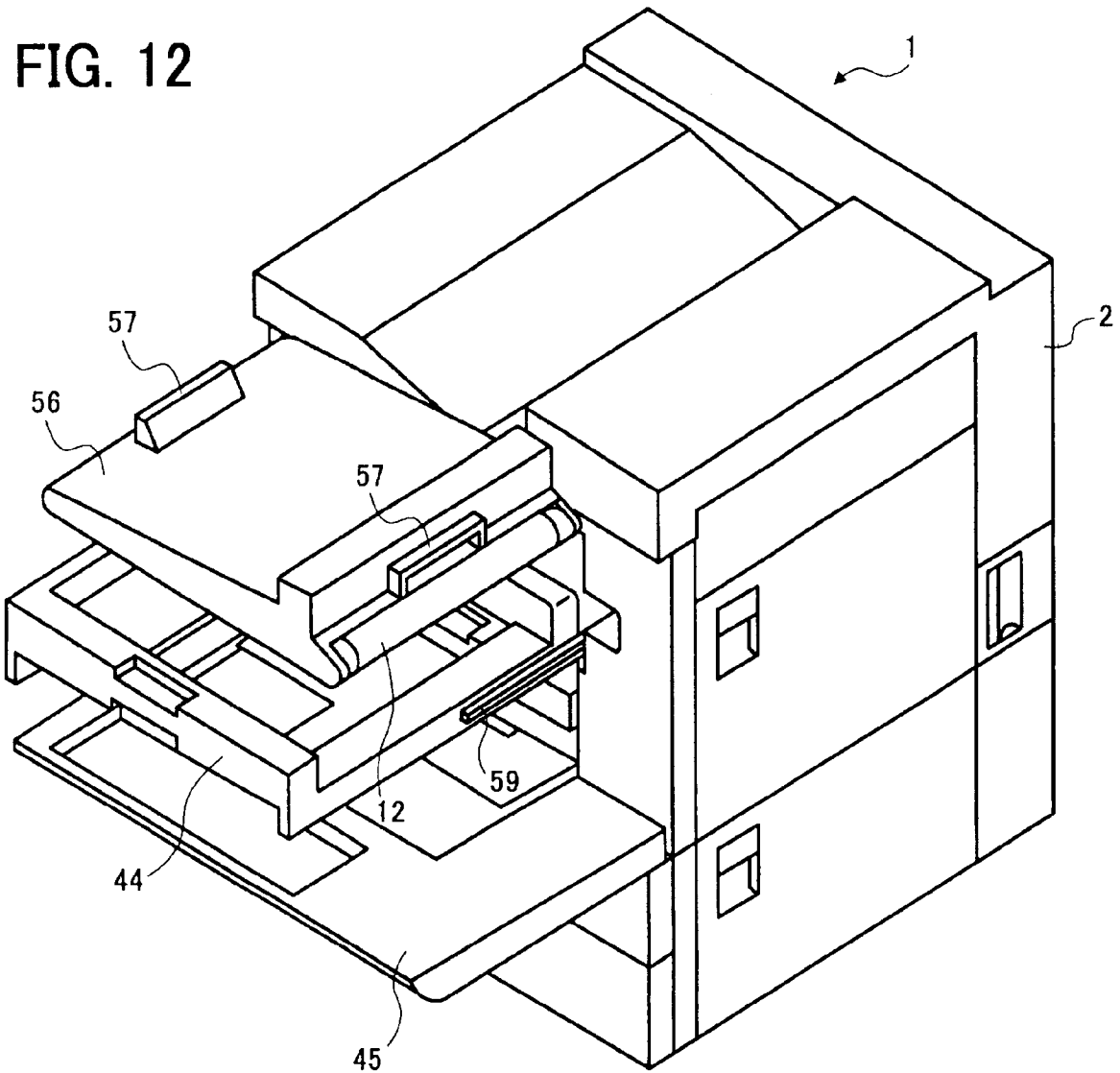
FIG. 12 is a drawing illustrating the transfer unit holding component formed in the shape of a rectangular frame such that the intermediate transfer belt together with a protection cover are held detachably thereto.

Referring to FIGS. 11 and 12, the transfer unit holding component 44 disclosed herein is formed in the shape of a rectangular frame such that the intermediate transfer belt 12 together with a protection cover 56, which holds rollers 9 through 11, and which covers the belt 12, are simply placed thereon from above and held detachably thereto.

A handle 57 is provided on both right and left sides of the protection cover 56. The thus formed transfer unit holding component 44 is slidably mounted into and out of the main chases 2 by means of rail mechanisms 58 provided on both left and right sides thereof.

The part 59 shown also in the drawings is an acuride as a constituent of the rail mechanism 58 attached to the transfer unit holding component 44.

In the construction of the transfer belt 17 in the present embodiment illustrated in FIG. 2, the belt 17 as the third image bearing member is also mounted detachably by means of a belt holding component 61.

Figure 13:
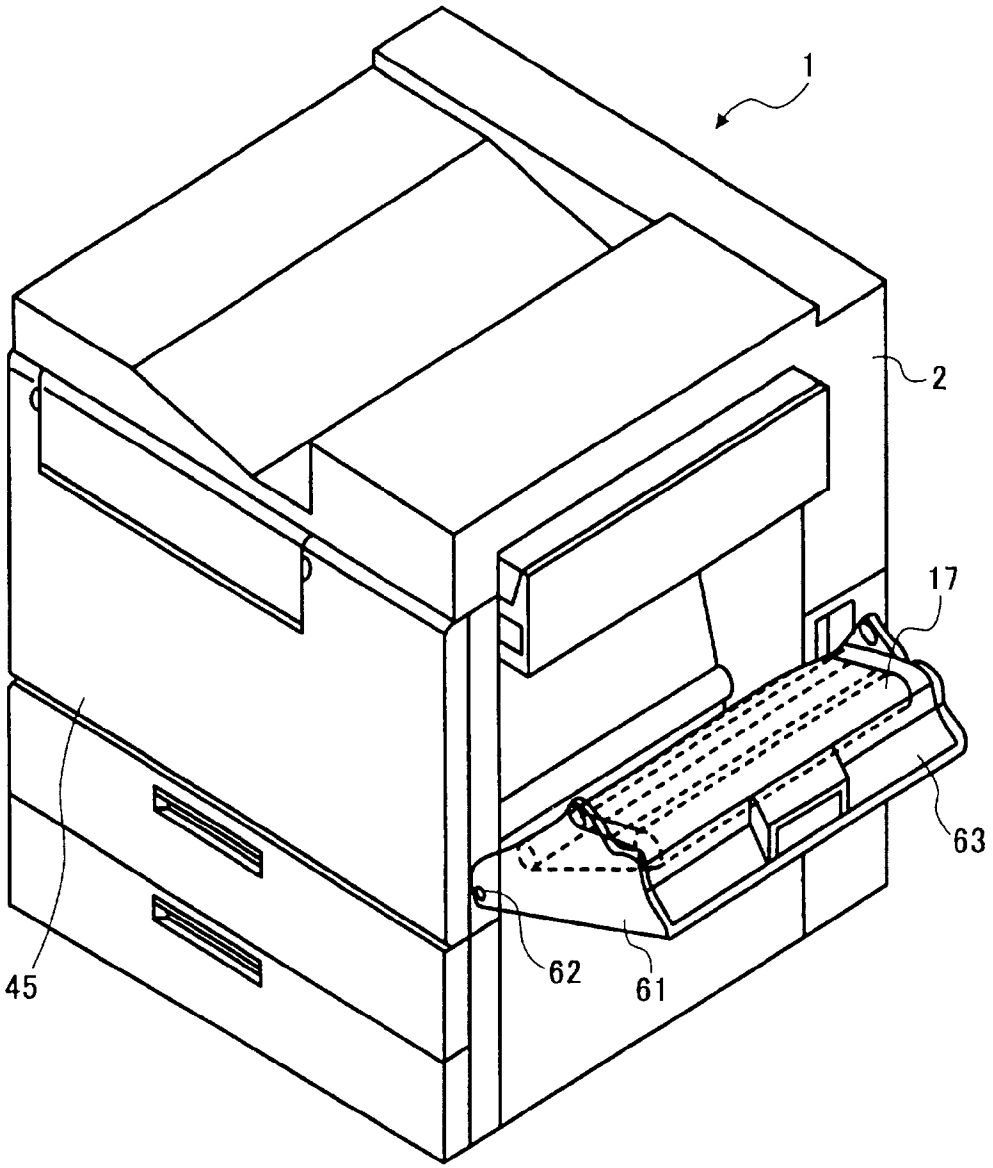
FIG. 13 is a drawing illustrating the belt holding component formed in the shape of a rectangular frame such that the transfer belt together with a protection cover are simply placed thereon from above to be parallel to each other.
Figure 14:
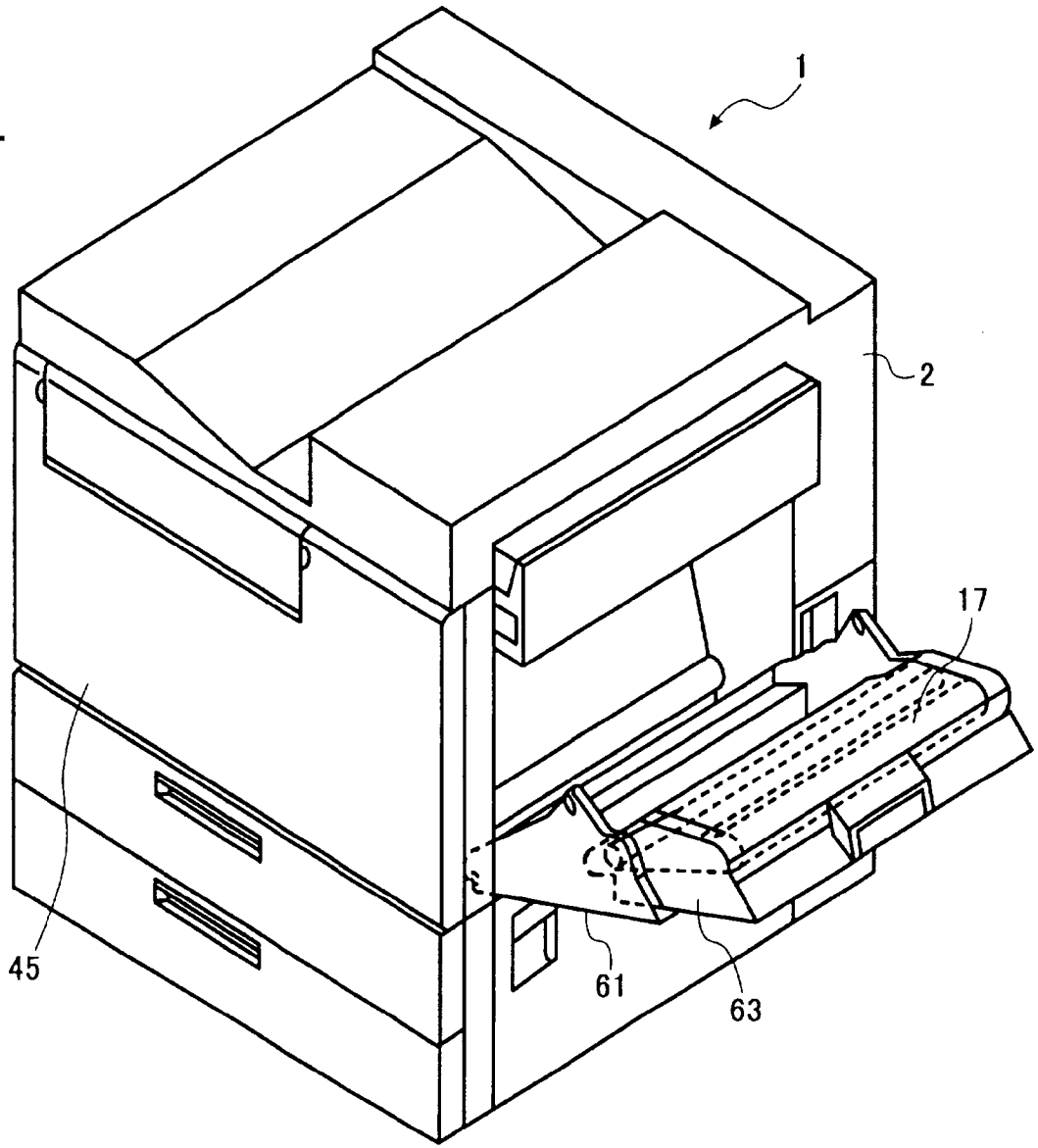
FIG. 14 is a drawing illustrating the belt holding component formed in the shape of a rectangular frame such that the transfer belt together with a protection cover are held detachably thereto.

The belt holding component 61 is, in turn, mounted to the main chases 2 being pivotable about the fulcrum 62 to be rotated for opening and closing movement, which serves also as a side cover. In addition, the belt holding component 61 is formed such that the transfer belt 17 together with a protection cover 63, which holds at least rollers 15 and 16, and which covers the transfer belt 17, are simply placed thereon from above and held detachably thereto (FIGS. 13 and 14).

There described herein below is one of the examples to illustrate fundamental construction of contact/detach mechanism 70 for carrying out contacting/detaching operations of holding components 41, 43, and 44 with reference to FIGS. 15A and 15B.

There provided are accuride pairs 71, 72 and 73, respectively supported by two main stays 74 which are provided bilaterally on right and left sides as viewed from the front being fixed to the main chases 2.

In addition, the accuride pairs 71, 72 and 73 are mounted on left and right sides so as to corresponding to the above noted accurides 49, 53 and 59 as the constituents of rail mechanisms 48, 52 and 58, respectively being attached to left and right sides of the holding components 41, 43 and 44.

Furthermore, in order for the holding components 43 and 44 be subjected to the separation movement in relation to the image bearing member holding component 41, the accuride pair 71 as the constituent of the image bearing member holding component 41 is mounted being fixed to the main stays 74, while the accuride pairs 71 and 72 as the constituents of the holding components 43 and 44, respectively, are mounted movably in the vertical direction through the guide by pins 72*a* and 72*b* engaged into vertically elongated holes 74*a* and 74*b*.

For the separation movement be carried out for both holding components 43 and 44, simultaneously, a linkage mechanism 75 is formed as follows: Two movable stays 77 and 78 each having a hole in the middle thereof are combined with a pin 76 penetrated though the holes to form the X-character shape. In addition, the both end of respective movable stays 77 and 78 are engaged to pins 72*a*, 72*b*, 73*a* and 73*b*, mounted horizontally to the respective faces of the accurides in the vicinity of the front and backside thereof, through elongated holes 77*a*, 77*b*, 78*a* and 78*b* formed again in the vicinity of both ends of respective movable stays 77 and 78, whereby the linkage mechanism 75 is formed so as the separation movement be carried out for both holding components 43 and 44, simultaneously.

Furthermore, four eccentric cams 79 are provided in the vicinity of four corners under the holding component 43, each being fixed to a rotation axis 81 which, in turn, is rotatably supported by a supporting piece 80.

The eccentric cam 79 is designed to have two characteristic positions, one protruded position and the other retracted. At the former position, the cam 79 serves to bring the image forming unit holding component 43 in contact with, or proximity to, the image bearing member holding component 41. In contrast, it serves to lower the holding component 43 owning to the weight thereof, thereby bringing to separation from the holding component 41.

The drive of the eccentric cams 79 is controlled so as to arbitrary select one of the above noted two characteristic positions through a drive transmission mechanism consisting of several units such as, for example, a motor 82, motor gear 83, transmission gear 84 which is fixed to the rotation axis 81 and engaged with the motor gear 83, and a belt 86 wound around two pulleys 85 which are each fixed to front and back rotation axes 81.

Figure 15A:
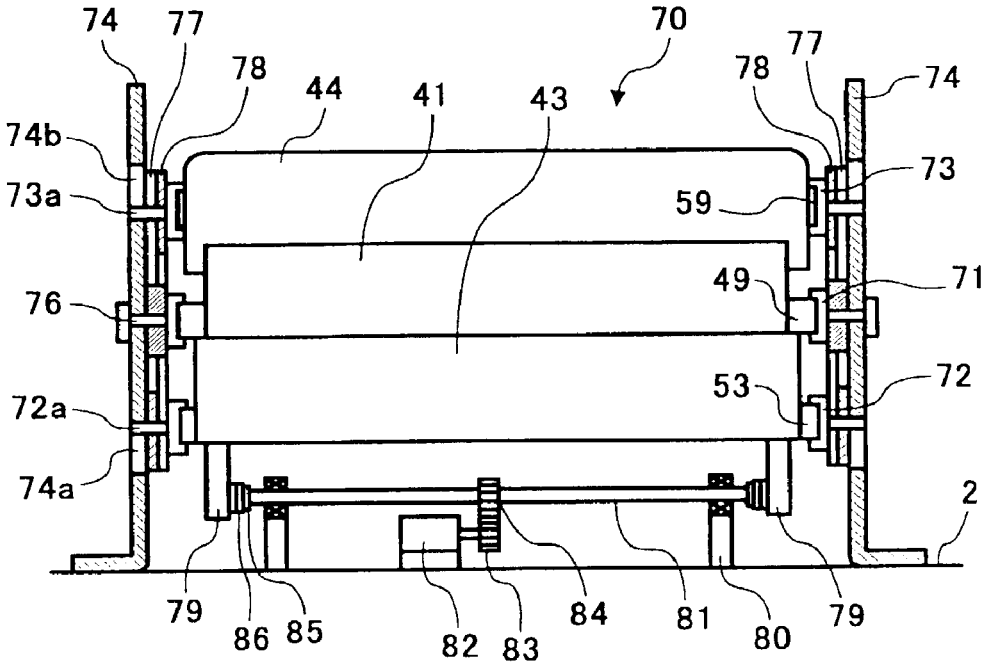
FIG. 15A is a drawing illustrating the fundamental construction of contact/detach mechanism for carrying out contacting/detaching operations of holding components in contact mode.
Figure 16A:
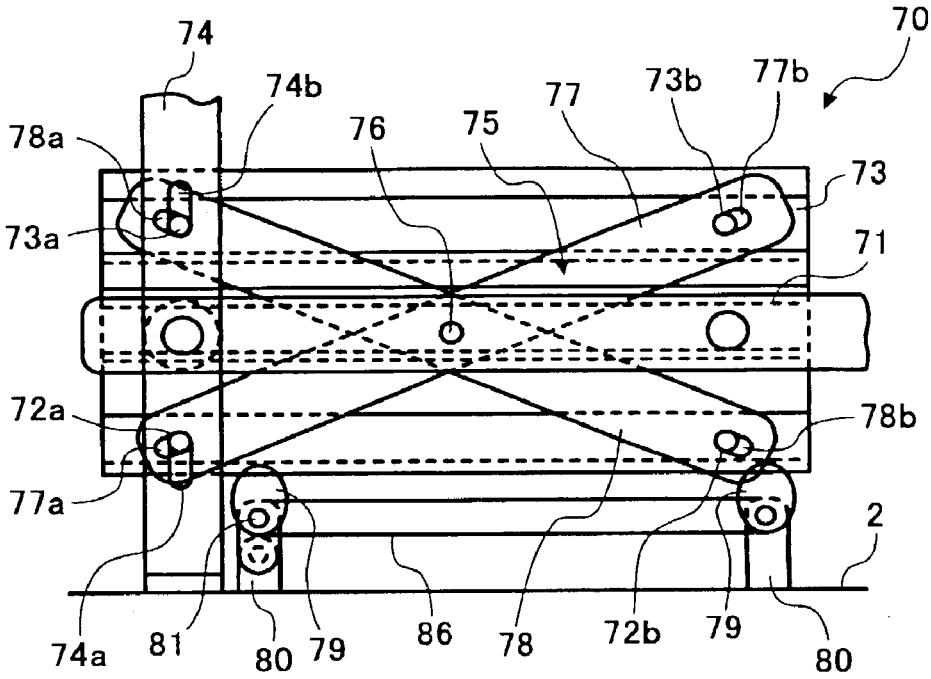
FIG. 16A is a side view illustrating the fundamental construction of contact/detach mechanism for carrying out contacting/detaching operations of holding components in contact mode.

At the position of the eccentric cams 79 with its protruded portion upright as shown in FIGS. 15A and 16A, the image forming unit holding component 43 is brought upward to the state in contact with, or pressed to, the image bearing member holding component 41.

During the above movement along with the upward movement of the image forming unit holding component 43, the movable stays 77 and 78 are rotated about the pins 72*a* and 72*b* so as to decrease the angel between these stays 77 and 78.

As a result, the accuride 73 is lowered through the rotation about the pins 73*a* and 73*b* engaged with elongated holes 77*b* and 78*b*, respectively, to thereby for the transfer unit holding component 44 to be lowered in contact with, or proximity to, the image bearing member holding component 41.

On arriving at the state of an image forming unit holding component 43 in contact with, or proximity to, the image bearing member holding component 41, several units of the image forming units 42 held in image forming unit holding component 43 are also brought in contact with corresponding photoreceptors 3, thereby being ready for the next image forming steps.

In a similar manner, on arriving at the state of an image forming unit holding component 44 in contact with the image bearing member holding component 41, the intermediate transfer belt 12 held in the transfer unit holding component 44 is also brought into contact with photoreceptors 3, thereby being ready for the next image forming steps.

Figure 15B:
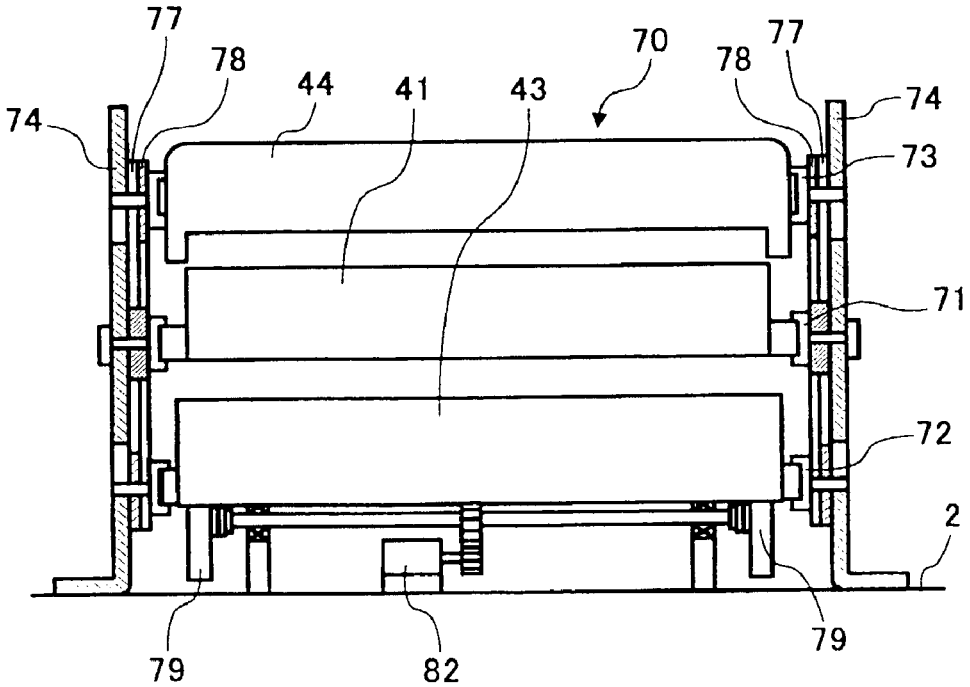
FIG. 15B is a drawing illustrating the fundamental construction of contact/detach mechanism in detached mode.
Figure 16B:
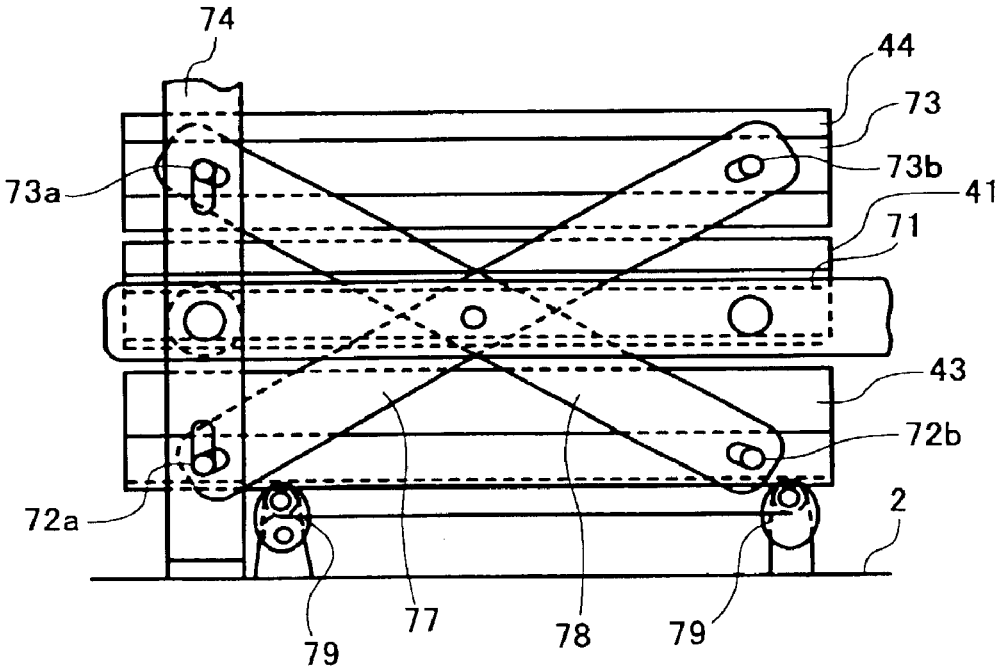
FIG. 16B is a side view illustrating the fundamental construction of contact/detach mechanism in detached mode.

In contrast, at the position of the eccentric cams 79 with its detracted portion upright as shown in FIGS. 15B and 16B, the image forming unit holding component 43 is lowered owning to the weight thereof, thereby bringing to separation from the holding component 41.

During the above movement along with the downward movement of the image forming unit holding component 43, the movable stays 77 and 78 are rotated about the pins 72*a* and 72*b* so as to decrease the angel between these stays 77 and 78.

As a result, the accuride 73 is raised through the rotation about the pins 72*a* and 72*b* engaged with elongated holes 77*b* and 78*b*, respectively, whereby the transfer unit holding component 44 is raised to be in separation from the image bearing member holding component 41.

On arriving at the state of an image forming unit holding component 43 in separation from the image bearing member holding component 41, several units of the image forming units 42 held in image forming unit holding component 43 are also detached from corresponding photoreceptors 3, thereby becoming slidable into or out of the main chases 2.

In a similar manner, on arriving at the state of an image forming unit holding component 44 in separation from the image bearing member holding component 41, the intermediate transfer belt 12 held in the transfer unit holding component 44 is also detached from photoreceptors 3, to thereby become slidable into or out of the main chases 2.

Therefore, the image forming unit holding component 43 and the transfer unit holding component 44 are capable of carrying out contact/detach movements in a cooperative manner in relation to the image bearing member holding component 41.

When either the energy-saving mode is enabled for the operation or its power switch is turned off with the thus constructed system, contact/detach movements are carried out by the contact/detach mechanism 70 disclosed herein for the image forming unit holding component 43 and the transfer unit holding component 44 in relation to the image bearing member holding component 41 in a cooperative manner.

As a result, by detaching the image forming unit holding component 43 and the transfer unit holding component 44 in relation to the image bearing member holding component 41, the several units of the image forming units 42 and the intermediate transfer belt 12 can also be detached and then remained as detached from respective photoreceptors 3.

Since an improved construction is made as disclosed herein above such that the plurality of photoreceptors 3 and image forming units 3, and the intermediate transfer belt 12 are held onto the image bearing member holding component 41, image forming unit holding component 4, and transfer unit holding component 44, respectively, and that these image bearing member holding component 41, image forming unit holding component 4, and transfer unit holding component 44 are provided to be detachable within the main chases 2, necessary contact/detach movements become feasible by means of a single integrated contact/detach mechanism 70 provided among the holding components 41, 43 and 44, without providing plural separated contact/detach mechanisms, one between each of the photoreceptors 3 and image forming unit 42, and the other between the plural photoreceptors 3 and intermediate transfer belt 12, for example.

The contact/detach mechanism can therefore be greatly simplified. In addition, the previous disadvantages such as contact residue images which is unduly caused by continual contact to the photoreceptors 3 by the several units of the image forming units 42 and the intermediate transfer belt 12, can be can be obviated with relatively simple and less expensive construction of the mechanism disclosed herein.

Especially, since the detaching movement of the image forming unit holding component 43, and that of the transfer unit holding component 44, both in relation to the image bearing member holding component 41, are herein adapted to be carried out simultaneously by the linkage mechanism 75, the contact/detach mechanism 70 can be made simpler by providing one power source 82 for use in driving plural units in common, as well as its control system which can also be simplified accordingly.

In contrast, the detaching movement of the image forming unit holding component 43 and transfer unit holding component 44 in relation to the image bearing member holding component 41 may also be carried out in case when a maintenance and/or parts exchange is requested by a user or service personnel.

Figure 5:
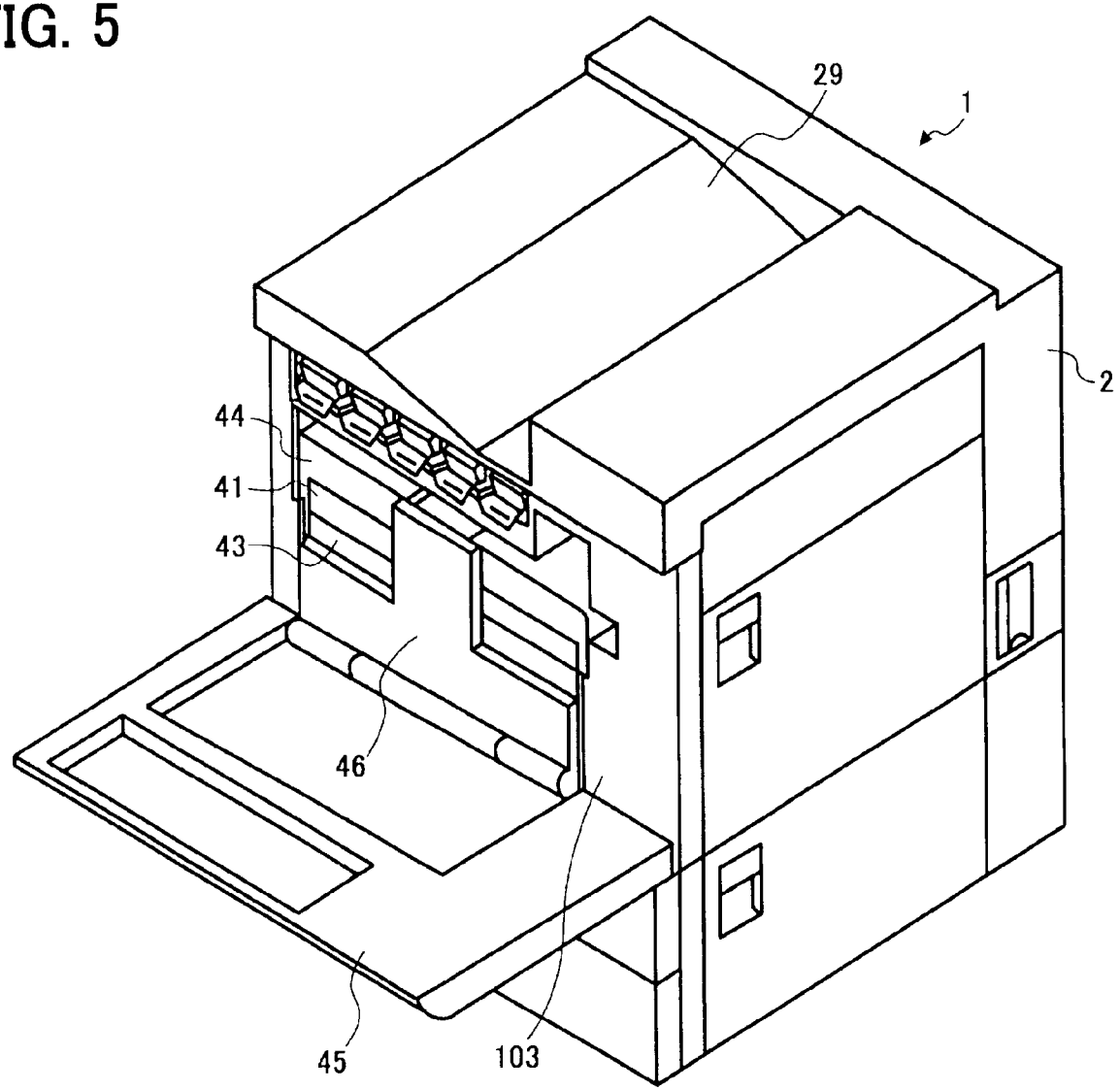
FIG. 5 is a drawing illustrating the outer cover released to open.
Figure 6:
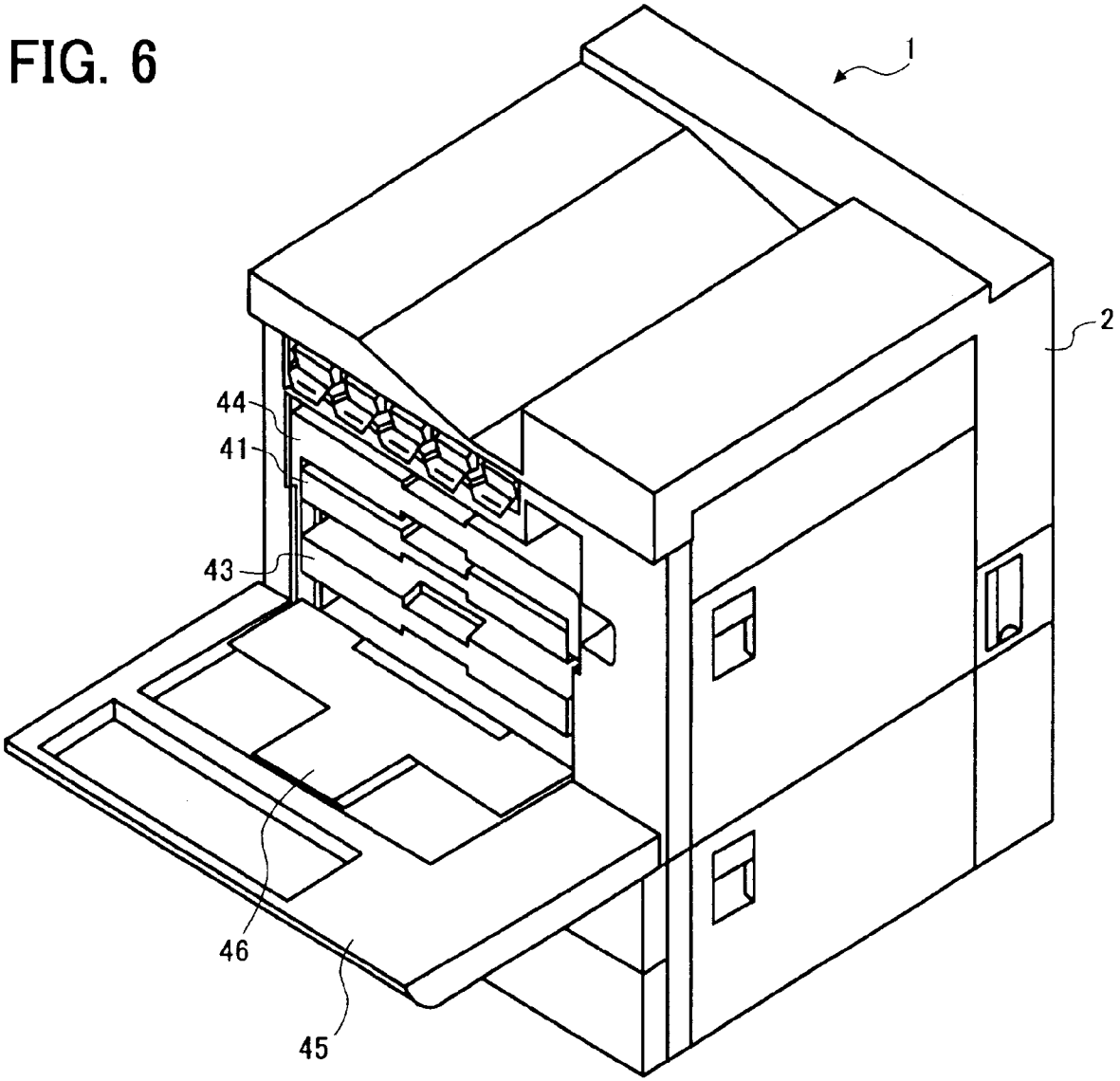
FIG. 6 is a drawing illustrating the inner cover released to open in addition to the outer cover.

In such case, the detaching movement can be initiated even when the energy-saving mode hasn't started, by releasing the frontal outer cover 45 to open, as shown in FIG. 5, and further opening the inner cover 46 shown in FIG. 6, in a similar manner described above, so that the image forming unit holding component 43 and transfer unit holding component 44 are brought into the detaching movement in relation to the image bearing member holding component 41 in a cooperative manner.

As a result, by detaching the image forming unit holding component 43 and the transfer unit holding component 44 from the image bearing member holding component 41, the several units of the image forming units 42 and the intermediate transfer belt 12 are detached and then remained as detached from respective photoreceptors 3. As a further result, each of the holding components 41, 43 and 44, becomes separately slidable out of the main chases 2.

For example, in case when maintenance and/or parts exchange works are required for the photoreceptors 3, it becomes feasible by the construction and method disclosed herein that the image bearing member holding component 41 is first pulled by sliding out of the main chases as shown in FIG. 7, and then the photoreceptors 3 (such as the photoreceptor unit 47 and photoreceptor 3Bk) can be taken out from holding component 41 for some of the photoreceptors 3 to subsequently be replaced, as shown in FIG. 8.

In such a case, since the photoreceptor unit 47 and photoreceptor 3Bk are simply held onto the image bearing member holding component 41 even in the aforementioned durable disassembly type structure presently undertaken, the replacement thereof can be carried out with relative ease.

As to the photoreceptors 3, in addition, the durability may well be assumed in general approximately equal to each of the photoreceptors 3Y, 3M, and 3C. Since these photoreceptors 3Y, 3M, and 3C are herein detachably held together as one photoreceptor unit as described earlier, the replacement workability is further increased with the present structure for the photoreceptors.

Conversely, the durability for the photoreceptor 3Bk has to be appropriately taken into consideration in comparison with that of other color photoreceptors 3Y, 3M, and 3C.

That is, the photoreceptor 3Bk in use for forming black images is generally considered to be used more frequently and, accordingly, to have a shorter durability, and the replacement thereof has to be carried out with a period different from that of color photoreceptors 3Y, 3M, and 3C, thereby obviating a shortcoming such as a too early replacement of the color photoreceptors 3Y, 3M, and 3C, which may be caused if the photoreceptor 3Bk and color photoreceptors 3Y, 3M, and 3C are replaced altogether simultaneously.

In the present disclosure, since the photoreceptor 3Bk is held as another unit detached from the above noted unit including 3Y, 3M, and 3C, the replacement can be carried out at proper timing individually one for the photoreceptor 3Bk and the other for the color photoreceptors 3Y, 3M, and 3C, the above noted difficulty, e.g., too early replacement of the latter, can be obviated.

In addition, in case when maintenance and/or parts exchange works are required for the image forming unit 42, it becomes feasible that the image bearing member holding component 43 is first pulled sliding out of the main chases as shown in FIG. 9, and then the image forming unit 42 (such as color image forming unit 51 and image forming unit 42Bk) can be taken out from the holding component 43 for some of the units to subsequently be replaced as shown in FIG. 10.

In such a case, since color image forming unit 51 and image forming unit 42Bk are simply held onto the image bearing member holding component 43, the replacement thereof can be carried out with relative ease.

As to the color image forming units 42Y, 42M and 42C, may be assumed to be approximately equal each other in characteristics and durability. Since these color image forming units 42Y, 42M and 42C, are herein detachably held together as one color image forming unit 51 as described earlier, the replacement workability is further increased with the present structure for the image forming unit 42.

Conversely, the durability for the forming unit 42Bk has to be appropriately taken into consideration in comparison with that of the color image forming units 42Y, 42M and 42C.

That is, the forming unit 42Bk in use for forming black images is generally considered to be used more frequently and, accordingly, to have a shorter durability, and the replacement thereof has to be carried out with a period different from that of color image forming units 42Y, 42M and 42C, thereby obviating a shortcoming such as a too early replacement of the color image forming units 42Y, 42M and 42C, which may be caused if the image forming unit 42Bk and color image forming units 42Y, 42M and 42C are replaced altogether simultaneously. In the present disclosure, since the image forming unit 42Bk is held as one unit detached from the above noted unit including 42Y, 42M and 42C the replacement can be carried out at proper timing individually one for image forming unit 42Bk and the other for color image forming units 42Y, 42M and 42C, the above noted too early replacement of the latter can be obviated.

Furthermore, in case when maintenance and/or parts exchange works are required for intermediate transfer belt 12, it becomes feasible that the transfer unit holding component 44 is first pulled sliding out of the main chases as shown in FIG. 11, and then the intermediate transfer belt 12 can be taken out from the transfer unit holding component 44 to subsequently be replaced as shown in FIG. 12.

In such a case, since intermediate transfer belt 12 is simply held onto the transfer unit holding component 44, the replacement thereof can be carried out with relative ease.

In addition, as shown in FIGS. 8, 10 and 12, the movements for detaching is herein designed to be directed upward for all the photoreceptors 3, image forming units 42 and intermediate transfer belt 12. The replacement workability is further increased considerably.

Also, in case when the frontal outer cover 45 is released to open for maintenance and/or parts exchange operation, the movements drawing out of the chases of the holding components 41, 43 and 44 can be carried out immediately after detachment movements for these holding components 41, 43 and 44, which are made through the detachment movements between the holding components 41 and 43, and 41 and 44, without any further detachment operation required. As a result, operationality is considerably increased for the user and maintenance personnel.

Figure 17A:
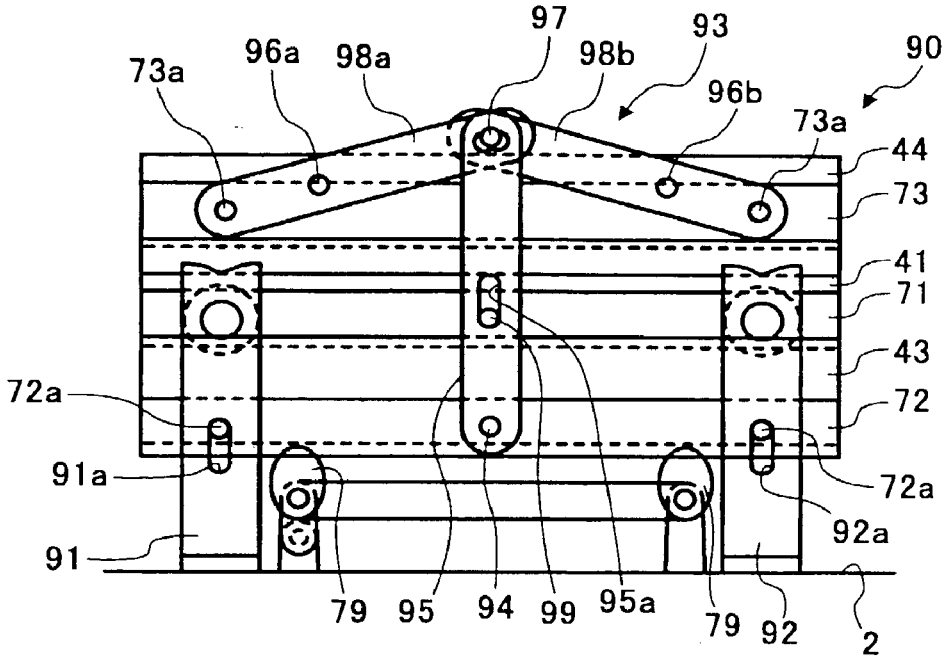
FIG. 17A is a side view illustrating the fundamental construction of a further contact/detach mechanism for carrying out contacting/detaching operations of holding components in contact mode.
Figure 17B:
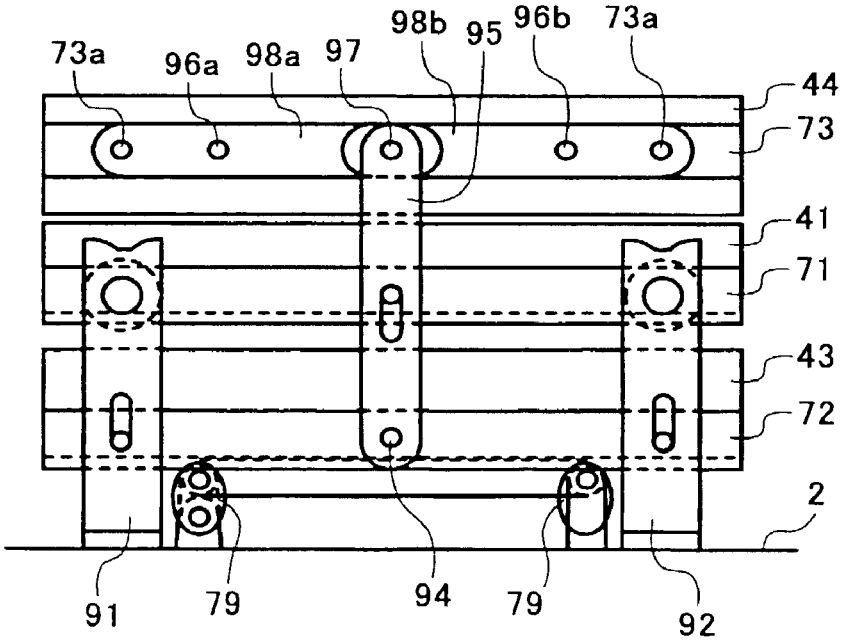
FIG. 17B is a side view illustrating the fundamental construction of a further contact/detach mechanism in detached mode.

Referring now to FIGS. 17A and 17B, the contact/detach mechanism 90 will be described herein below as a modification of the mechanism 70.

There provided are accuride pairs 71, 72 and 73, respectively supported by two main stays 91 and 92, which are provided bilaterally on front and back sides as viewed from the front being fixed to the main chases 2.

In addition, the accuride pairs 71, 72 and 73 are mounted on left and right sides so as to correspond to the holding components 41, 43 and 44.

Furthermore, in order for the holding components 43 and 44 be subjected to the detachment movements in either upward or downward direction in relation to the image bearing member holding component 41, the accuride pair 71 as the constituent of the image bearing member holding component 41 is mounted being fixed to the main stays 91 and 92, while the accuride pairs 71 and 72 as the constituents of the holding components 43 and 44, respectively, are mounted movably in the vertical direction through the guide by pins 72*a* and 72*b* engaged into vertically elongated holes 91*a* and 92*a* (only the side of the accuride pair 72 is shown herein).

For the detachment movements be carried out for both holding components 43 and 44, simultaneously, a linkage mechanism 93 is also formed as follows: The main driving stay 95 is first provided vertically movably either upward or downward by connected to a pin 94 mounted on the accuride 72 of the image forming unit holding component 43. Front and back driven stays 98*a* and 98*b* are further provided such that one ends thereof are pivotably engaged with the pin 96*a* and 96*b* mounted on the main driving stay 95, respectively, and that the other ends thereof are engaged with pin 73*a* on the accuride 73 attached to the transfer unit holding component 44.

In addition, a further pin 99 is mounted on the accuride 71 of the image bearing member holding component 41. Through an elongated hole 95*a* engaged with the pin 99, the vertical movements of the main driving stay 95 can be guided either upward or downward, whereby the linkage mechanism 93 is formed.

It may be noted that further units are additionally included such as eccentric cams 79, motor 82 and others in the contact/detach mechanism 90, in a similar manner to the aforementioned mechanism 70, to arbitrary select one of the aforementioned two characteristic positions.

With the present construction of the contact/detach mechanism 90, and at the position of the eccentric cams 79 with its protruded portion upright as shown in FIG. 17A, the image forming unit holding component 43 is brought upward to the state in contact with, or pressed to, the image bearing member holding component 41. During the above movement along with the upward movement of the image forming unit holding component 43, the main driving stay 95 is also displaced upward.

Since the driven stays 98*a* and 98*b* are previously connected to the main driving stay 95 through the pin 97, the stays 98*a* and 98*b* are pivoted about the pin 96*a* and 96*b*, respectively.

As a result, the accurides 73 is lowered with the pins 72*a* and 73*a* which are engaged with the other end thereof, whereby the transfer unit holding component 44 is brought downward to the state in contact with, or pressed to, the image bearing member holding component 41.

In contrast, at the position of the eccentric cams 79 with its detracted portion upright as shown in FIG. 17B, the image forming unit holding component 43 is lowered owning to the weight thereof, thereby bringing to separation from the image bearing member holding component 41. During the above movement along with the downward movement of the image forming unit holding component 43, the main driving stay 95 is also lowered.

Since the driven stays 98*a* and 98*b* are previously connected to the main driving stay 95 through the pin 97, the stays 98*a* and 98*b* are pivoted about the pin 96*a* and 96*b*, respectively.

As a result, the accurides 73 is raised with the pins 72*a* and 73*a* which are engaged with the other end thereof, whereby the transfer unit holding component 44 is raised to be in separation from the image bearing member holding component 41.

Therefore, the image forming unit holding component 43 and the transfer unit holding component 44 are capable of carrying out contact/detach movements in a cooperative manner in relation to the image bearing member holding component 41.

In addition, in case when maintenance and/or parts exchange works are required for transfer belt 17, it becomes feasible that the transfer unit holding component 61 is released by rotating about a fulcrum 62 as shown in FIG. 13, and then the transfer belt 17 can be removed from the transfer unit holding component 61 to subsequently be replaced as shown in FIG. 14.

In such a case, since the transfer belt 17 is simply held onto the transfer unit holding component 61, the replacement thereof can be carried out with relative ease.

There described herein below are the units and methods for positioning the holding components 41, 43, and 44. These holding components are subjected to positioning movements in relation to the image bearing member holding component 41, as a standard, the vertical position of which is previously fixed in the present embodiment.

The positioning movements are carried out as follows: There provided are a plurality of, for example, three of positioning pins 101 placed at predetermined locations suitably separated each other for proper positioning on the upper face of the image bearing member holding component 41.

Although no specific illustration is included in the drawing, additional three positioning pins are similarly provided on the lower face of the holding component 41.

Figure 18:
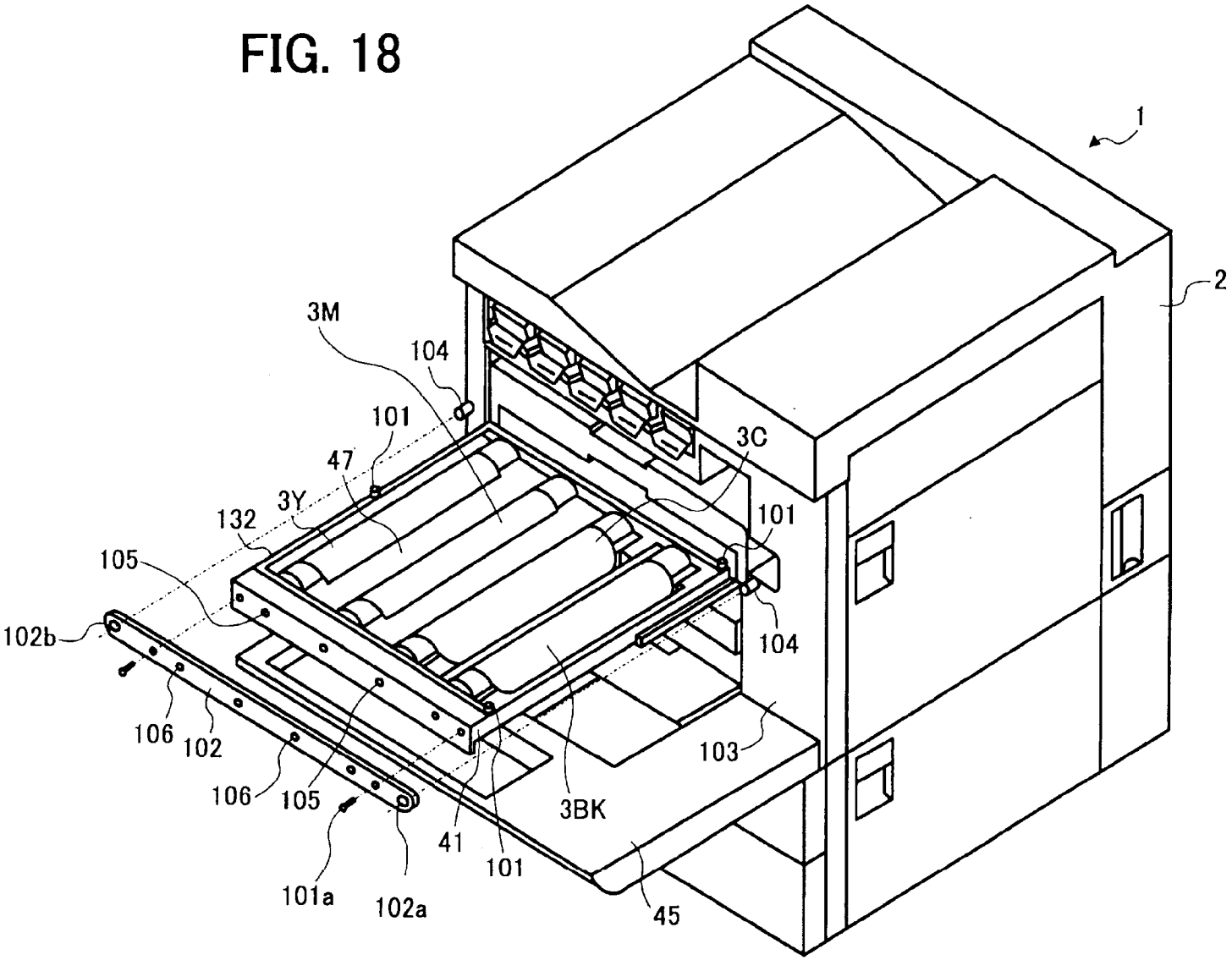
FIG. 18 is a drawing illustrating the units and methods for positioning the holding components.

In addition, positioning holes 102 are provided as positioning parts on the upper face of the image forming unit holding component 43 at the locations for precise fitting respective positioning pins (FIG. 18). In a similar manner, further positioning holes (not shown) are provided as positioning parts on the lower face of the transfer unit holding component 44 at the locations for fitting the positioning pins.

Therefore, when the holding components 41, 43 and 44 are brought into contact with, or proximity to each other as shown in FIGS. 4*a* and 15*a*, the positioning there between can be carried out by properly engaging respective pairs of positioning pins and holes.

Since respective holding components are thus provided with own pairs of positioning parts to be utilized for positioning, the positioning among individual photoreceptor 3, image forming unit 5 and intermediate transfer belt 12 can be achieved by positioning only the above noted pairs, thereby un-necessitating complicated positioning steps otherwise required for the above individual units.

It may be added the positioning of the image bearing member holding component 41 itself in relation to the main chases 2 is carried out as follows: After the position of the image bearing member holding component 41 is first determined by placing on the rail mechanism 48 (FIG. 7), a further positioning is carried out as shown FIG. 18 by fitting right and left base holes 102*a* and 102*b*, which are formed bilaterally on the both ends of a narrow metal plate 102 fixed by a screw 101 to the frontal edge of the holding component 41, to positioning pins 104 provided respectively at predetermined positions on the frontal chases board 103.

The base holes 102*a* and 102*b* formed on the metal plate 102, and the positioning pins 104 provided at predetermined positions on the frontal chases board 103, therefore, serve as the image bearing member holding component controlling component.

As to the positioning of the photoreceptors 3Y, 3M, 3C and 3Bk detachably held on the image bearing member holding component 41, this positioning is carried out by firstly providing photoreceptor supporting axes (not shown) for respective photoreceptors, which are each attached rotatably to the aforementioned drive transmission mechanism in the cantilever manner, and properly positioned at the back portion in the main chases; and secondly supporting these supporting axes by fitting into respective bearing holes 106 formed being situated at predetermined locations on a metal plate 102, along sliding movements for the image bearing member holding component 41 into the main chases 2 through respective through holes formed on the rear face of the holding component 41, the interiors of respective photoreceptors, and respective through holes formed on the frontal face of the holding component 41.

Therefore, the photoreceptor supporting axes, which are held in the cantilever manner and properly positioned at the back portion in the main chases, and the bearing holes 106 formed on the metal plate 102, serve as an image bearing member holding component positioning component.

That is, since the supporting axes are removed from the photoreceptors 3Y, 3M, 3C and 3Bk (or left behind in the chases 2) by sliding the holding component 41 out of the main chases 2 in the present construction, the photoreceptors 3Y, 3M, 3C and 3Bk can be brought to be simply held on the holding component 41 with a certain degree of positional allowance, whereby it becomes feasible for the photoreceptors 3Y, 3M, 3C and 3Bk to be dismounted by simply lifting upward.

Next, the positioning for the image forming unit 42 and intermediate transfer belt 12 will be exemplified herein below in relation to the photoreceptors 3Y, 3M, 3C and 3Bk, positioned as above.

Figure 19B:
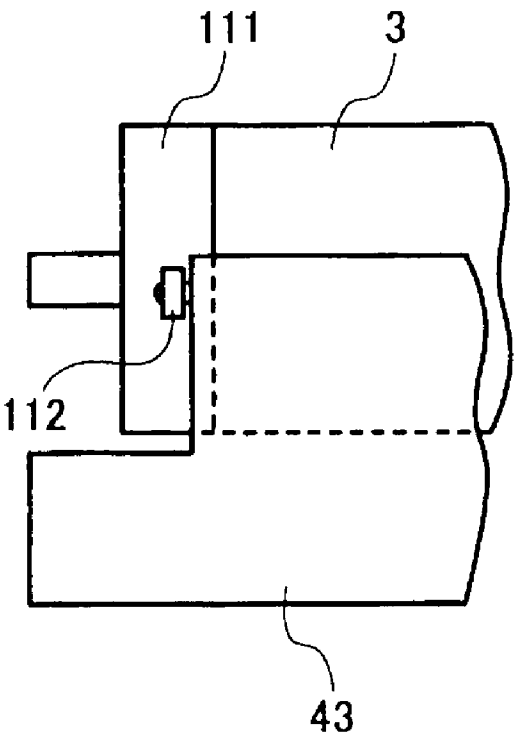
FIGS. 19A and 19B are cross sectional views illustrating the image forming unit in still another embodiment provided with a plurality of positioning rollers.
Figure 19A:
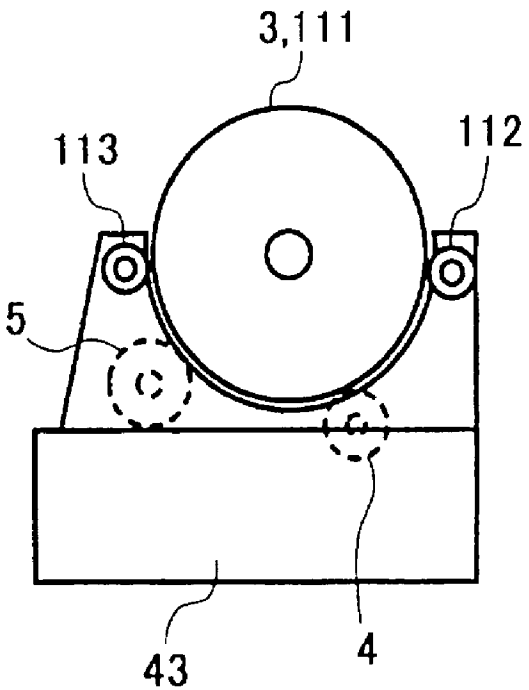

Referring to FIGS. 19A and 19B of the drawing illustrating the image forming unit 42 in the present embodiment, there provided are a plurality of, for the present example, two of positioning rollers 112 and 113, which are detachably and rotatably provided in contact with the wheel 111 which is mounted coaxially with, and has the same diameter as, the photoreceptor 3. In addition, the wheel 111 is situated outside of the region active in image formation.

As aforementioned, the image forming unit holding component 43 is detachably provided in relation to the image bearing member holding component 41. When the image forming unit holding component 43 is raised to be in contact with, or in proximity of the holding component 41 during the image forming steps, the developing roller 5 and charging roller 4 also approach to the previously positioned photoreceptors 3 to such an extent that the positioning rollers 112 and 113 are in contact already with the wheel 111 to thereby no further approach is feasible. This position of contact is in fact the normal position of the developing roller 5 and charging roller 4 in relation to the photoreceptors 3 for forming images, whereby the positioning of the image forming unit 42 is achieved in relation to the photoreceptors 3. That is, both wheel 111 and positioning rollers 112 and 113 serve as an image forming unit positioning mechanism.

Although no specific illustration is included in the drawing, the positioning of the intermediate transfer belt 12 in relation to the photoreceptors 3 can be carried out in a similar manner.

According to the present embodiments, as described above, the photoreceptors 3Y, 3M, 3C and 3Bk and image forming units, 42Y, 42M, 42C and 42Bk are detachably held with a certain positional allowance in relation to the image bearing member holding component 41 and image forming unit holding component 43; respective photoreceptors 3Y, 3M, 3C and 3Bk are properly positioned in relation to the image bearing member holding component 41 and image forming unit holding component 43, both mounted in the main chases 2; and several units included in respective image forming units, 42Y, 42M, 42C and 42Bk are positioned in relation to the photoreceptors 3Y, 3M, 3C and 3Bk, positioned as above.

As a result, since there is required not so much accuracy as before for the assembly of respective holding components 41 and 43 themselves, not so much caution is needed during mounting/demounting steps, whereby work operation becomes feasible with relative ease even for a customer.

It may further be added this is also true for the positioning steps of the intermediate transfer belt 12 in relation to the photoreceptors 3.

In addition, the positioning of the belt holding component 61 will be described herein below on the side of the transfer unit holding component 44.

Figure 20A:
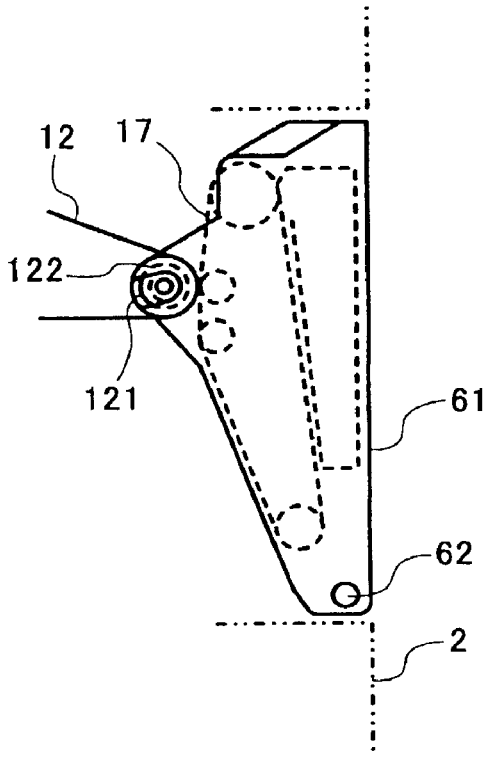
FIGS. 20A and 20B are drawings illustrating positioning pulleys as positioning units placed on the both ends of the axis of the roller which supports the intermediate transfer belt, and positioning grooves as positioning units detachably engaged with the positioning pulleys.
Figure 20B:
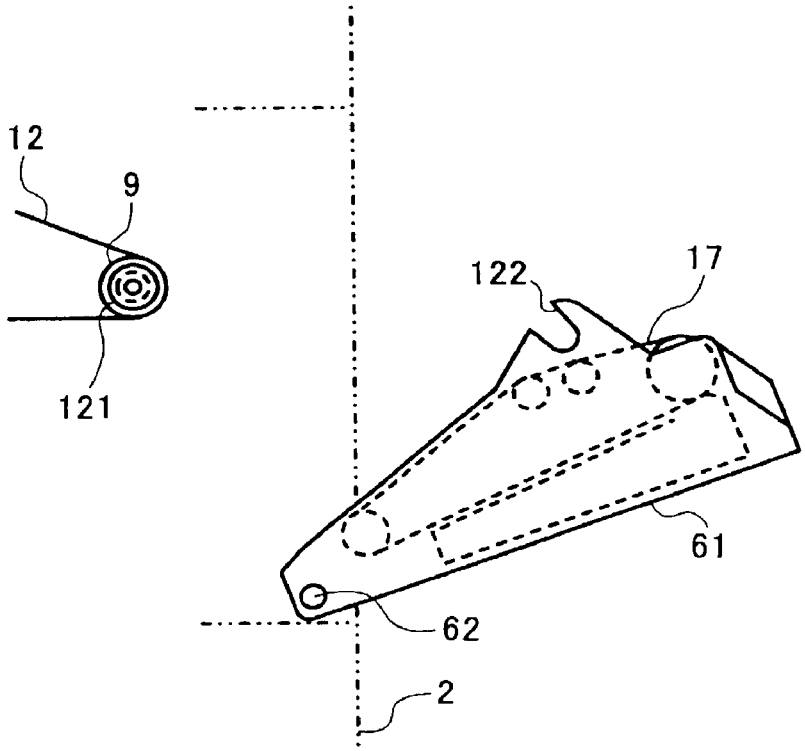

Referring to FIGS. 20A and 20B, there provided are positioning pulleys 121 as positioning units placed on the both ends of the axis of the roller 9 which supports the intermediate transfer belt 12, positioning grooves 122 as positioning units detachably engaged respectively with the positioning pulleys 121.

When the belt holding component 61 is retracted toward the main chases 2 as shown in FIG. 20A, the positioning grooves 122 are engaged with the positioning pulleys 121. As a result, the transfer unit holding component 44 is positioned such that the transfer belt 17 is brought in contact with the intermediate transfer belt 12.

In contrast, when the belt holding component 61 is pulled open away from the main chases 2 as shown in FIG. 20B, the positioning grooves 122 are disengaged from the positioning pulleys 121 and the transfer belt 17 is released free from the contact with the intermediate transfer belt 12.

In another aspect, the full color printer is provided with a further contact/detach mechanism according to the second embodiment disclosed herein. Like reference numerals designate identical or corresponding parts shown in the first embodiment, detailed description thereof is herewith abbreviated.

This embodiment relates to a contact/detach mechanism 220 in place of the aforementioned mechanism 70 of FIGS. 15 and 16.

In the course of the displacement between a stored (or slid-in) position and pulled-open position of this contact/detach mechanism 220, in particular, a transfer unit holding component 44 including an intermediate transfer belt 12; and an image forming unit holding component 43 including image forming units, 42Y, 42M, 42C and 42Bk, as a single component; are provided to be detachable in the vertical direction in relation to the direction of translation of an image bearing member holding component 41 including photoreceptors 3Y, 3M, 3C and 3Bk, as another single component.

Figure 21:
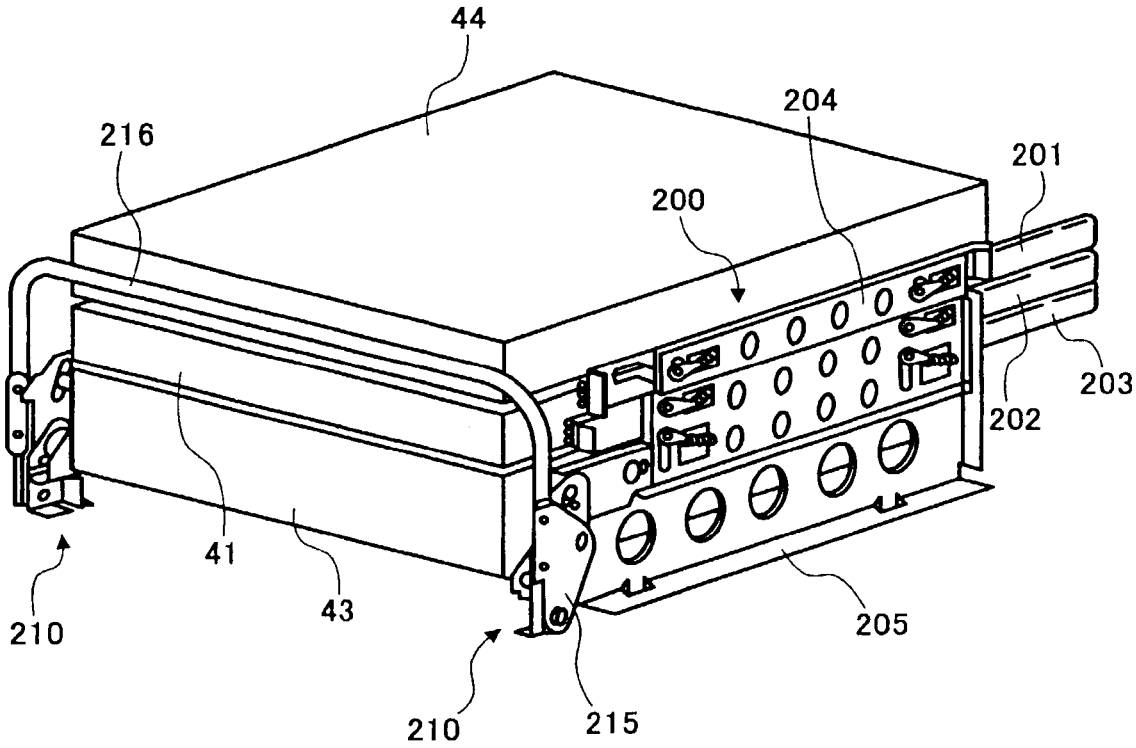
FIG. 21 is an oblique perspective view illustrating the major portion of a support system for supporting respective unitized holding components.

FIG. 21 is an oblique perspective view illustrating the major portion of a support system for supporting respective unitized holding components 41, 43 and 44.

Referring to FIG. 21, the support system includes slide rails 201, 202 and 203, mounted to the holding components 41, 43 and 44, respectively; sliding members 204 for displacing the slide rails 201, 202 and 203 between the stored (or slide-in) position and pulled-open position; support bases 205 rigidly fixed to a main chases 2 for slidably supporting the sliding member 204; and sliding member drive component 210 for driving the sliding member 204 between the slid-in position and pulled-open position.

The slide rails 201, 202 and 203 are herein provided, being aligned horizontally. The rail 202 is situated in the middle thereof and attached to the side of the image bearing member holding component 41.

In addition, although one side of the contact/detach mechanism 220 is shown in the drawing, the slide rails 201, 202 and 203, sliding member 204 and support base 205 are each provided on the other side of the mechanism 220, pair-wise so as to correspond to the holding components 41, 43 and 44, respectively.

Figure 22:
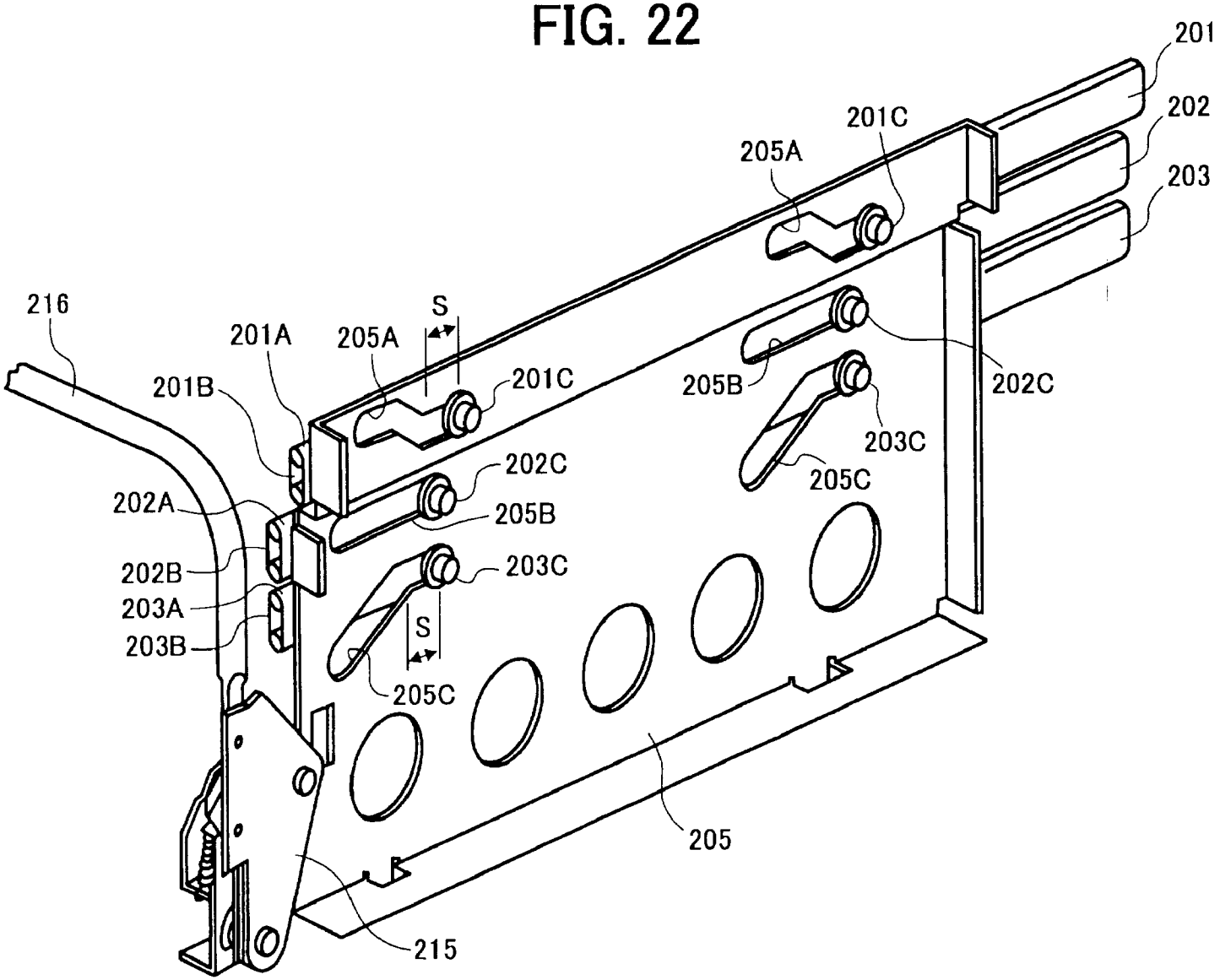
FIG. 22 is a perspective view illustrating slide rails included in the support system of FIG. 21.

Being formed in a similar manner as shown in FIG. 22, the slide rails 201, 202 and 203 include outer rails 201A, 202A and 203A; and inner rails 201B, 202B and 203B, which are inserted sliding into the outer rails 201A, 202A and 203A with rolling bodies for assisting sliding motions, respectively.

As also shown in FIG. 22, connecting pins 201C, 202C and 203C as connecting parts are provided being fixed to the outer rails 201A, 202A and 203A, respectively, so as to be situated at frontal and back portions in the direction of the displacement motion between the slid-in position and pulled-open position.

Figure 23:
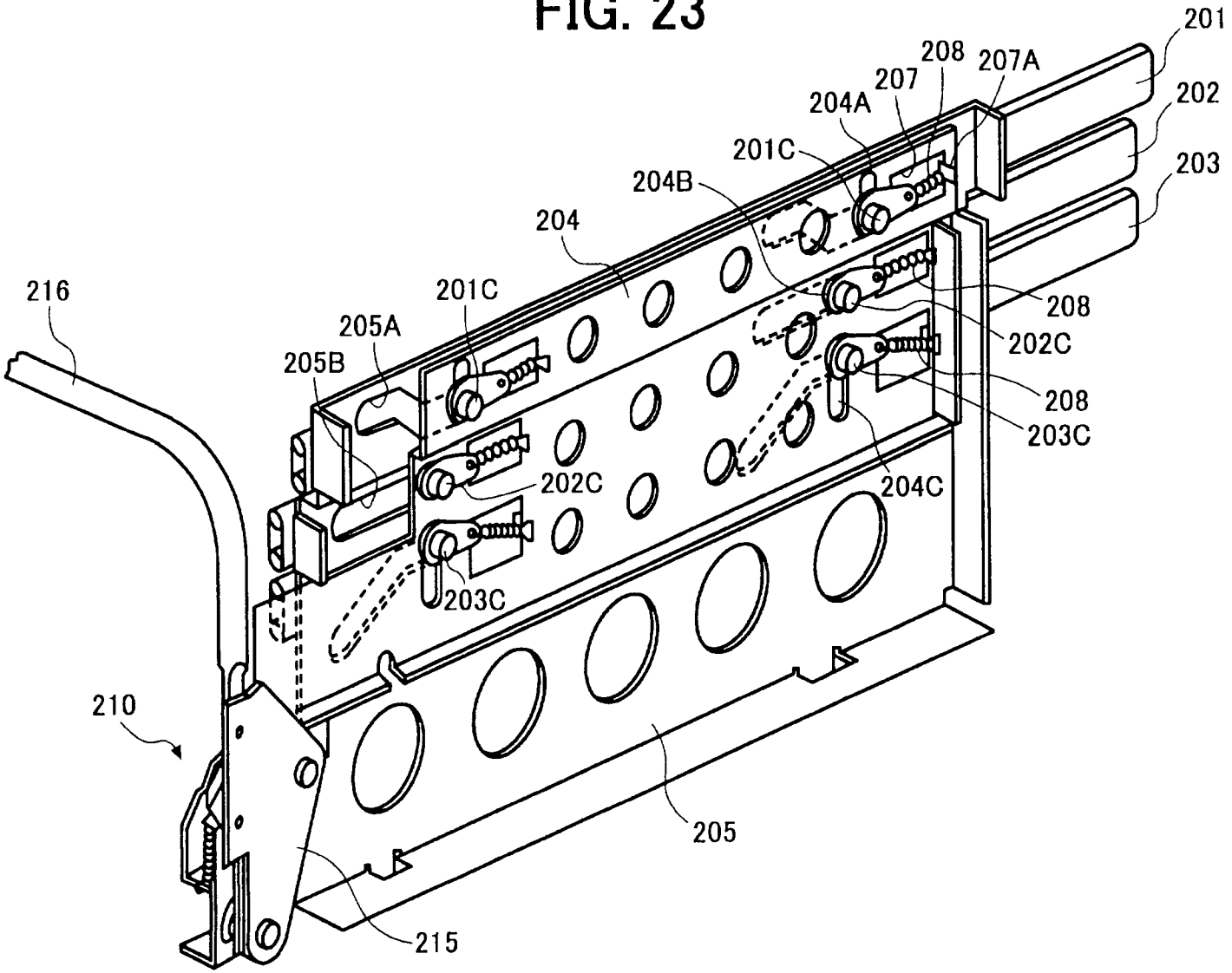
FIG. 23 is a perspective view illustrating plural brackets formed being attached to connecting pins penetrating through holes formed on the sliding member included in the support system of FIG. 21.

The connecting pins 201C, 202C and 203C are positioned to penetrate through holes 204A, 204B and 204C formed in the sliding member 204, as shown in FIG. 23, and then fit to guiding parts 205A, 205B and 205C formed in the support base 205 as elongated holes, respectively, as shown in FIGS. 22 and 23.

As shown in FIG. 22, among the through holes 204A, 204B and 204C, formed in the sliding member 204 through which the connecting pins 201C, 202C and 203C penetrate, the hole 204B corresponding to the connecting pin 202C is formed in the shape of a circle, while the other holes such as 204A and 204C are each formed in the shape of vertically elongated hole, respectively.

The through holes 204A, 204B and 204C, formed in the sliding member 204 through which the connecting pins 201C, 202C and 203C penetrate, are herein designed such that the elongated portions of the holes 204A and 204C are extended, being further separated along the vertical direction in relation to the hole 204B which corresponds to the connecting pin 202C attached to the image bearing member holding component 41.

Furthermore, through holes 204A, 204B and 204C, are herein also designed such that the center of respective through holes 204A, 204B and 204C coincide each other in the horizontal direction, or the direction perpendicular to that of displacing movements.

As a result, the relative position of the holding components 41, 43 and 44 in the direction of displacing movements can remain unchanged when these holding components are subjected to the displacement motion between the slid-in position and pulled-open position.

The guiding parts 205A, 205B and 205C, formed as shown in FIG. 22 in the support base 205 through which the connecting pins 201C, 202C and 203C penetrate, are each horizontally elongated holes for defining the direction of the displacement motion by image bearing member holding component 41 between the slid-in position and pulled-open position, as shown in FIG. 22.

Among the guiding parts 205A, 205B and 205C, the parts 205A and 205C are formed herein such that the elongated portions of 205A and 205C corresponding to the transfer unit holding component 44 and image forming unit holding component 43, respectively, are extended so as to further separate the holding components 44 and 43 each other, when these holding components are subjected to the displacement motion from the slid-in position to pulled-open position.

In addition, the elongated portions of guiding parts 205A and 205C are each formed to have such a specified shape that is provided including a partial inclined portion (FIG. 22) so as to be able to achieve two steps of movements for displacing both transfer unit holding component 44 and image forming unit holding component 43 when these holding components are displaced from the slid-in position to pulled-open position. These displacing steps are first horizontally by a predetermined distance (as designated by the distance 'S' in FIG. 22) and then toward the direction to be separated one another, to thereby arrive at the pulled-open position.

The above noted predetermined distance (as designated by the distance 'S' in FIG. 22) of the horizontal displacement for the guiding parts 205A and 205C is herein adapted to disconnect driving paths at the slid-in position for the holding components 41, 43 and 44 from those leading to several driving members in the main chases 2.

That is, the predetermined distance is defined by the distance between two points, one for initiating the displacement movement and the other for completing the disconnection of the driving paths.

Furthermore, the strokes for the displacement movements between the slid-in position and pulled-open position, or the lengths of elongated holes in the longitudinal direction, for respective holding components 41, 43 and 44, are designed in the present embodiment to be approximately equal to each other such that the relative position of the holding components 41, 43 and 44 in the direction of displacing movements can remain unchanged during the displacement movements between the slid-in and pulled-open positions.

Referring to FIG. 23, plural brackets 206 are formed being attached to respective connecting pins 201C, 202C and 203C penetrating through holes 204A, 204B and 204C formed on the sliding member 204, respectively.

Onto the thus formed brackets 206, coiled springs 208 are respectively suspended from hooks 207A each formed with a strip made of bent-out metal piece from some portion of the hole 207.

Through the continual attraction acting on the brackets 206 by the coiled springs 208, there applied respectively are compressive force acting onto connecting pins 201C, 202C and 203C so as for the holding components 41, 43 and 44 to be retracted back to the original starting positions in the guiding parts 205A, 205B and 205C, respectively.

On the other hand, at one end of the sliding member 204, or at the end portion thereof downstream with respect to the direction for pulling out the holding components 41, 43 and 44, there provided is a slide member driving component 210.

Figure 24:
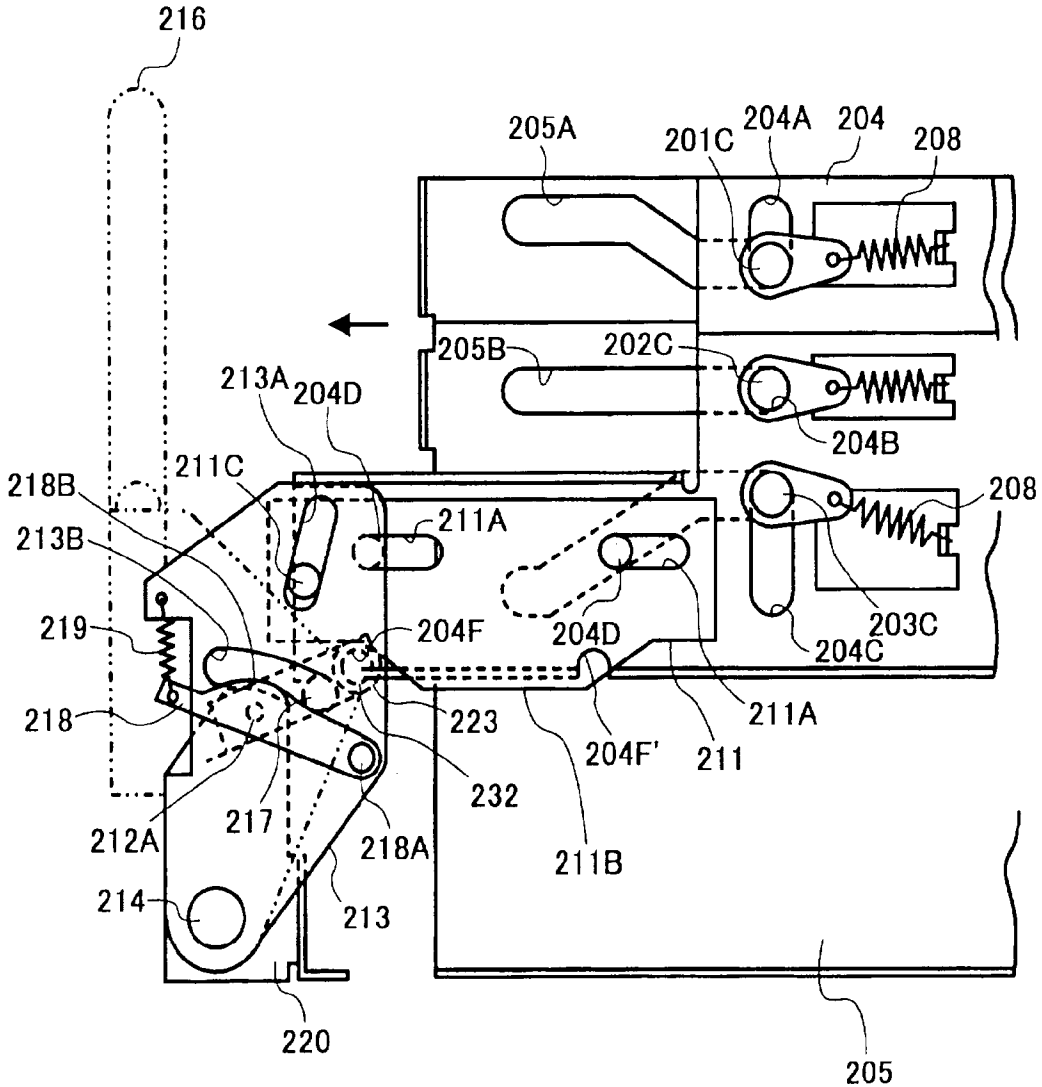
FIG. 24 is a perspective view illustrating the part connecting the slide member driving component with sliding member included in the support system of FIG. 21.

FIG. 24 is prepared to illustrate the part connecting the slide member driving component 210 with sliding member 204, in which a connecting member 211 is further provided at the above noted end portion of the member 204 so as to be displaced along the direction of the movements for the holding components 41, 43 and 44.

Referring again to FIG. 24, there formed on the connecting member 211 are an elongated hole 211A through which a connecting pin 204D fixed to sliding member 204 penetrates, and an cum portion 211B at the lower portion thereof.

The elongated hole 211A is situated with its longitudinal side in the direction of the movements for the holding components 41, 43 and 44, and adapted to displace the connecting member 211 along the direction mentioned just above utilizing the connecting pin 204D as a guide.

In addition, the lower portion of the scum portion 211B is formed to have a convex face, with which in contact is a slide halting member 212 oscillatory provided onto the main chases 2 of the full color printer 1.

The convex face of scum portion 211B has a height suitable for releasing the halting of the sliding member 204 by slide halting member 212, and the elongated hole 211A has a length suitable for switching the face (convex or concave) of scum portion 211B opposing to slide member driving component 210.

That is, in the situation shown in FIG. 24 the holding components 41, 43 and 44 are at the slid-in or stored position, in which the connecting pin 204D penetrating through the elongated hole 211A is brought into contact with the inner edge of the longitudinal end portion downstream in the direction of pulling out movement (as designated by an arrow in the drawing) and slide halting member 212 is in contact with the concave face of the cum portion 211B.

On displacing the connecting member 211 in the direction of pulling out movement (as designated again by an arrow in the drawing) from the above noted position, the connecting pin 204D penetrating through the elongated hole 211A is now displaced toward the opposite end of the inner edge of the hole 211A, to thereby result a concomitant movement such that the cum portion 211B forces the slide halting member 212 is brought on to the convex face of the cum portion 211B.

The displacing movements of the connecting member 211 is carried out by way of an oscillating bracket 213 on the slide member driving component 210 penetrates, through which the driving pin 211C fixed to the connecting member 211.

In addition, the slide member driving component 210 includes the oscillating bracket 213 which is provided oscillatory about a support axis 214 fixed onto the main chases 2 of the full color printer 1, and an operation bracket 215 to which a manipulating handle 216 is attached.

Referring again to FIG. 24, the oscillating bracket 213 is herein formed as a member having an oscillation radius large enough for covering the connecting member 211 in relation to the support axis 214. On the side of oscillating portion thereof, there provided is a connecting drive hole 213A through which the driving pin 211C formed on the connecting member 211 penetrates.

The connecting drive hole 213A is formed herein as an elongated hole with its longitudinal axis aligned in the radius of the oscillation, rather than as the trajectory of the oscillation about the support axis 214, such that the connecting member 211 can be slid in the direction of displacing movements of the holding components 41, 43 and 44.

In addition to the connecting drive hole 213A, a further hole, operation drive hole 213B, is formed as an elongated hole having a shape of the oscillation trajectory about the support axis 214.

As to the operation drive hole 213B, an operation pin 217 fixed to the operation bracket 215 penetrates there through, and a click member 218 is supported so as to position the operation pin 217 at several positions on the end portion of the partial arc of the oscillation trajectory.

The click member 218 is formed, having an oscillation axis 218A fixed onto the oscillating bracket 213, such that the tip subjected to the oscillation can swing into and out of the operation drive hole 213B.

The movements into and out of the operation drive hole 213B is driven by a force exerted by compressed spring 219 which is bridged between the oscillating bracket 213 and the above noted tip for the oscillation.

A halting surface 218B is further provided on the surface of the click member 218 facing to operation drive hole 213B, such that the operation pin 217 can be held at one of two positions divided by the top portion of the convex face on the operation pin 217 such that the halting surface 218B can be positioned at a predetermined location of the partial arc of the oscillation trajectory depending on the status of the manipulating handle 216.

The compressed spring 219 attached to the click member 218 is so designed as to exert an elastic force strong enough to prevent a manipulating handle 216, which is presently latched to the side of a manipulating bracket 215, from being improperly brought down.

The compressed spring 219 is also designed such that the operation pin 217 on the side of the manipulating bracket 215 can overleap the aforementioned convex face by a downward force exerted only when the manipulating handle 216 is taken down intentionally from its upright position.

Figure 25:
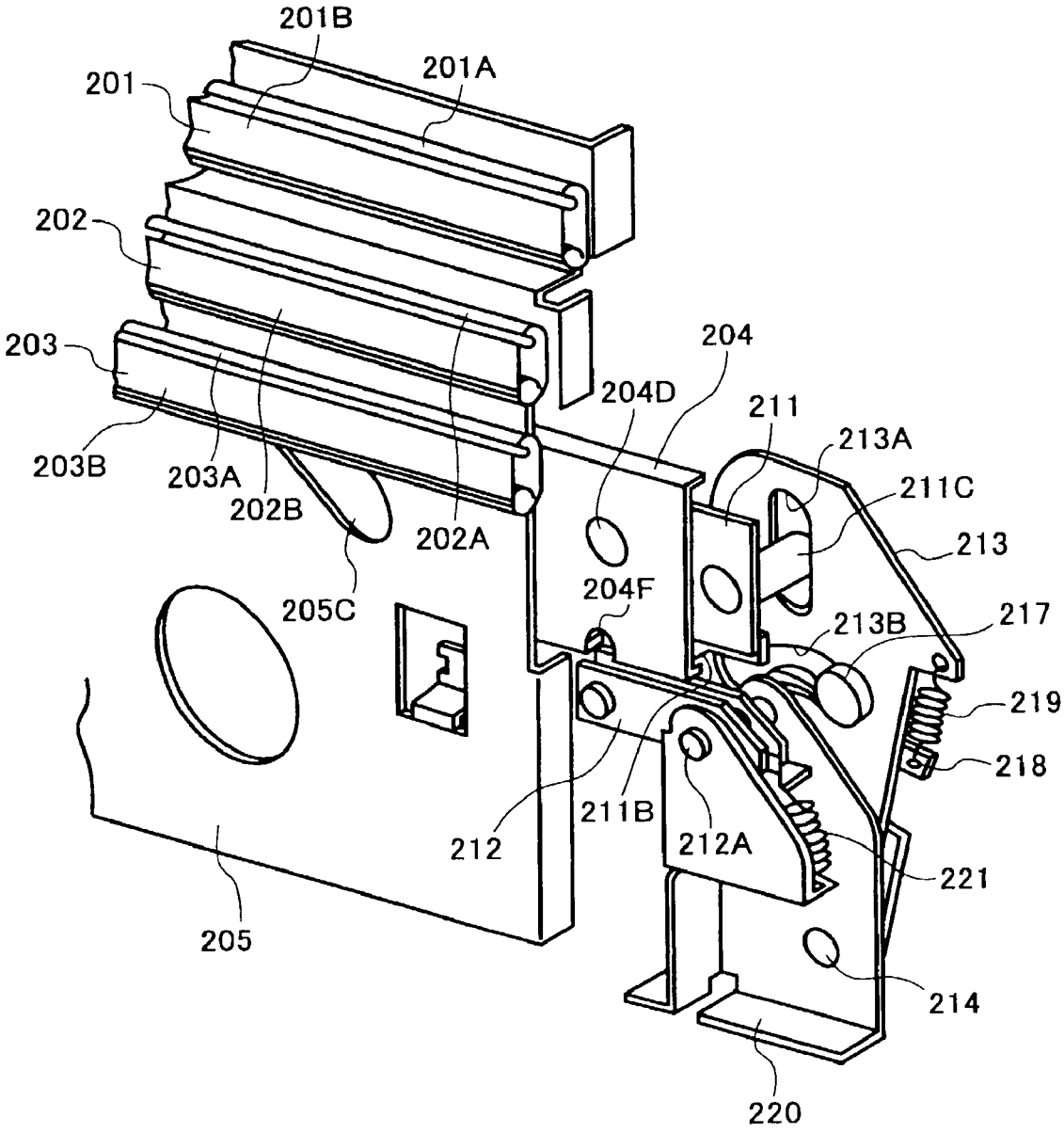
FIG. 25 is a perspective view illustrating the structure of the slide halting member opposing to the cum portion attached to the connecting member.

FIG. 25 is prepared to illustrate the structure of the slide halting member 212 opposing to the cum portion 211B attached to the connecting member 211.

Referring to FIG. 25, a supporting bracket 220 is provided, being fixed to the chases of the full color printer 1, for oscillatory supporting a slide halting member 212.

The slide halting member 212 is herein formed as an oscillatory member capable of seesaw movements about a supporting axis 212A, and another compressed spring 221 is provided bridging between the end portion of oscillating tip and the supporting bracket 220.

In addition, the other end of the oscillating tip is situated opposing to the cum portion 211B of the connecting member 211 through by a force exerted by the compressed spring 221, and a halting roller 222 and a guide roller 223 are further provided on the same axis each having a radius different one another.

The halting roller 222 is formed as one capable of contacting/detaching to halting slits (204F or 204F' in FIG. 24), while the guide roller 223 is formed as one rotatory movable retaining the contact with the cum portion 211B of the connecting member 211.

The slide halting member 212 is formed to be able to swing depending on the situation facing to the cum portion 211B of the connecting member 211. On facing to concave portion of the cum portion 211B, for example, the slide halting member 212 swings to such a direction for the as to the halting roller 222 to be detached from the halting slit of slide member 204.

Therefore, the halting slits 204F and 204F' are the parts for use in halting the displacement of the slide member 204 so as to retain the holding components 41, 43 and 44 at either slid-in or pulled-out position. The halting slit 204F thus corresponds to the slid-in position, while the slit 204F' corresponds to the pulled-out position.

On the other hand, the transfer unit holding component 44 and image forming unit holding component 43 placed above and below the image bearing member holding component 41, respectively, are adapted to carry out detachment movements in relation to the holding component 41, i.e., the holding components 41, 43 and 44 are supported movably each other in the vertical direction.

Figure 26:
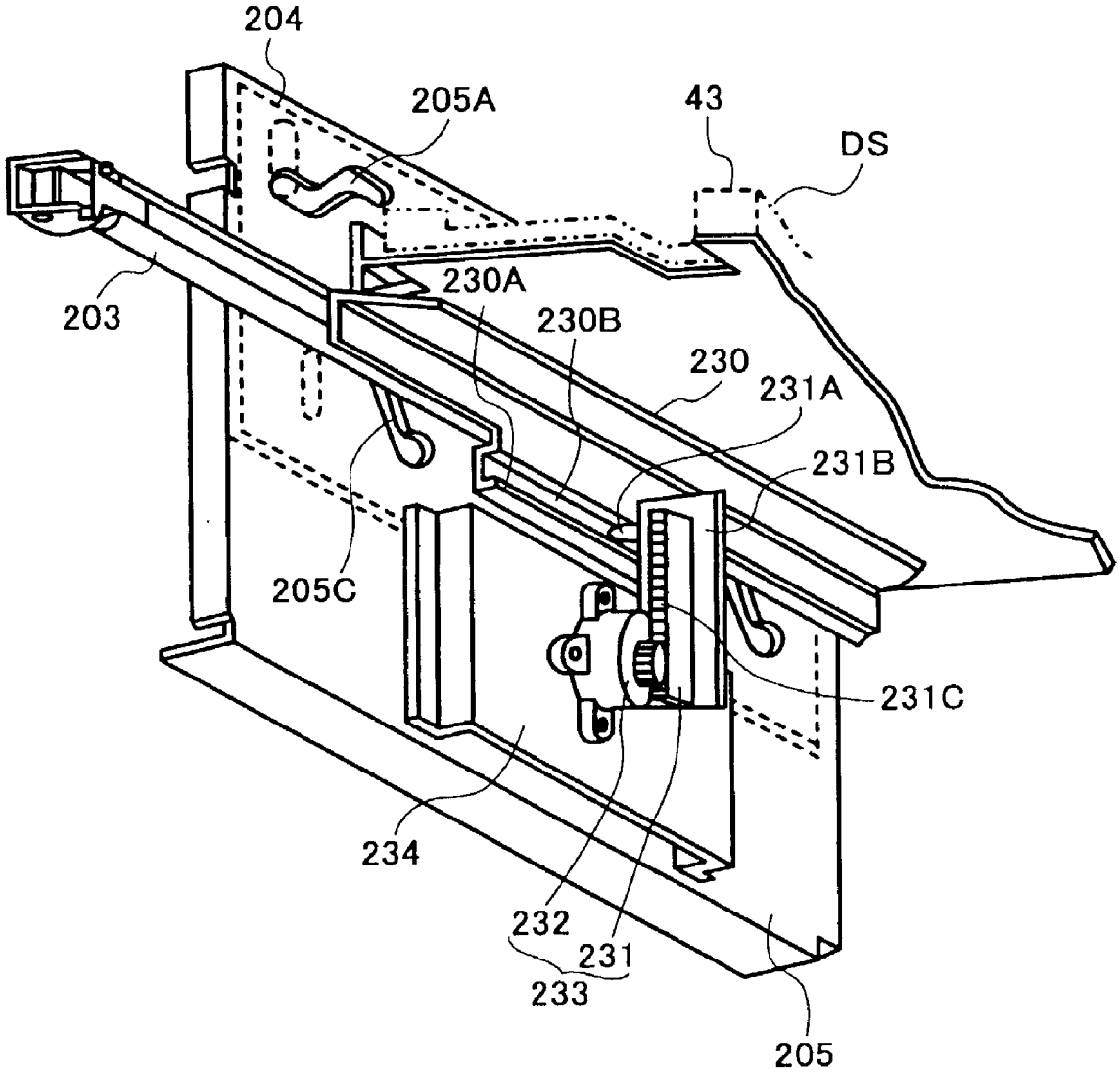
FIG. 26 is an oblique perspective drawing illustrating the image forming unit holding component viewed upward from the bottom.
Figure 27:
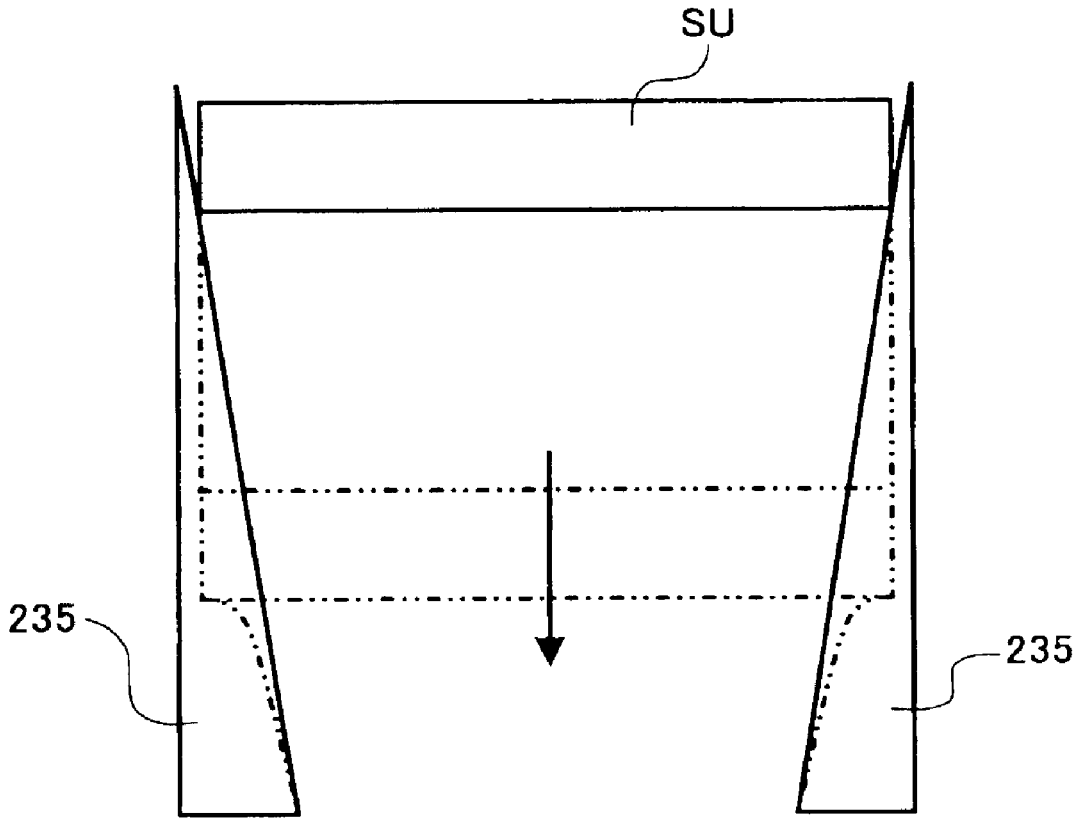
FIG. 27 is a schematic view illustrating the modified version of the damping unit.

Referring to FIGS. 26 and 27, an elevating support mechanism will be described herein below primarily on the lowermost image forming unit holding component 43.

FIG. 26 is an oblique perspective drawing of image forming unit holding component 43 viewed upward from the bottom thereof.

Referring to FIG. 26, a bottom plate DS of the holding component 43 is mounted, being fixed to a base holding member 230 which is, in turn, attached to the inner rail 203B of slide rail 203 with a screw (not shown).

In addition, a sliding unit 230A is provided being formed as a hanging plate. On the slide unit 230A, a slide guiding hole 230B is formed with its longitudinal direction aligned along the displacement direction of the image forming unit holding component 43.

Further, a damping unit 233 is provided in vicinity of the slide guiding hole 230B, including an elevating member 231 with a slide pin 231A, which is designed to penetrate into the slide guiding hole 230B, and a damping member 232.

The damping unit 233 is designed to decrease the speed of the image forming unit holding component 43 during hoisting, and particularly during the descent thereof.

The damping member 232 included in the damping unit 233 is provided with a support member 231B which is formed with its longitudinal direction aligned along the direction of the hoisting, and which accommodates the slide pin 231A on one end thereof; and a rack 231C as an engaging member mounted on the support member 231B.

The damping member 232 is provided with a pinion engaging with the rack 231C, and designed so as to decrease the speed of the image forming unit holding component 43 during the movements thereof in one direction only, i.e., in the descending direction. In the interior of the damping member 232 to which the rotation of the pinion is transferred, there provided is fluid such as, for example, oil or air, to thereby decrease the speed through the change in viscoelasticity.

Damping characteristics of the damping unit 233 utilizing the fluid can be adjusted by changing counteracting force (or resilience) generated by the amount of fluid penetrating through an orifice included in the unit 233, either fixed or variable orifice, having fixed or variable opening, respectively.

Namely, the following change in the counteracting force is suitably utilized: At a high speed of displacement, the amount of fluid penetrating through the orifice increases, to thereby increase the counteracting force; while at a low speed in contrast, the amount penetrating through the orifice decreases, thereby decreasing the counteracting force.

Therefore, with the present construction of the damping member 232, the magnitude of damping force can be varied corresponding to the moving speed of the image forming unit holding component 43.

It may be added that the high moving speed of the image forming unit holding component 43 is realized at the instance of initiating the descent owning to potential energy consideration, and the speed decreases as the descent continues. That is, the damping member 232 has damping characteristics such that the decrease in moving speed is greater with the descent, and the moving speed is therefore smaller at the end of the descent than that at the beginning.

Since the speed damping with the damping unit 233 is carried out in the combination of the elevating member 231 having its longitudinal edge aligned in the hoisting direction and the damping member 232, the movements during the descent are solely linear without causing any undue moment.

Therefore, the damping member 232 does not require so much power, and the damping unit 233 can be made relatively small, accordingly. Incidentally, the part 234 shown in FIG. 26 designates the supporting base for the damping unit 233.

There may be cited herein below a modification of the damping unit 233, in which the change in friction coefficient is utilized in place of the resilience noted above.

FIG. 27 is a schematic view illustrating the modified version of the damping unit.

Referring to FIG. 27, this damping unit is provided at least with a frictional member 235 such that the width thereof decreases with the increase in the distance of the present descent of the image forming unit holding component 43.

Because of narrowing in width of the frictional member 235, the friction coefficient increases when the image forming unit holding component 43 descends on the surface of the frictional member 235, to thereby decrease the moving speed smaller at the end of the descent than that at the beginning, which may alternatively be utilized as the means for suitably decreasing the hoisting speed of the holding component 43.

According to the embodiment disclosed herein, respective holding components 41, 43 and 44 can be displaced from the slid-in (e.g., stored) position to pulled-open position by swinging the manipulating handle 216, which is provided on to the slide member driving component 210, from the upright position to lie-down position.

At the pulled-open position, as shown in FIG. 4B, the image forming unit holding component 43 and the transfer unit holding component 44 can be brought to the position detached each other in relation to the image bearing member holding component 41. These positions and the means for achieving these will be detailed herein below.

At the stored position of the holding components 41, 43 and 44 as shown in FIG. 22, the manipulating handle 216 attached to slide member driving component 210 is at its upright position. This upright position of the manipulating handle 216 is maintained by the aforementioned mechanism, in which the operation pin 217 at the side of the operation bracket 215 is held by the halting surface 218B of click member 218.

After releasing open the side cover (not shown) of the chases 2, an operation is initiated for the manipulating handle 216 to be brought from its upright position to lie-down position. When a force, which is larger than the elastic force by the compressed spring 219 of click member 218, is exerted by the handle 216, the operation pin 217 on the side of the manipulating bracket 215 climbs over the aforementioned halting surface 218B of the click member 218 as shown FIG. 28.

Figure 29:
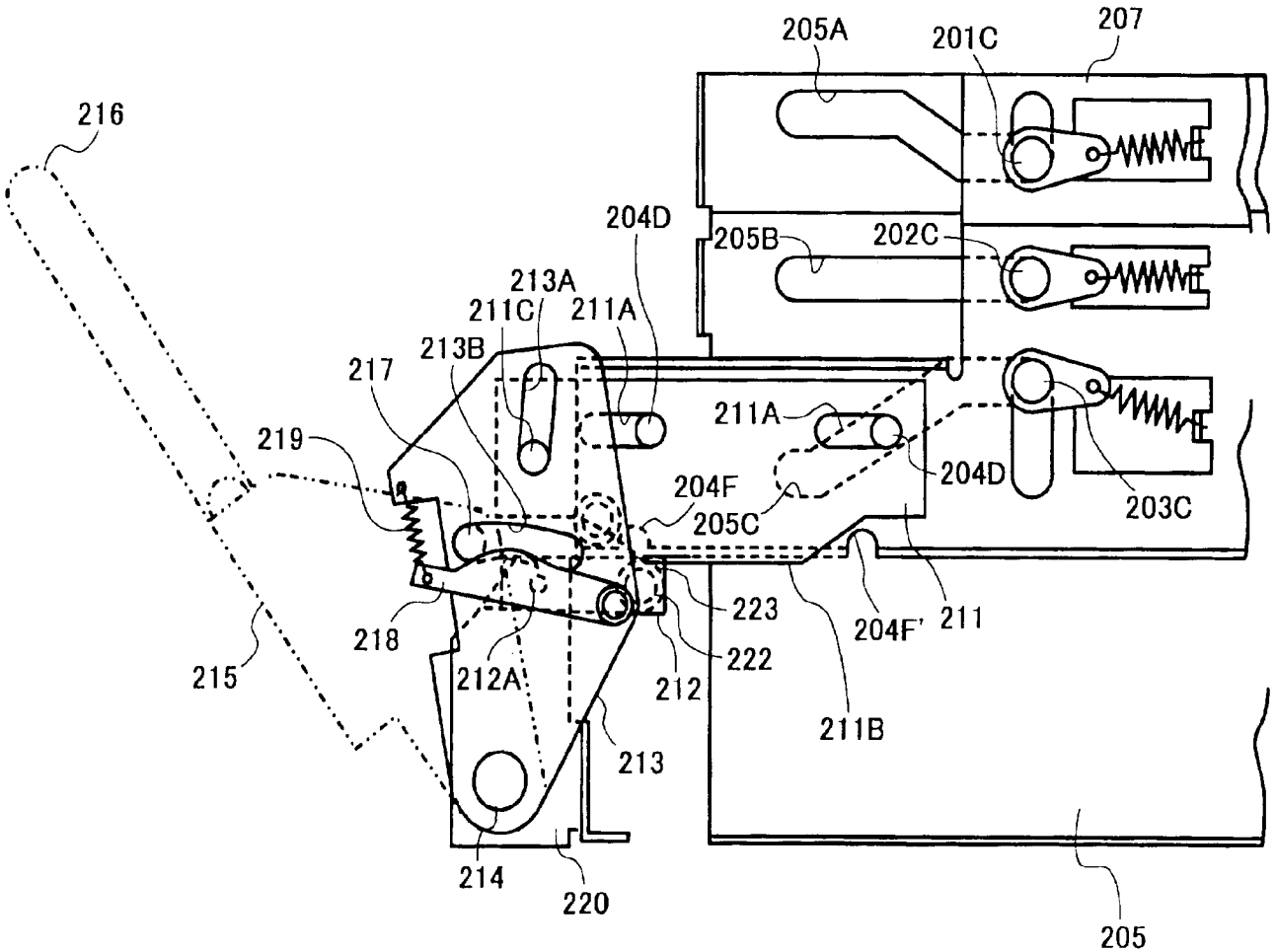
FIG. 29 is prepared to illustrate the operation of the manipulating handle to be brought from its upright position to lie-down position.

When the operation pin 217 made the overleaping the halting surface 218B of the click member 218 and becoming in contact with the inner side of longitudinal edge in operation drive hole 213B at its downstream in the pull-out direction, the driving pin 211C on the side of the connecting member 211 is displaced, as shown in FIG. 29, by the distance corresponding to the longitudinal length of the elongated hole 211A concerting with the swinging movement of the oscillating bracket 213.

In case the connecting pin 204D comes in contact with the inner side of longitudinal edge in the elongated hole 211A on the connecting member 211 at its downstream in the pull-out direction for the holding components 41, 43 and 44, the slide halting member 212 swings so as for the halting roller 222 be removed from the halting slit 204F formed on the slide member 204.

As a result, the slide member 204 is released from being constraint at the stored position, and the displacing movements become feasible in the pull-out direction.

Figure 28:
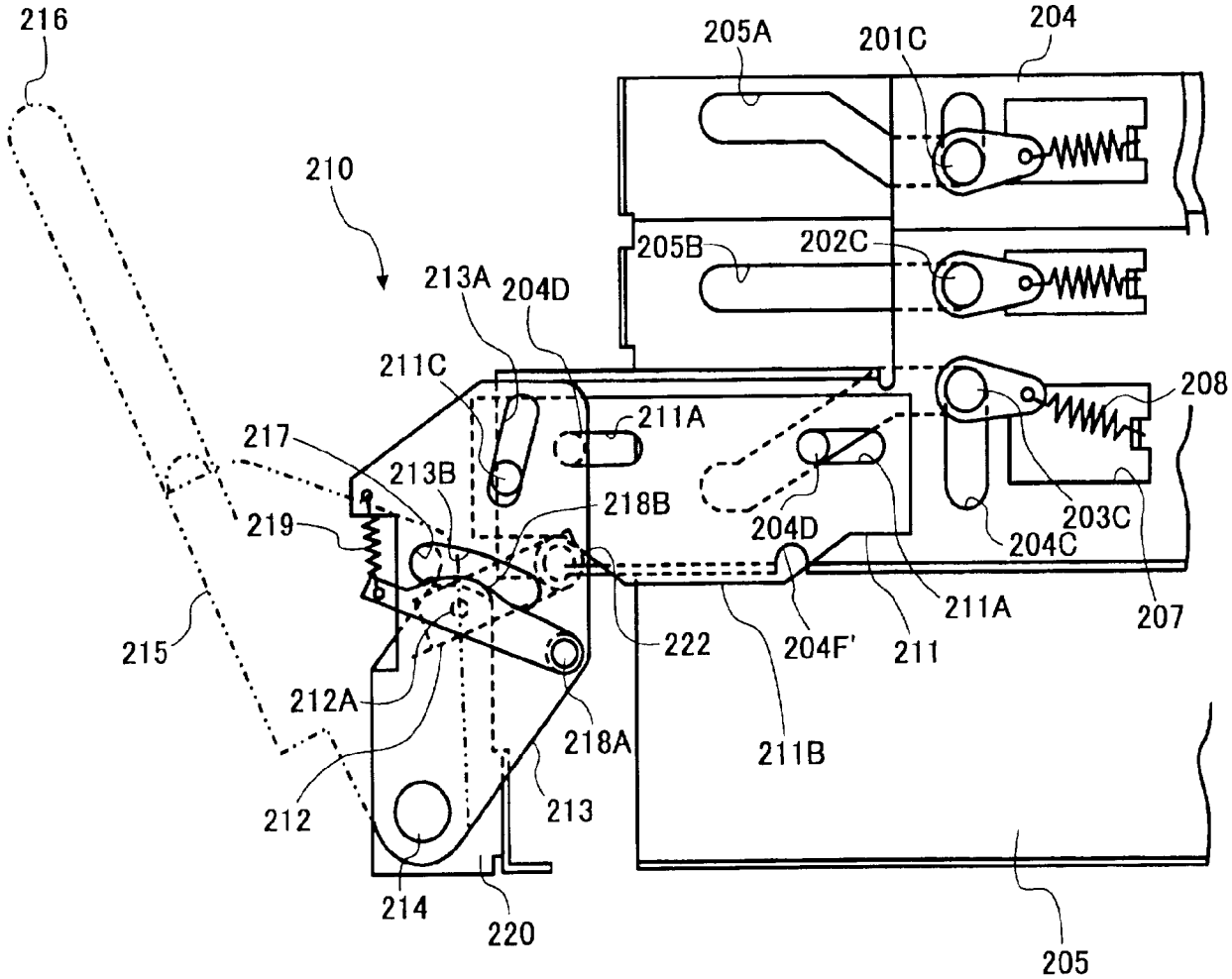
FIG. 28 is prepared to illustrate the operation of the manipulating handle starting from its upright position to lie-down position.
Figure 30:
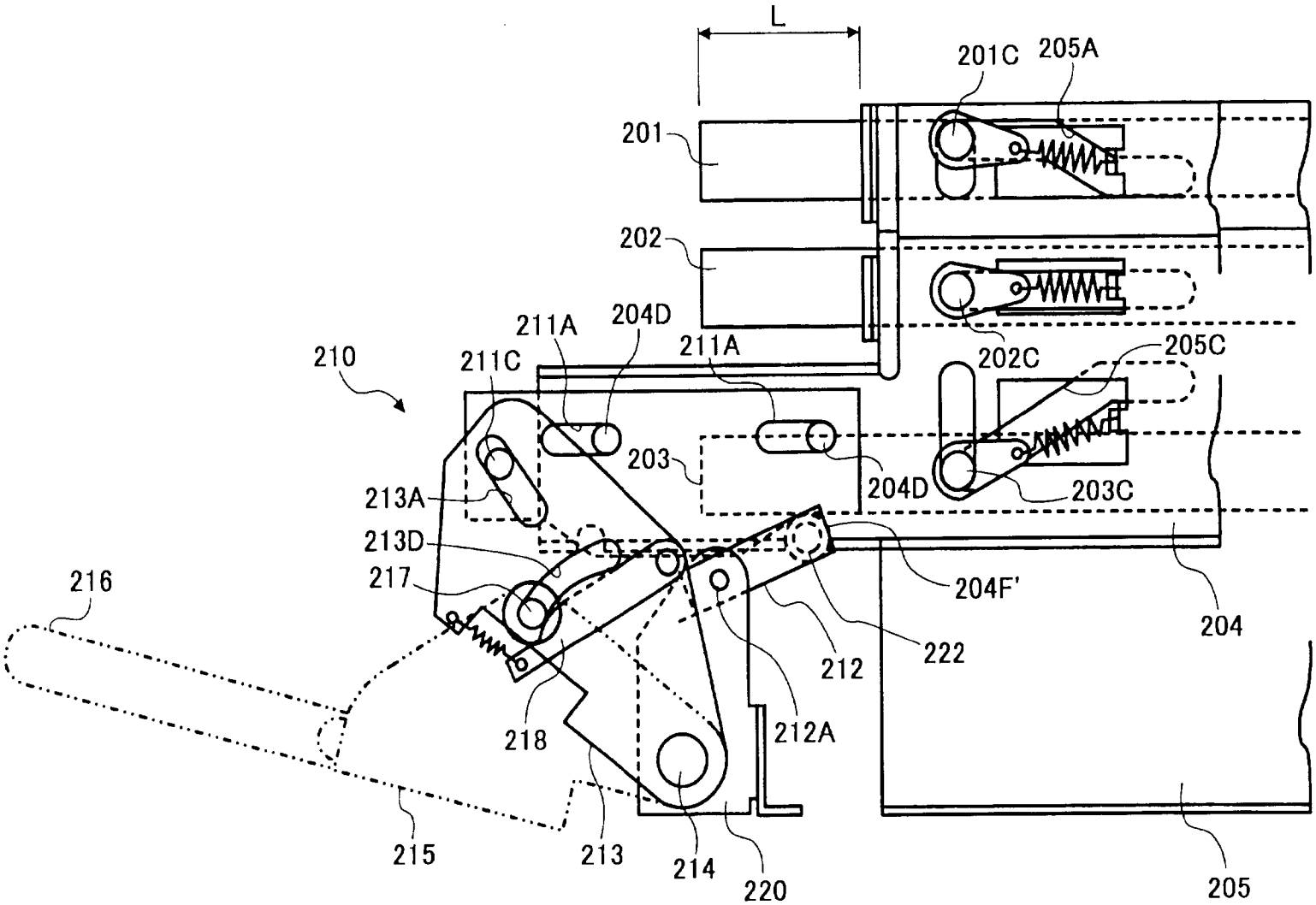
FIG. 30 is prepared to illustrate the operation of the manipulating handle to be brought further to lie-down position.

The manipulating handle 216 now swings further as shown in FIG. 30 from the previous position shown in FIG. 28. In the present situation, by the swinging movements of the oscillating bracket 213 concerted with those of manipulating handle 216, the driving pin 211C comes in contact with the inner edge of the connecting drive hole 213A, and also the connecting pin 204D comes in contact with the inner edge of the elongated hole 211A at its downstream in the pull-out direction.

As a result, the displacing movement of the slide member 204 is initiated in the pull-out direction corresponding to the swing movements of the oscillating bracket 213.

Along the start of this displacing movement of the slide member 204, the connecting pins 201C, 202C and 203C, penetrating through the slide member 204 each slide in a concerted manner along the guiding portions 205A, 205B and 205C formed on the support base 205, respectively.

Since the slide member 204 is displaced horizontally at a predetermined distance immediately after the start of the displacing movement, the aforementioned driving paths, which interconnect the driving members for respective holding components 41, 43 and 44, with those for the side of the main chases 2, are disconnected.

It is worth mentioning that the present structure of the driving paths is advantageous, since the displacement movement of the slide member 204 is carried out horizontally, and the interconnection of the driving members is of such a type as one having the structure of being engaged horizontally. Therefore, the disconnection can be achieved with relative ease without undue effects by a force exerted in the directions other than horizontal during the displacement movements and undue load.

Referring again FIG. 30, the connecting pins 201C, 202C and 203C are displaced corresponding to the predetermined shape of the guiding portions 205A, 205B and 205C formed on support base 205, respectively.

Namely, the connecting pins 201C and 203C, which are formed on the side of slide rails 201 and 203 for the transfer unit holding component 44 and image forming unit holding component 43, respectively, displace horizontally to be detached one another in relation to the moving direction of the connecting pin 202C formed on the slide rail 202 for the image bearing member holding component 41.

Corresponding to the displacement of the slide member 204, on the other hand, the connecting member 211 also displaces toward the pull-out position, and then the concave face of the cum portion 211B is brought to the position facing the guide roller 223 formed on slide halting member 212.

Accordingly, the slide halting member 212 swings in such a direction as the halting roller 222 be engaged to the other halting slit 204F' formed on the slide member 204. As a result, the slide member 204 is retained at the pull-out position for the holding components 41, 43 and 44.

In the situation shown in FIG. 30, the connecting pins 201C, 202C and 203C each displace over the distance corresponding to the stoke of displacement of the slide member 204; and outer rails 201A, 202A and 203A for the slide rail 201, 202 and 203, to which the connecting pins 201C, 202C and 203C are fixed, respectively, are displaced from the slid-in position to pull-out position.

As a result, a larger overall displacement stroke can be obtained compared with the displacement of the inner rails with the outer rail fixed. This is illustrated by the distance designated by the length 'L' in FIG. 30, which corresponds to the length for outer rails 201A, 202A and 203A stick out of the edge of the support base 205.

Figure 31:
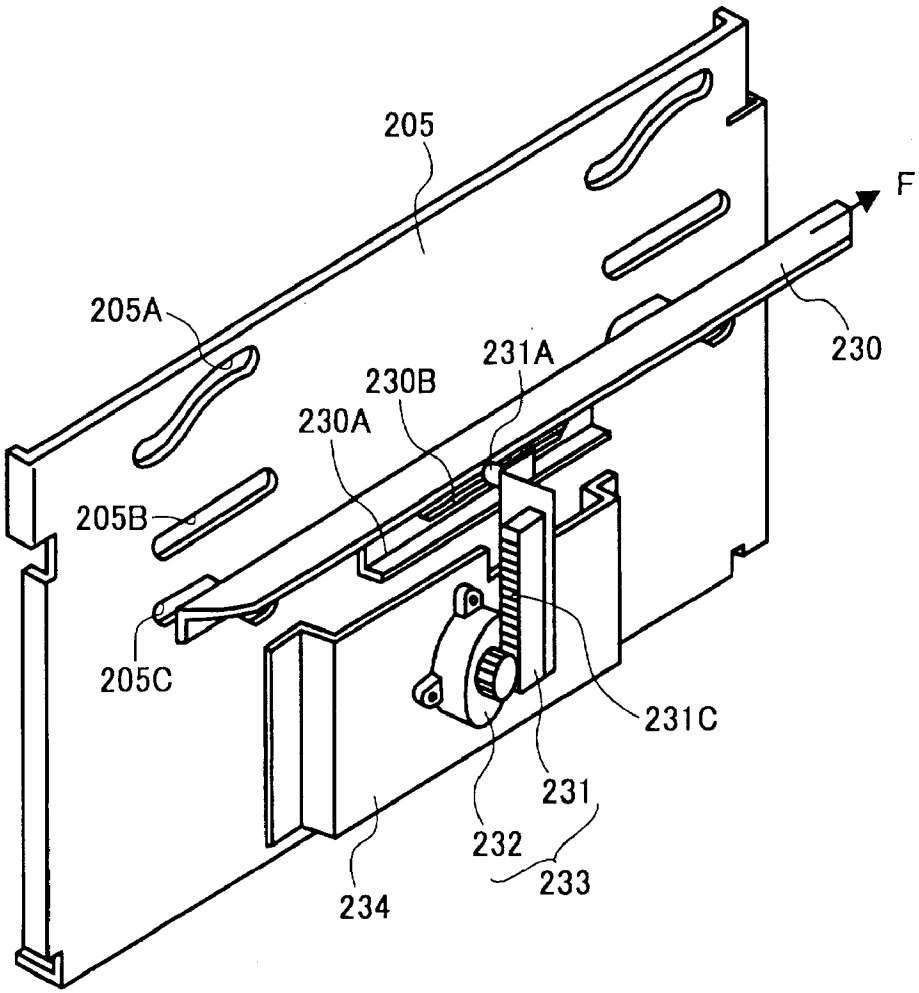
FIGS. 31 and 32 are prepared to illustrate the way for the image forming unit holding component be displaced horizontally in a manner concerted with the slide member, and lowered in relation to the descending direction of the image bearing member holding component.
Figure 32:
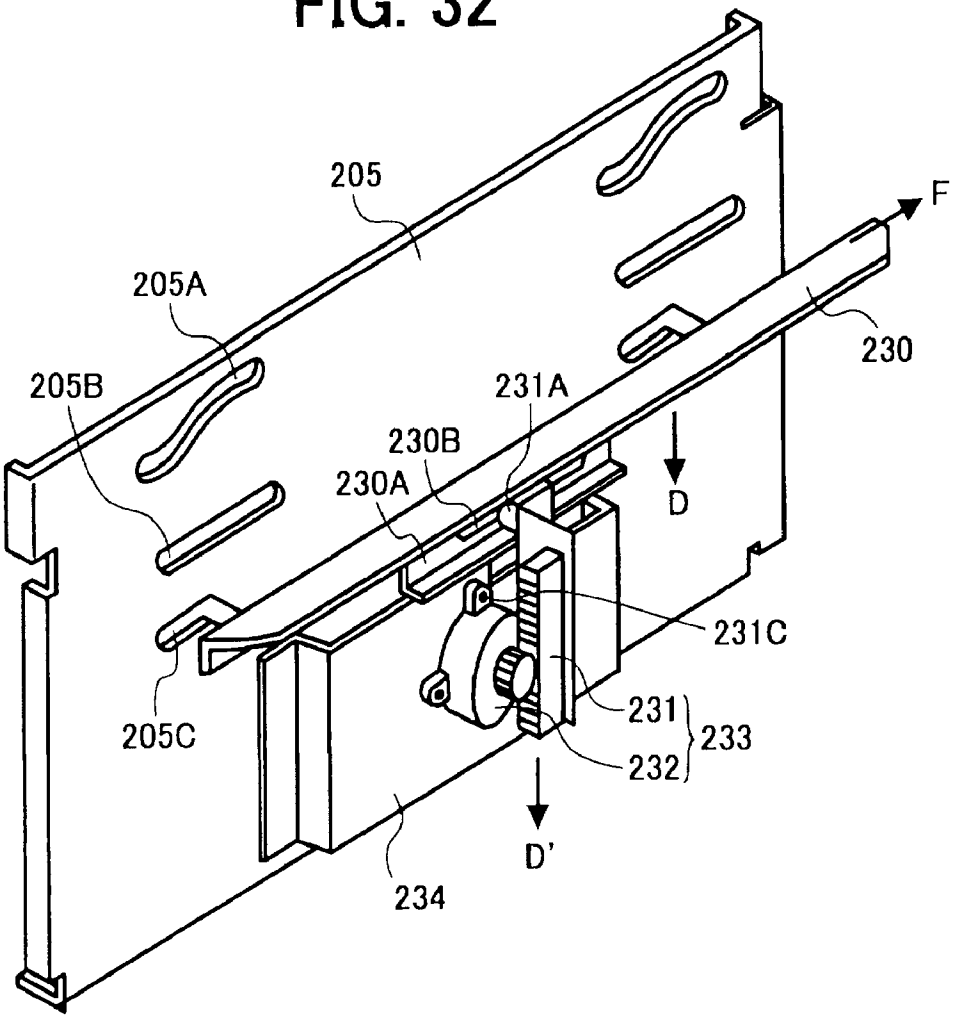

FIGS. 31 and 32 illustrate the way for the image forming unit holding component 43 be displaced horizontally in a manner concerted with that of the slide member 204, and lowered in relation to the descending direction of the image bearing member holding component 41, respectively.

Referring to FIG. 31, in the former case where the image forming unit holding component 43 is displaced horizontally in a manner concerted with that of the slide member 204, the bottom plate DS is also displaced in the same direction (designated by the arrow 'F' in the drawing). This displacement of the bottom plate DS is accompanied by sliding movements of the slide pin 231A of the elevating member 231 along the slide guiding hole 230B on the side of the damping unit 233.

Referring to FIG. 32, in the latter case where the image forming unit holding component 43 is lowered in a manner concerted with that of the slide member 204, the bottom plate DS and also the sliding unit 230A are lowered (in the direction designated by the arrow 'D') in a concerted manner. Further, the hoisting member 231 is also lowered (in the direction "D"), which mounts the slide pin 231A that penetrates through the slide guiding hole 230B.

During the lowering movements, the descending speed of the rack 231C included in the hoisting member 231 is decreased by the damping member 232 of damping unit 233.

In the present embodiment, the image forming unit holding component 43 reaches the end position of the descent with a decreased speed by way of the slide rail 203, and the image forming unit holding component 43 is thus taken out to the pull-out position. Then, among the holding components 41, 43 and 44 held on the slide rails 201, 202 and 203, respectively, at least some of these holding components 41, 43 and 44 to be subjected to parts exchange and/or maintenance operation are now be brought to the position, in which these holding components can be taken out by pulling the inner rails in the slide rails 201, 202 and 203 out of outer rails.

In case the holding components are displaced from the pull-out position back to the stored position, these holding components 41, 43 and 44 are subjected to the above mentioned steps in the reversed order, to thereby be able to carry out the positioning and holding for these holding components.

In still another aspect, the full color printer is provided with a further contact/detach mechanism according to the third embodiment disclosed herein in reference to FIGS. 33 through 37.

Figure 33:
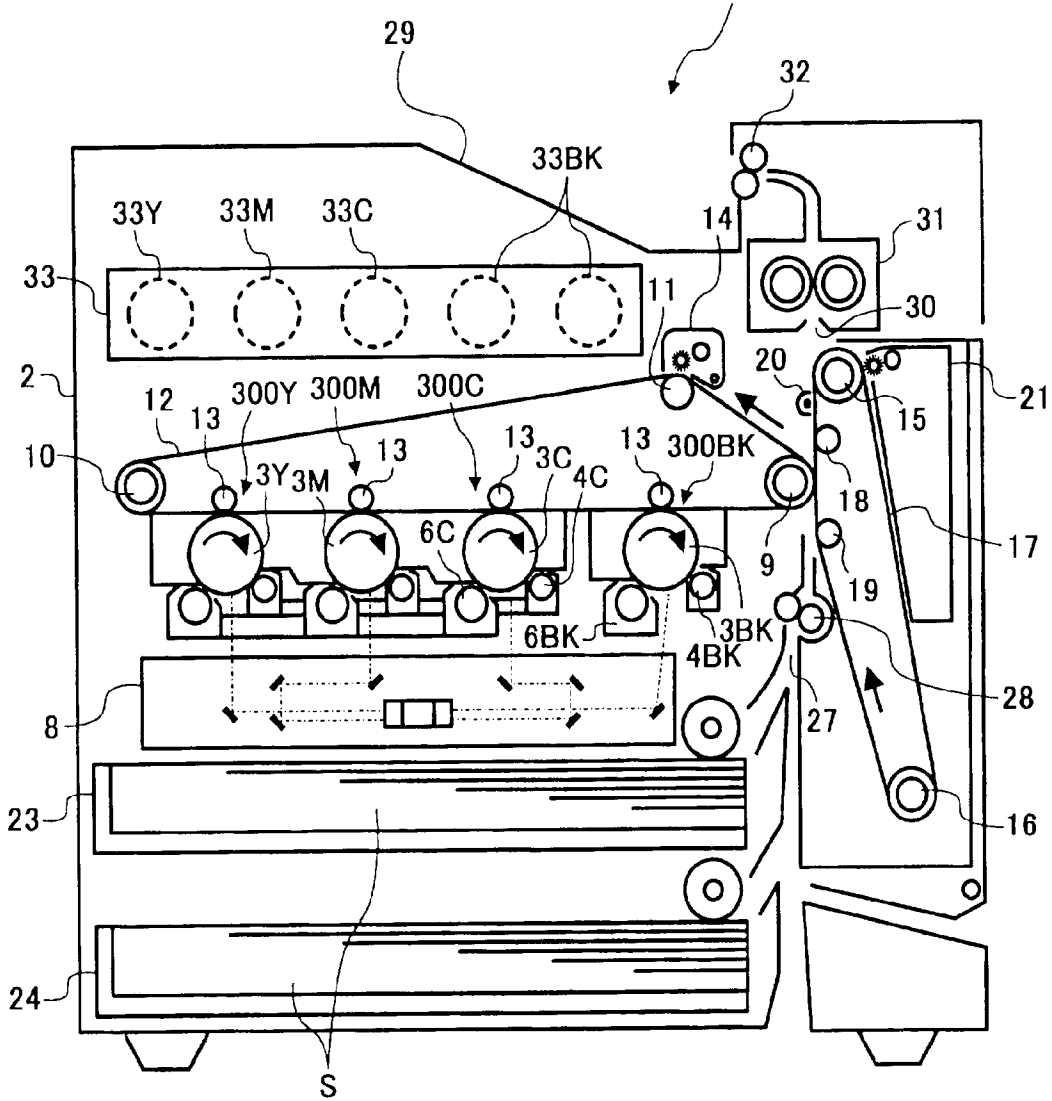
FIG. 33 is a front elevation illustrating the structure of a full color printer as image forming apparatus according to another embodiment disclosed herein.
Figure 35:
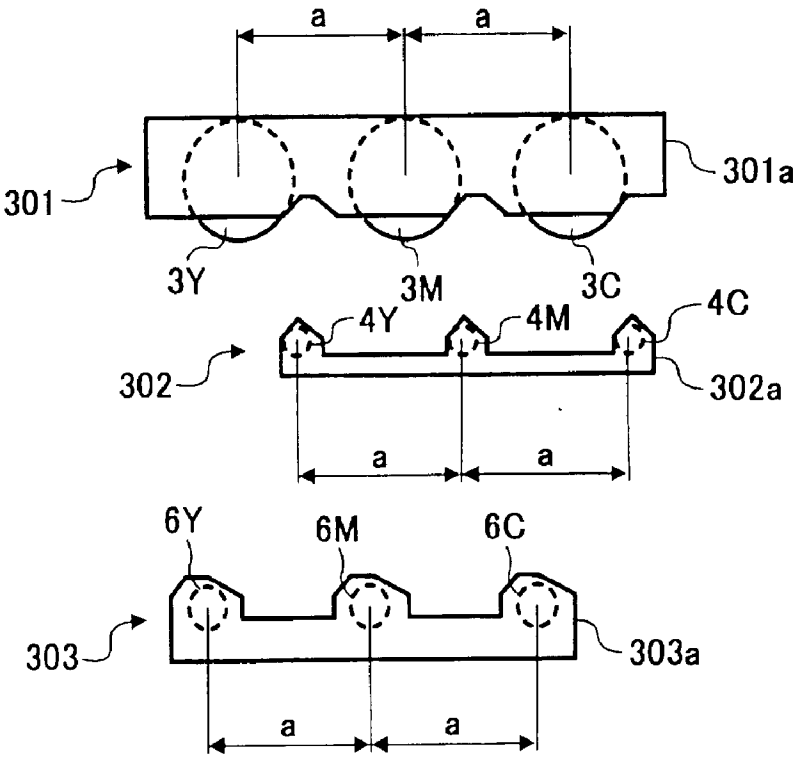
FIG. 35 is another front elevation illustrating the three image forming units of FIG. 34 detached from each other.
Figure 34:
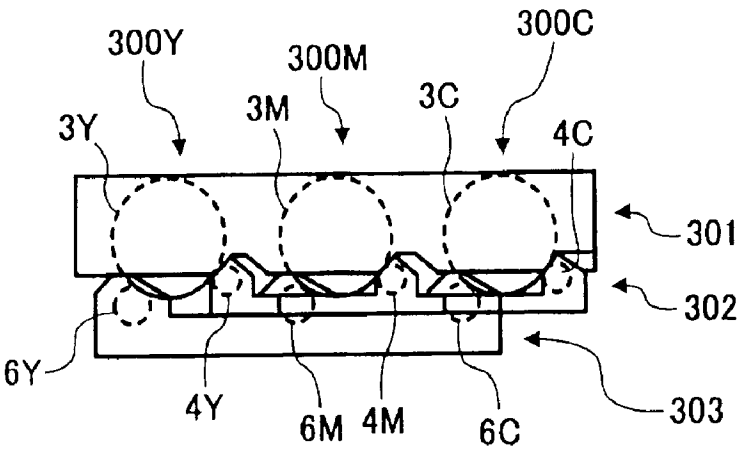
FIG. 34 is another front elevation illustrating the color image forming unit for forming color images incorporating three image forming units.
Figure 36:
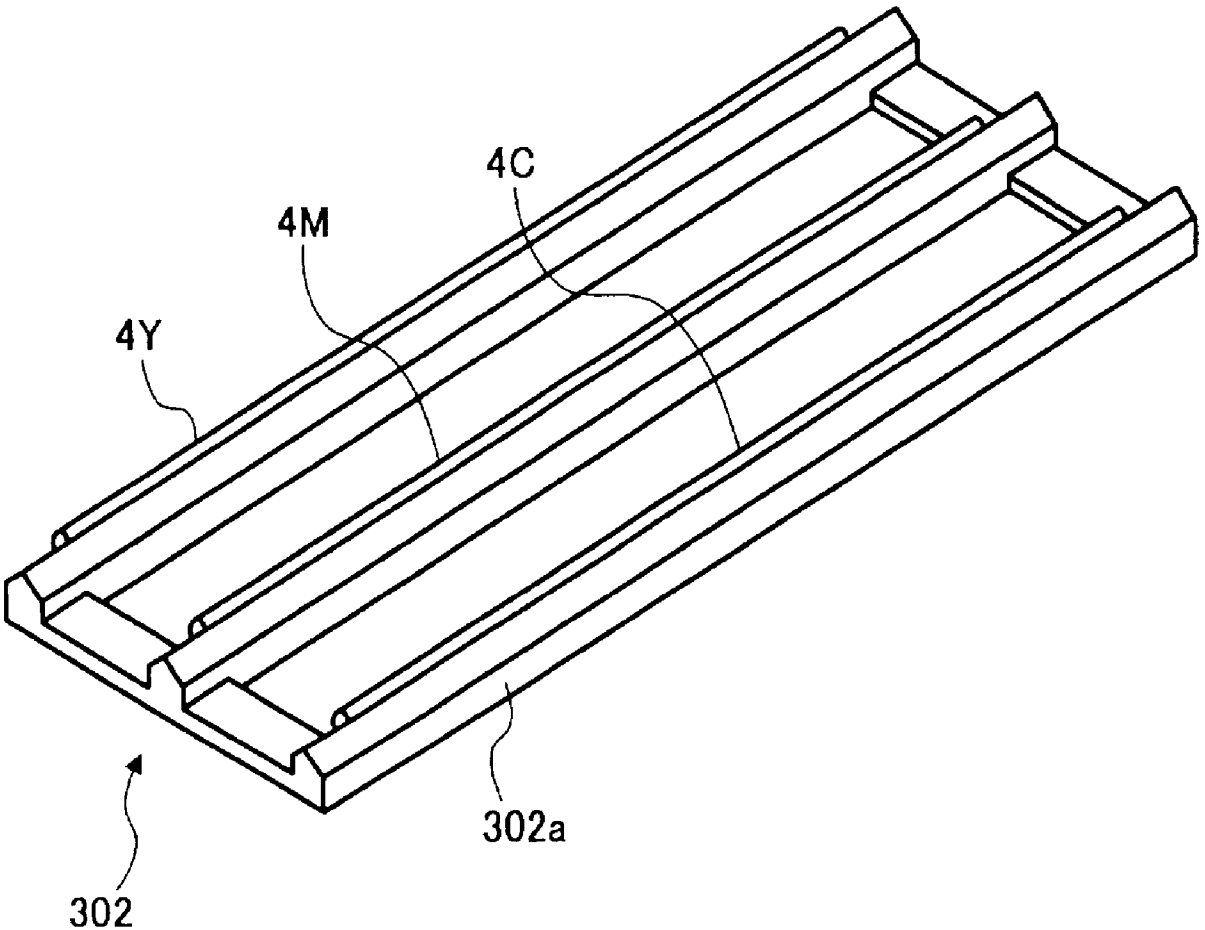
FIG. 36 is a perspective view illustrating a charging unit as an image forming unit.
Figure 37:
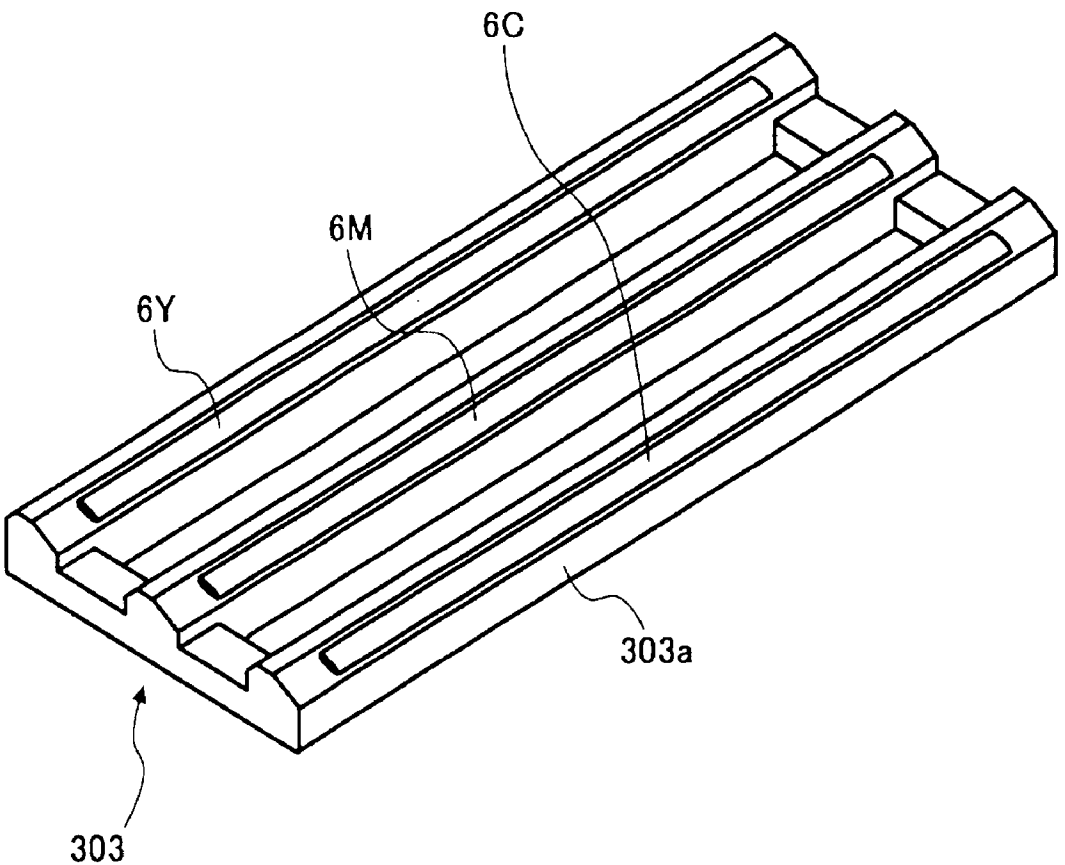
FIG. 37 is another perspective view illustrating a developer unit as another image forming unit.

FIG. 33 is a front elevation illustrating the structure of a full color printer as image forming apparatus, FIG. 34 another front elevation illustrating a color image forming unit for forming color images incorporating three image forming units (photoreceptor unit, charging unit and developer unit), FIG. 35 still another front elevation illustrating the above noted three image forming units detached from each other, and FIGS. 36 and 37 perspective views illustrating a charging unit as an image forming unit and a developer unit as another image forming unit, respectively.

Approximately in the middle of its main chases 2, the full color printer 1 is provided with four image bearing units, 300Y, 300M, 300C and 300Bk, exposure unit 8, and intermediate transfer belt 12. Respective image forming units 300 are adapted to form images of different colors such as yellow Y, magenta M, cyan C and black Bk.

The image forming units 300 each have similar basic structure under the provision for adopting respective toner particles different only in color-wise. Minor differences in structure are present, however, between the units 300Y, 300M and 300C for forming color images, and the unit 300Bk for forming black images, as detailed herein below.

In addition, the respective image forming units 300 are each consisted of the photoreceptor 3 which is formed as an image bearing member to be rotated in the direction designated with an arrow in the drawing, a charging roller 4 as another image forming unit situated in the circumference of the photoreceptor 3, and a developing unit 6 as still another image forming unit.

The exposure unit 8 is provided to scan illuminate laser beams corresponding to respective color images onto the outer periphery of photoreceptor unit 3.

The photoreceptor unit 3 has a cylindrical structure made of aluminum, with a diameter ranging from 30 to 100 mm. The surface of the aluminum cylindrical structure is then provided with the layer of an organic semiconductor material as a photoconductive substance. By illuminating laser beams emitted from the exposure unit 8, electrostatic latent images are formed on the surface of photoreceptor unit 3 corresponding to image data.

Incidentally, narrow openings are provided for the beam illumination between the charging rollers 4 of the image forming units 3 and developing units 6 to serve as slits for allowing the passage of laser beams from the exposure unit 8 to be incident onto the respective photoreceptor units 3. In addition, the surface of photoreceptor units 3 is uniformly charged by the charging roller 4.

The developing unit 6 is adapted to convey toner particles to be attached to the electrostatic latent images formed on the surface of photoreceptor unit 3, whereby thus formed latent images are rendered visible as toner images.

The intermediate transfer belt 12 is formed with such a material as a film of resinous material or rubber, for example, preferably having a thickness ranging from 50 to 600 $\mu$m and a resistance suitable for transferring toner images previously formed on the photoreceptor 3.

The intermediate transfer belt 12 is supported by rollers 9 through 11 and rotated in the direction designated by an arrow in the drawing. On the inner periphery of intermediate transfer belt 12, there provided are four transfer rollers 18 for transferring toner images previously formed on respective photoreceptors 3.

A cleaning unit 14 is further provided on the outer periphery of intermediate transfer belt 12 in use for removing disused toner residual and paper dusts from the surface of the intermediate transfer belt 12.

Under four photoreceptor 300 and exposure unit 8 in the main chases 2, transfer sheets S are supported in stacked arrangement on the two storied feeding trays 23 or 24, and then separated and fed sequentially from the uppermost sheet.

A sheet transport path 27 and sheet disposal path 30 are housed in the main chases 2 for conveying transfer sheets S. Along the sheet transport path 27 and sheet disposal path 30, there provided are a registration roller 28, transfer belt 17 for serving also as sheet conveying belt, transfer charger 20, fixing unit 31 and sheet disposal roller 32.

The registration roller 28 is adapted to rotate intermittently in predetermined timing. Through the intermittent rotation of the registration roller 28, the sheets previously forwarded to the location of registration roller 28 is further forwarded to the transfer location.

The transfer belt 17 is formed with such a material as a film of resinous material or rubber, for example, preferably having a thickness ranging from 50 to 600 $\mu$m, supported by rollers 15, 16 and 19 through 11, be rotated in the direction designated by the arrow mark in the drawing.

On the rear side (inner periphery) of transfer belt 17, there provided is a transfer roller 18, while the cleaning unit 21 is provided on the outer periphery of transfer belt 17 in use for removing disused toner residual and paper dusts from the surface of the transfer belt 17.

The portion of the intermediate transfer belt 12, the backside of which is supported by the roller 9, is further pressed against the obverse portion, the backside of which is supported by the roller 19 and transfer roller 18, whereby the transfer position is formed, at which the toner images transferred from the intermediate transfer belt 12 to transfer belt 17, or vice versa, is further transferred to transfer sheets conveyed to that position.

In case when toner images are transferred from intermediate transfer belt 12 to transfer belt 17, toner images on the transfer belt 17 and those newly formed on the intermediate transfer belt 12 can be transferred simultaneously onto both faces of transfer sheet S. In this case the tone images on transfer belt 17 are transferred to a fist side of the sheet S by means of transfer charger 20, while those on intermediate transfer belt 12 are transferred to the other side of the sheet S by transfer roller 18.

On the other hand, the image formation only onto one side of sheet is carried out by transferring toner images on intermediate transfer belt 12, and utilizing the transfer belt 17 as a sheet conveying means.

The fixing unit 31 is adapted to affix the thus transferred toner images onto transfer sheet S. The transfer sheet S which is subjected to fixing steps at the fixing unit 31 is subsequently directed to a sheet output tray 29 provided on the upper portion of the main chases 2.

Above the four image forming units 300 and intermediate transfer belt 12 mounted in the main chases 2, a toner container holding component 33 is provided, detachably including toner containers 33Y, 33C, 33M and 33Bk for containing toner particles to be supplied to the image forming unit 300.

The toner container holding component 33 is adapted to detachably mount five toner containers 33Y, 33C, 33M and 33Bk each in similar shape, and there mounted are one for each of toner containers 33Y, 33C and 33M for containing yellow, cyan and magenta toner, respectively, and two toner containers 33Bk for containing black.

In other word, the toner containers 33Y, 33C and 33M for color toner (yellow, cyan and magenta) are mounted with one of each, while the toner container 33Bk is mounted with two thereof, after the practical consideration that the consumption of larger amount of the black toner is generally anticipated.

Toner particles contained in respective containers held on the toner container holding component 33 are then transported to respective image forming units 300Y, 300C, 300M and 300Bk of corresponding colors by a toner transport mechanism (not shown).

Among several units included in the image forming unit 300, image bearing units 300Y, 300M, 300C and 300Bk are detailed herein below in reference to FIGS. 34 through 37. The image bearing unit 300Y (300M, 300C) is formed including at least several image forming members such as a photoreceptor 3Y (3M, 3C), charging roller 4Y (4M, 4C), and developing unit 6Y (6M, 6C).

Among the image forming members 3, 4 and 6, a plurality of those endowed with the same function are unified as a unit, whereby a photoreceptor unit 301 as an image forming member unit, charging roller unit 302 as another image forming member unit, and developer unit 303 as still another image forming member unit, are formed.

The photoreceptor unit 301 is formed by mounting three photoreceptors 3Y, 3M, and 3C on a photoreceptor holding case 301*a*, each being rotatably fixed at proper location. The distance between neighboring photoreceptors is adjusted to be 'a'.

The charging roller unit 302 is formed by mounting three charging rollers 4Y, 4M and 4C on a charging roller holding case 302*a*, each being fixed at proper location. The distance between neighboring charging rollers is adjusted to be 'a'.

The developer unit 303 is formed by mounting three developing units 6Y, 6M, and 6C on a developer holding case 303*a*, each being fixed at proper location. The distance between neighboring developing units is adjusted to be 'a'.

The photoreceptor unit 301, charging roller unit 302, and developer unit 303 are arranged to be able to be detached from each other as shown in FIG. 35, and also assembled as shown in FIG. 34.

When assembled as shown in FIG. 34, the photoreceptor 3Y, charging roller 4Y and developing unit 6Y are assembled to form an image bearing unit 300Y for forming images colored in yellow; the photoreceptor 3M, charging roller 4M and developing unit 6M to form another image bearing unit 300M for forming images colored in magenta; and the photoreceptor 3C, charging roller 4C and developing unit 6C are assembled to form still another image bearing unit 300C for forming images colored in cyan.

In addition, when the photoreceptor unit 301, charging roller unit 302, and developer unit 303 are assembled as shown in FIG. 34, these units are structured to be slidably mounted into and out of the main chases 2.

In other word, the photoreceptor unit 301, charging roller unit 302, and developer unit 303 are assembled as shown in FIG. 34 when stored inside the main chases 2, and these units can be pulled out of the chases 2 as an assembly. Thereafter, the units such as photoreceptor unit 301, charging roller unit 302 and developer unit 303, can be separated from each other.

During color image formation utilizing the thus formed structure of image forming units, color images (toner images) are formed in respective image bearing units 300Y, 300C and 300M, and then transferred onto the intermediate transfer belt 12 in a manner of proper registration, whereby a full color image is formed as a sequential overlap of the toner images. The full color image is subsequently transferred, at the aforementioned transfer position, onto a transfer sheets S which was supported on feeding trays 23 or 24 and separated and fed sequentially from the uppermost sheet. (It may be noted this applies to the case of image formation onto one side of the sheet.)

The image forming members such as photoreceptor 3, charging roller 4 and developing unit 6 are considered as consumable supplies, and they have to be replenished in a certain cycling time depending on operation life.

As to the replacement of these members 3, 4 and 6, those included in image bearing units 300Y, 300M and 300C with the same or similar function can be replaced simultaneously. That is, there can be replaced simultaneously are three photoreceptors 3Y, 3M and 3C as a photoreceptor unit 301, three charging rollers 4Y, 4M and 4C as a charging roller unit 302, and three developing units 6Y, 6M and 6C as a developer unit 303.

As a result, labor hours for replacing the image forming members 3, 4 and 6 can be reduced and the operation frequency for the replacement can also be decreased.

In addition, since the photoreceptor unit 301 (302, 303) is formed by unifying the members 3 (4, 6) with the same function as a unit, the operation life for these members 3 (4, 6) with the same function is considered approximately the same. Therefore, even replacing the unified members 3 (4, 6) simultaneously, the replacement time turns out to be appropriate for the members 3 (4, 6) of image forming unit 301 (302, 303).

As a result, wasteful use of resources can be obviated for replacing the image forming members 3, 4 and 6.

The replacement operation is carried out for image forming units 301, 302 and 303, by pulling the units by sliding out of the main chases 2, separating the specific unit 301 (302, 303) to be replaced out of the units 301, 302 and 303, and replacing with new image forming unit 301 (302, 303). As a result, replacement operations can be carried out with relative ease.

For respective image forming members 3, 4 and 6 in image forming units 301, 302 and 303 in the present embodiment, the distance is described earlier as 'a' between neighboring members. The distance, however, is not limited to this specific value 'a' applied uniformly to the members, but other values may also be applicable.

For example, the distance between two presently selected out of the image forming members 3, 4 and 6 may be alternatively adjusted to be same over the image forming units 301, 302 and 303.

More specifically, the following case is suitably considered in the image forming units 301, 302 and 303, in which the distances between photoreceptors 3Y and 3M, charging rollers 4Y and 4M, and developing units 6Y and 6M, are adjusted to be the same one another as the value 'A', while the distances between photoreceptors 3M and 3C, charging rollers 4M and 4C, and developing units 6M and 6C, are adjusted to be the same one another as 'B'.

With such a construction of the image bearing units 300Y, 300C and 300M in image forming units 301, 302 and 303, respectively, high accuracy of position can be maintained satisfactorily between respective image forming members 3, 4 and 6.

As a result, the difference in distance can be eliminated between photoreceptor 3Y and developing unit 6Y, for example, over image bearing units 300Y, 300C, 300M, to thereby for excellent image forming capabilities can be retained for respective the image bearing units 300Y, 300C, 300M.

Figure 38:
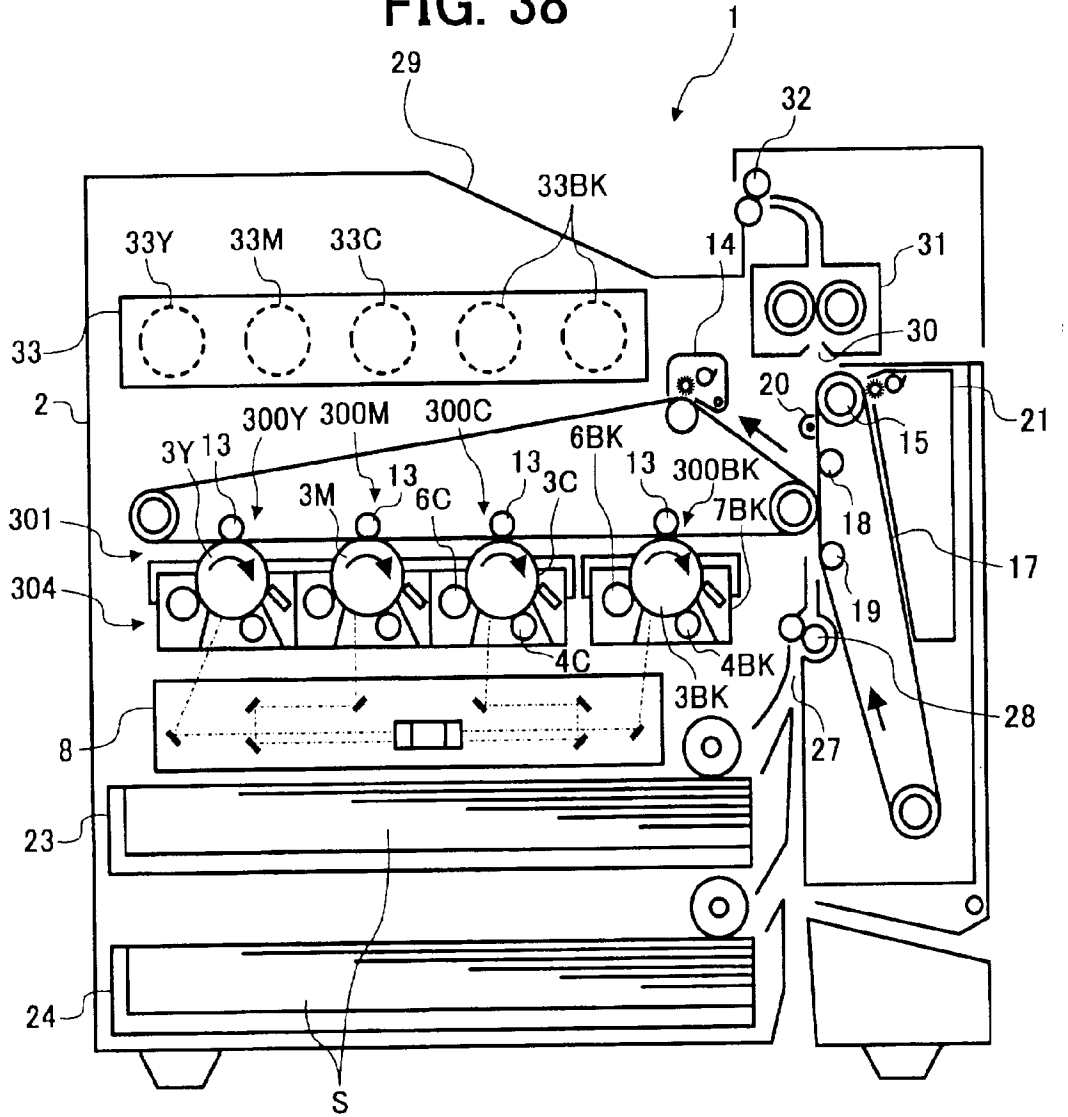
FIG. 38 is a front elevation illustrating the structure of a full color printer as image forming apparatus according to another embodiment disclosed herein.
Figure 39:
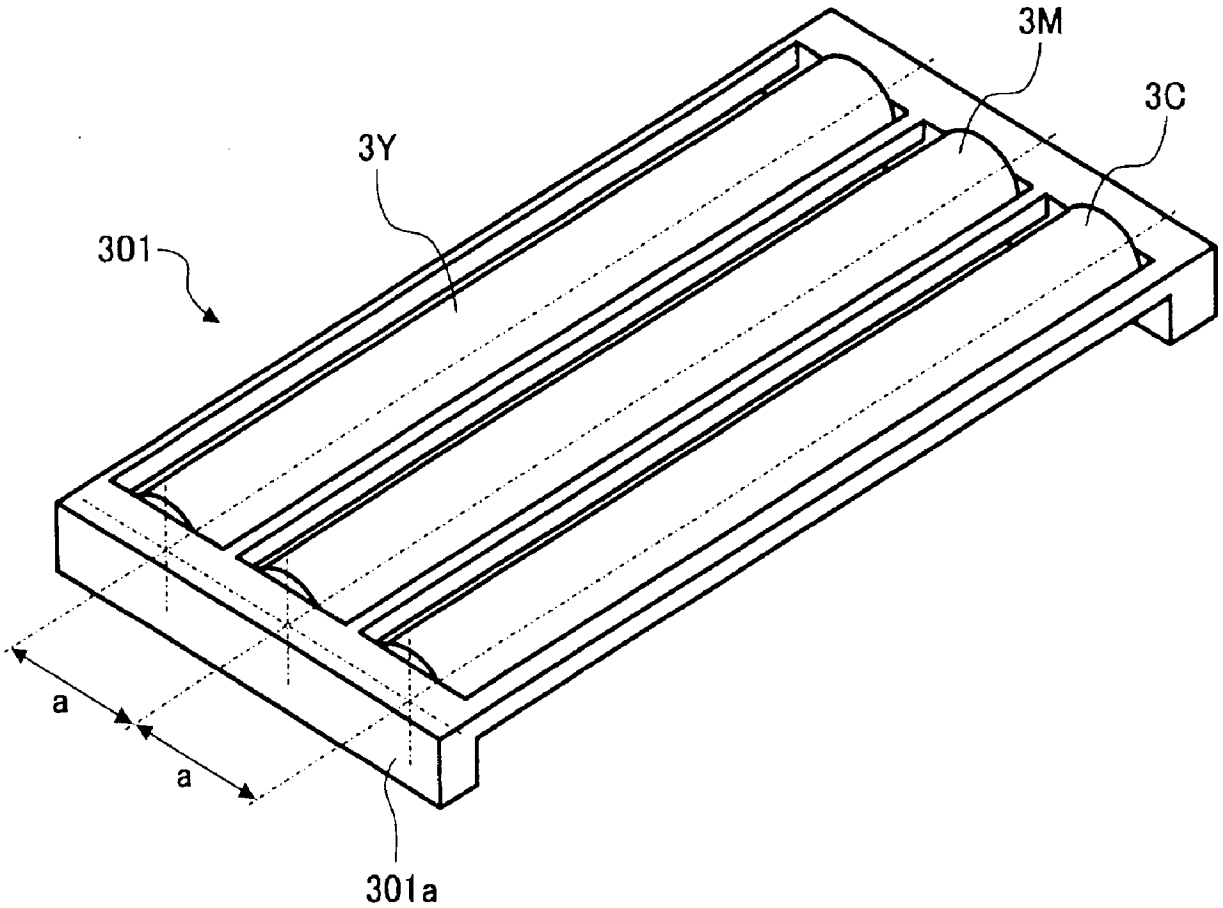
FIG. 39 is a perspective view illustrating a photoreceptor unit as an image forming unit included in the full color printer of FIG. 38.
Figure 40:
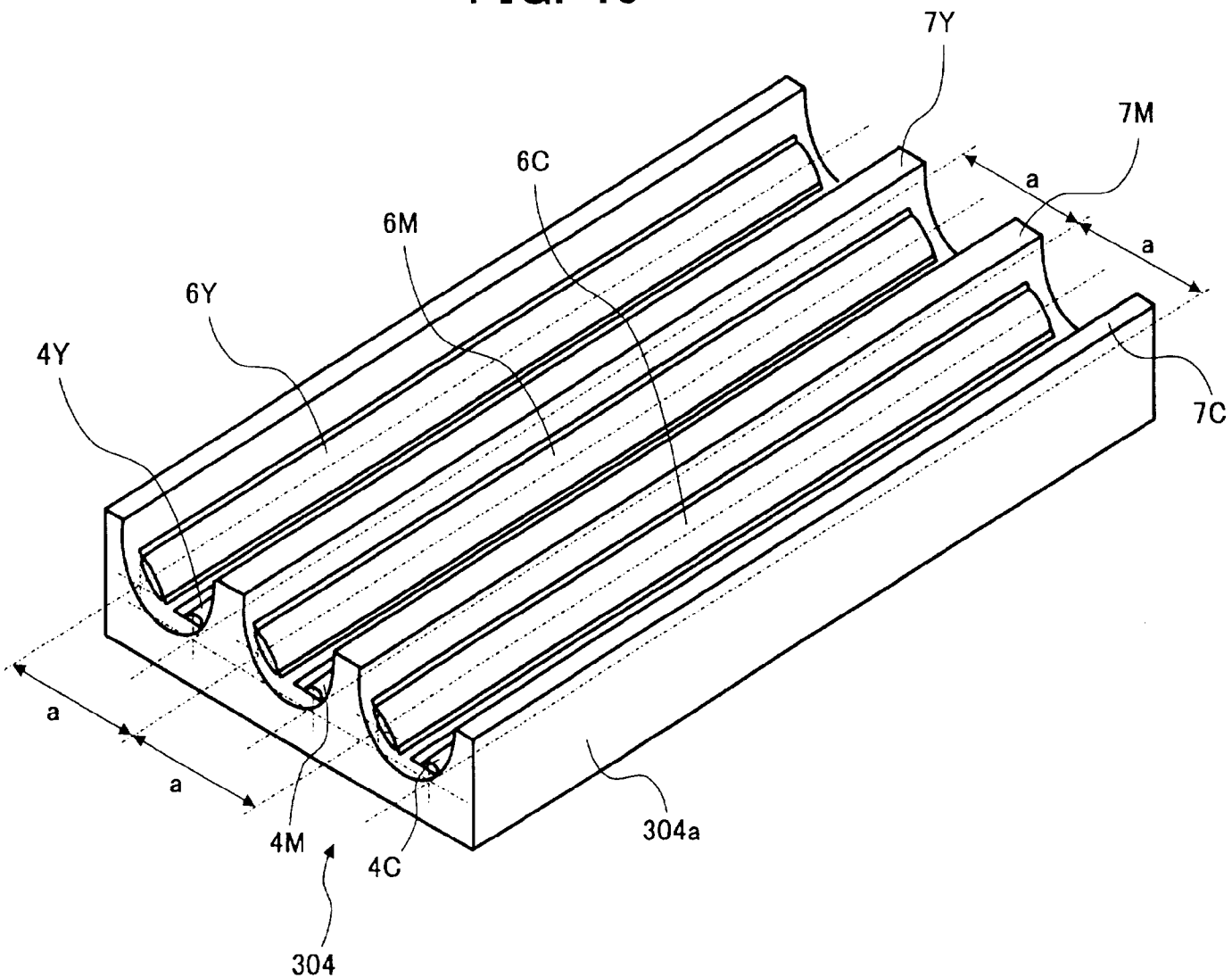
FIG. 40 is another perspective view illustrating a composite unit as an image forming unit included in the full color printer of FIG. 38.

In another aspect, the full color printer is provided with a further contact/detach mechanism according to the fourth embodiment disclosed herein in reference to FIGS. 38 through 40.

FIG. 38 is a front elevation illustrating the structure of a full color printer as image forming apparatus, and FIGS. 39 and 40 are perspective views illustrating a photoreceptor unit as an image forming unit and a composite unit as another image forming unit, respectively.

Having a basic structure similar to that described in the previous third embodiment, approximately in the middle of its main chases 2, the full color printer 1 is provided with four image bearing units, 300Y, 300M, 300C and 300Bk, exposure unit 8, and intermediate transfer belt 12. Respective image forming units 300 are adapted to form images of different colors Y, M, C and Bk.

In addition, the respective image forming units 300 are each consisted of several image forming members such as the photoreceptor 3 formed as an image bearing member to be rotated in the direction designated with an arrow in the drawing, a charging roller 4 as another image forming unit situated in the circumference of the photoreceptor 3, a developing unit 6, and a cleaning unit 7 for cleaning disused toner residual and paper dusts from the surface of the photoreceptor.

The image bearing unit 300Y (300M, 300C) is formed including at least several image forming members such as a photoreceptor 3Y (3M, 3C), charging roller 4Y (4M, 4C), developing unit 6Y (6M, 6C), and cleaning unit 7Y (7M, 7C).

Among the image forming members 3, 4, 6 and 7, a plurality of those endowed with the same function are unified as a unit, whereby a photoreceptor unit 301 as an image forming member unit and a composite unit 304 as another image forming member unit, are formed.

The photoreceptor unit 301 is formed by mounting three photoreceptors 3Y, 3M, and 3C on a photoreceptor holding case 301*a*, each being rotatably fixed at proper location. The distance between neighboring photoreceptors is adjusted to be 'a'.

The composite unit 304 is formed by unifying not only those endowed with the same function but also those with different functions as well.

That is, the composite unit 304 is formed by mounting, on a composite holding case 304*a*, three of photoreceptors, 3Y, 3M, and 3C, charging rollers, 4Y, 4M and 4C, developing units, 6Y, 6M, and 6C, and cleaning units, 7Y, 7M and 7C, each being fixed at proper location. The distance between neighboring similar members, photoreceptors 3, charging rollers 4, developing units 6 and cleaning units 7, is adjusted to be 'a'.

The constituents of the composite unit 304, photoreceptors 3, charging rollers 4, developing units 6 and cleaning units 7, are considered to have approximately the same operation life, although the function is different each other.

The photoreceptor unit 301 and composite unit 304 are arranged to be able to be detached from one another as shown in FIGS. 39 and 40, and also assembled as shown in FIG. 38.

When assembled as shown in FIG. 38, the photoreceptor 3Y, charging roller 4Y, developing unit 6Y and cleaning unit 7Y are assembled to form an image bearing unit 300Y for forming images colored in yellow; the photoreceptor 3M, charging roller 4M, developing unit 6M and cleaning unit 7M to form another image bearing unit 300M for forming images colored in magenta; the photoreceptor 3C, charging roller 4C, developing unit 6C and cleaning unit 7C are assembled to form still another image bearing unit 300C for forming images colored in cyan.

In addition, when the photoreceptor unit 301 and composite unit 304 are assembled as shown in FIG. 38, these units are structured to be slidably mounted into and out of the main chases 2.

In other word, the photoreceptor unit 301 and composite unit 304 are assembled as shown in FIG. 38 when stored inside the main chases 2, and these units can be pulled out of the chases 2 as an assembly. Thereafter, the units such as photoreceptor unit 301 and composite unit 304 can be separated one another.

The image forming members such as photoreceptor 3, charging roller 4, developing unit 6 and cleaning unit 7 are considered as consumable supplies, and they have to be replenished in a certain cycling time depending on operation life.

As to the replacement of the members 3, 4, 6 and 7, at least those included in image bearing units 300Y, 300M and 300C for forming color images with the same or similar function can be replaced simultaneously. That is, there can be replaced simultaneously are three photoreceptors 3Y, 3M and 3C as a photoreceptor unit 301, three of charging rollers, 4Y, 4M and 4C; developing units, 6Y, 6M and 6C; and cleaning units, 7Y, 7M and 7C, as a composite unit 304.

As a result, operation frequency of replacing the image forming members 3, 4, 6 and 7 can be decreased, and labor hours for the replacement can also be decreased.

In addition, in the present case of the composite unit 304, the replacement can be carried out simultaneously with respect to not only those endowed with the same function such as 4 (6 or 7) but also those with different functions such as 4, 6 and 7, as well. As a result, operation frequency of replacing the image forming members 4, 6 and 7 can be decreased.

Furthermore, since the photoreceptor unit 301 is formed by unifying the photoreceptors members 3Y, 3M and 3C as a unit, the operation life for the members 3Y, 3M and 3C is considered approximately the same. Therefore, even replacing the unified photoreceptors members 3Y, 3M and 3C simultaneously, the replacement time turns out to be appropriate for these members.

As a result, wasteful use of resources can be obviated for replacing the photoreceptors 3.

For the composite unit 304, in contrast, the units already unified are not only those endowed with the same function such as 4 (or 6, 7) but also those with different functions such as 4, 6 and 7, as well.

Since some of the abovementioned units have the same operation life despite of the difference in function, even replacing the unified members 4, 6 and 7 simultaneously, the replacement time turns out to be appropriate for these members. As a result, wasteful use of resources can be obviated for replacing the members 4, 6 and 7.

In another aspect, the full color printer as an image forming apparatus is additionally provided with several display units adapted to indicate the parts or units for which a maintenance work and/or parts exchange operation is needed.

Figure 44:
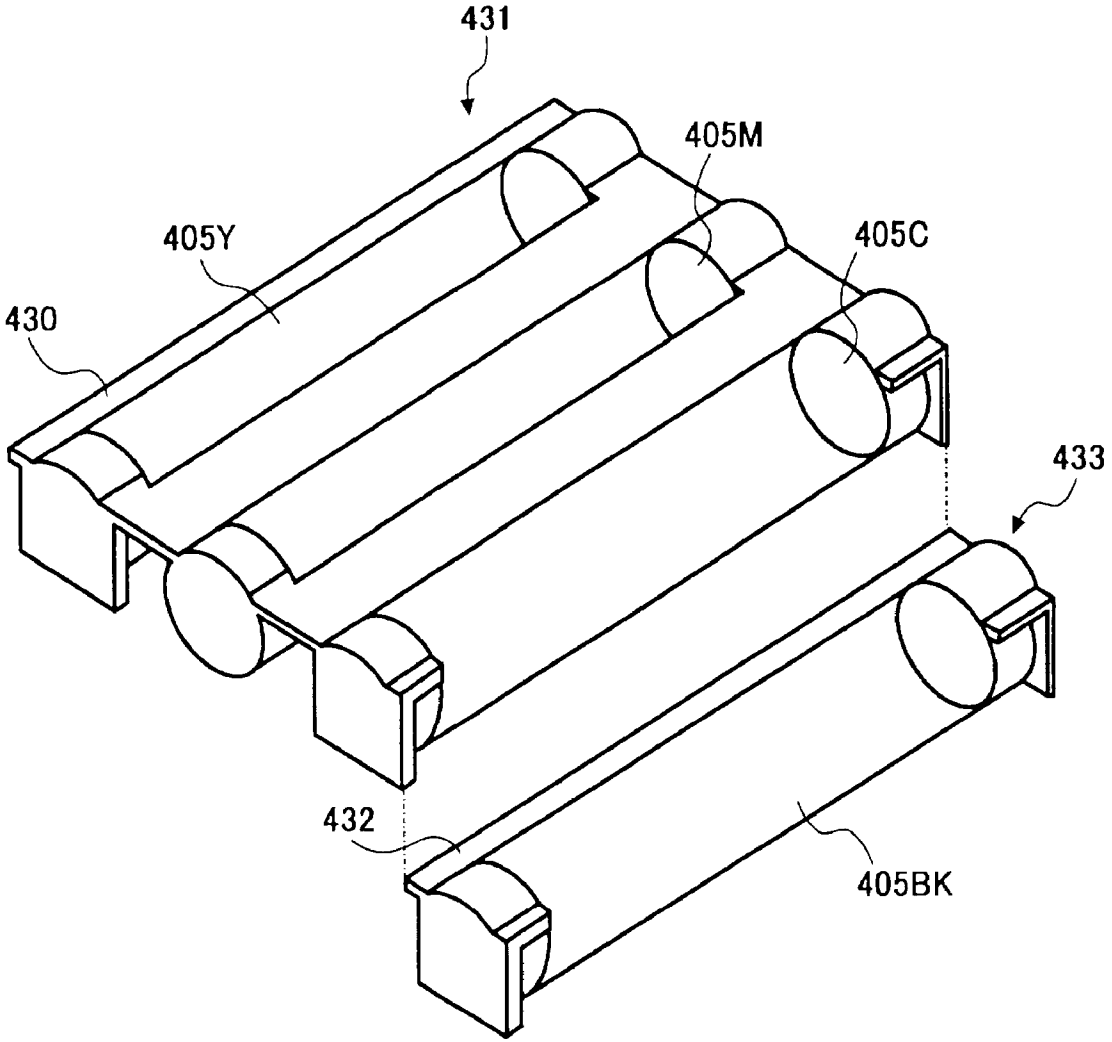
FIG. 44 is a perspective view prepared for illustrating photoreceptor units to be subjected to maintenance work and/or parts exchange operation.
Figure 45:
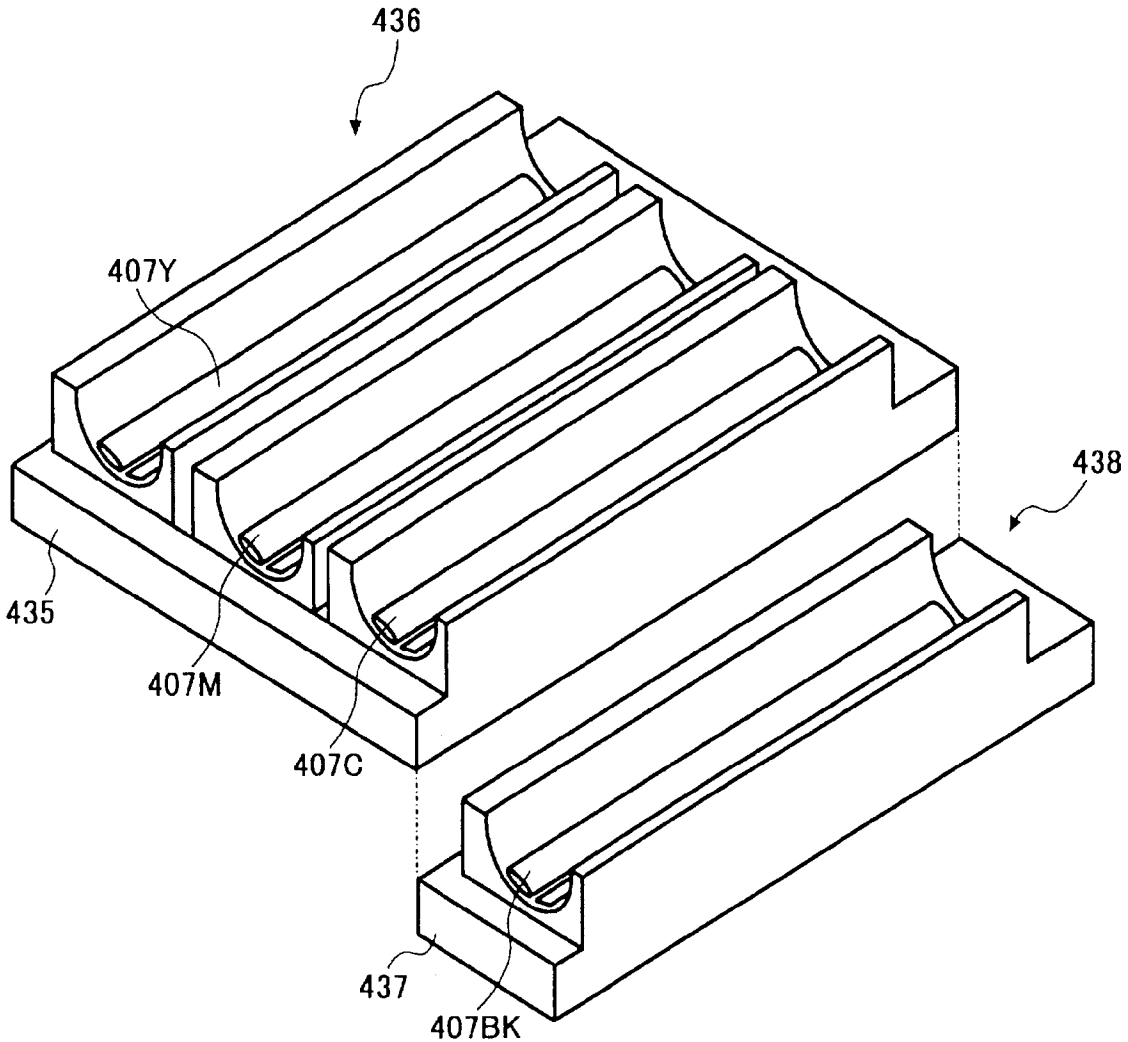
FIG. 45 is another perspective view illustrating composite units to be subjected to maintenance work and/or parts exchange operation.
Figure 46:
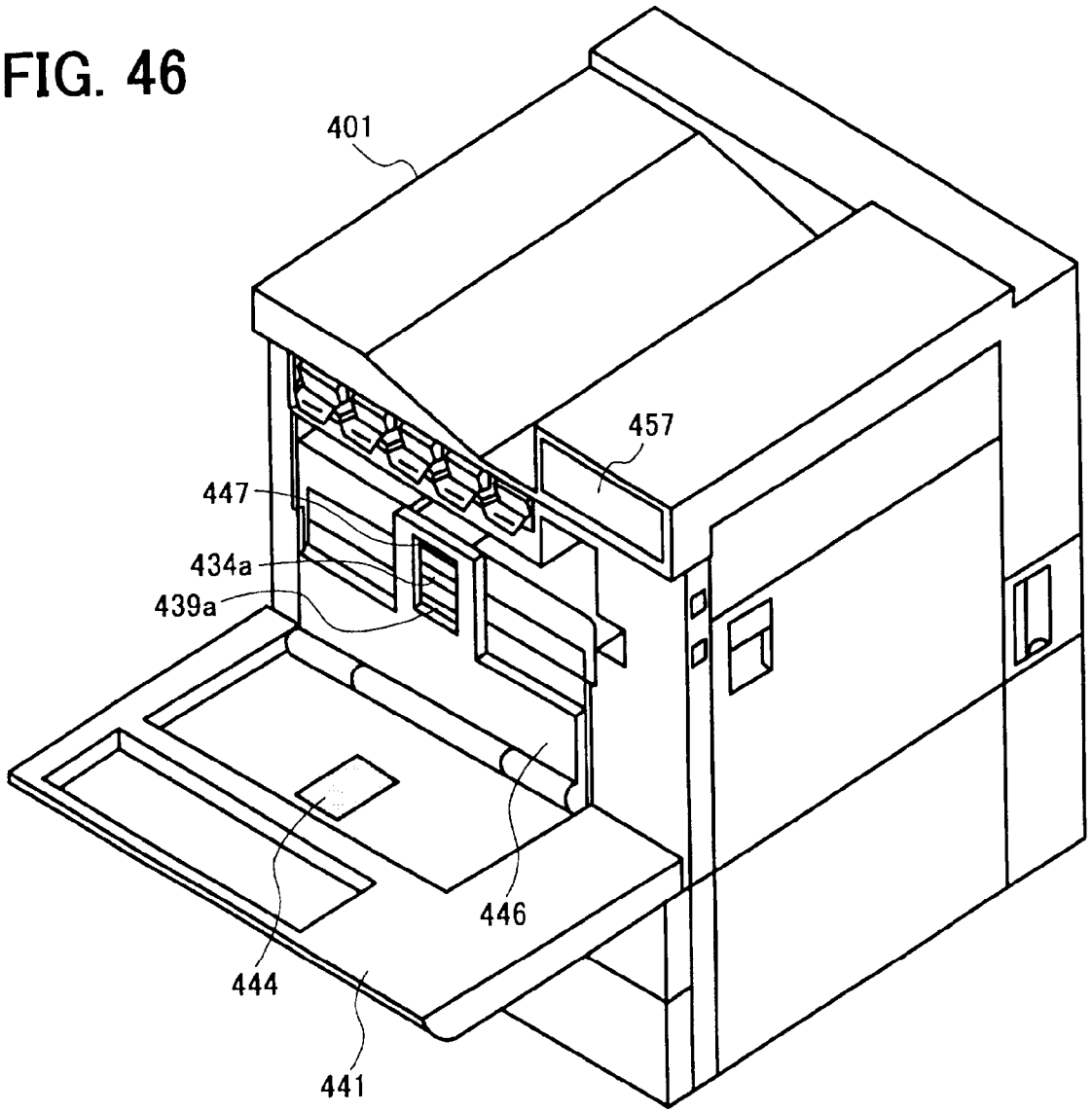
FIG. 46 is still another view illustrating a frontal holding cover in its opened status.
Figure 47:
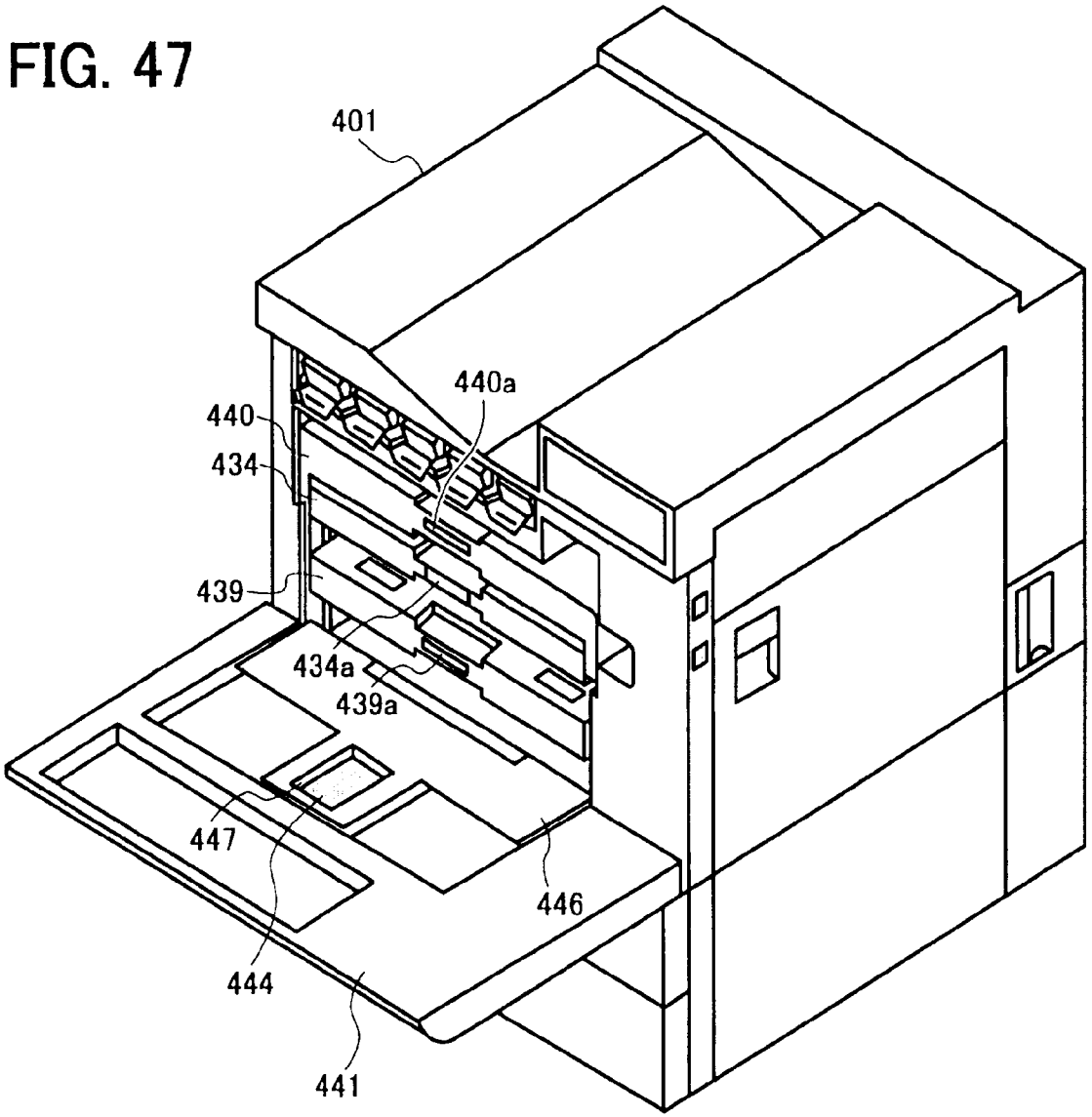
FIG. 47 is another view illustrating a holding cover being opened.
Figure 48:
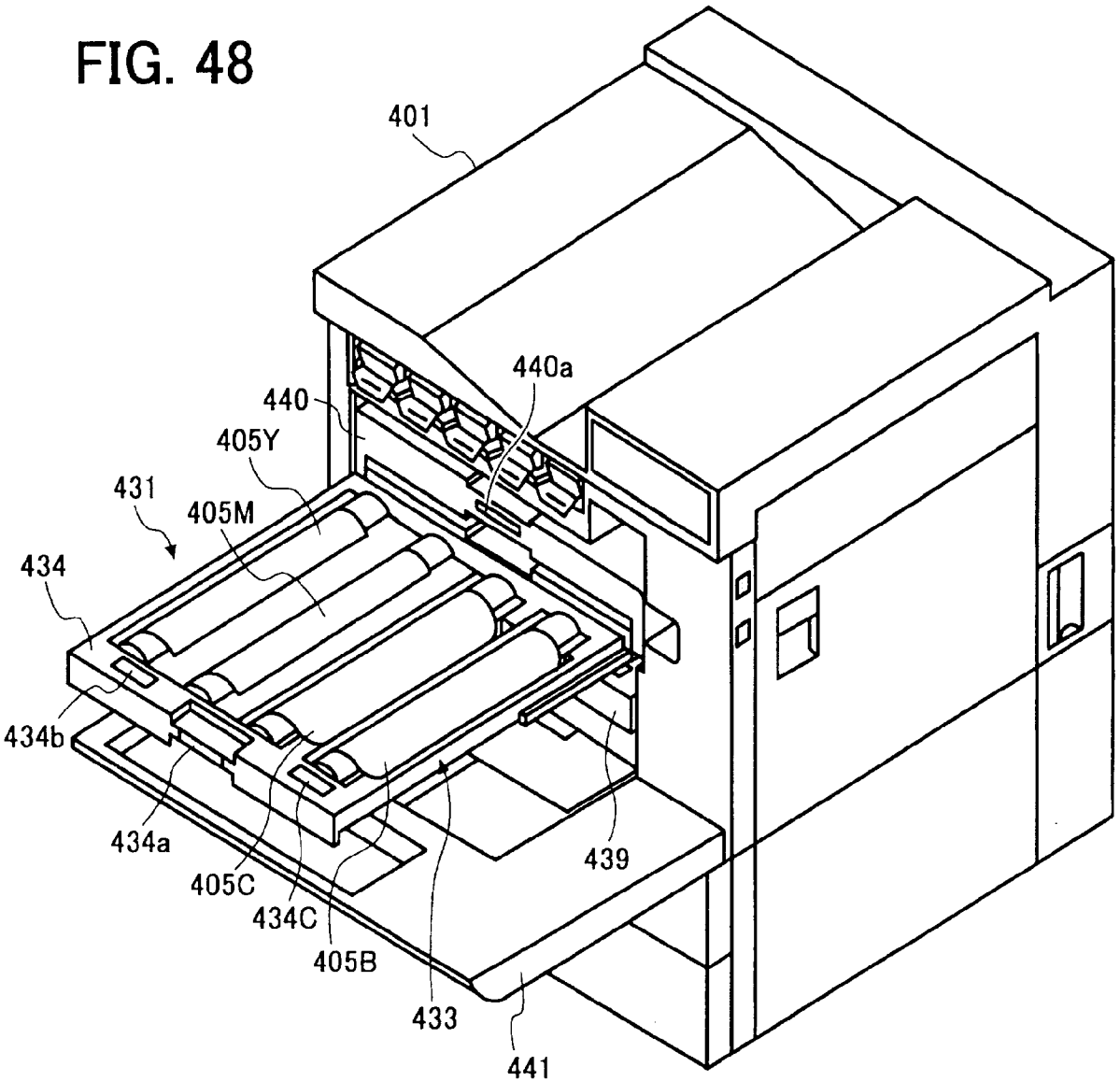
FIG. 48 is another view illustrating a tray loaded with photoreceptor units being pulled out of the main chases.
Figure 49:
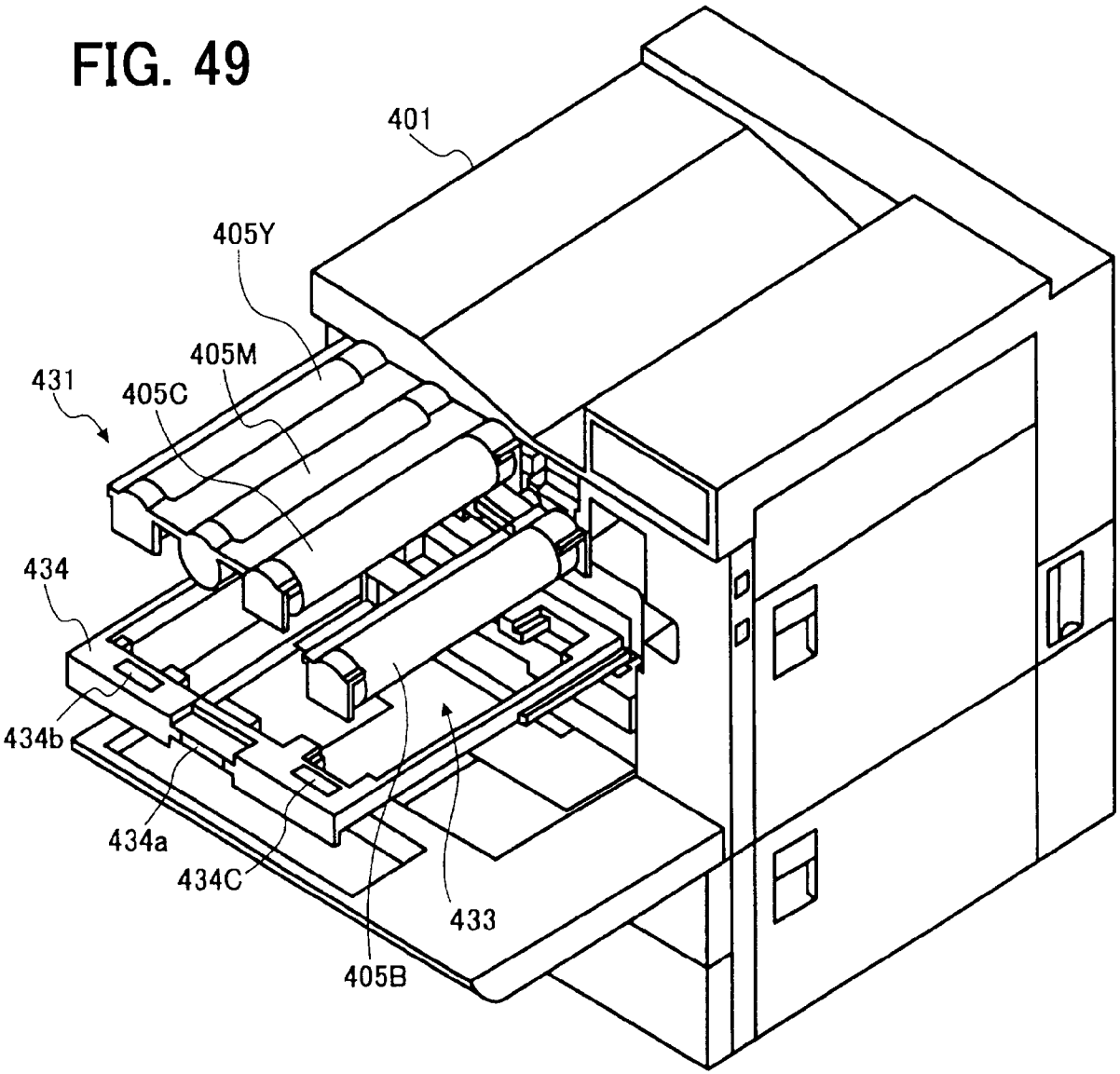
FIG. 49 is another view illustrating the photoreceptor unit being removed from the tray.
Figure 50:
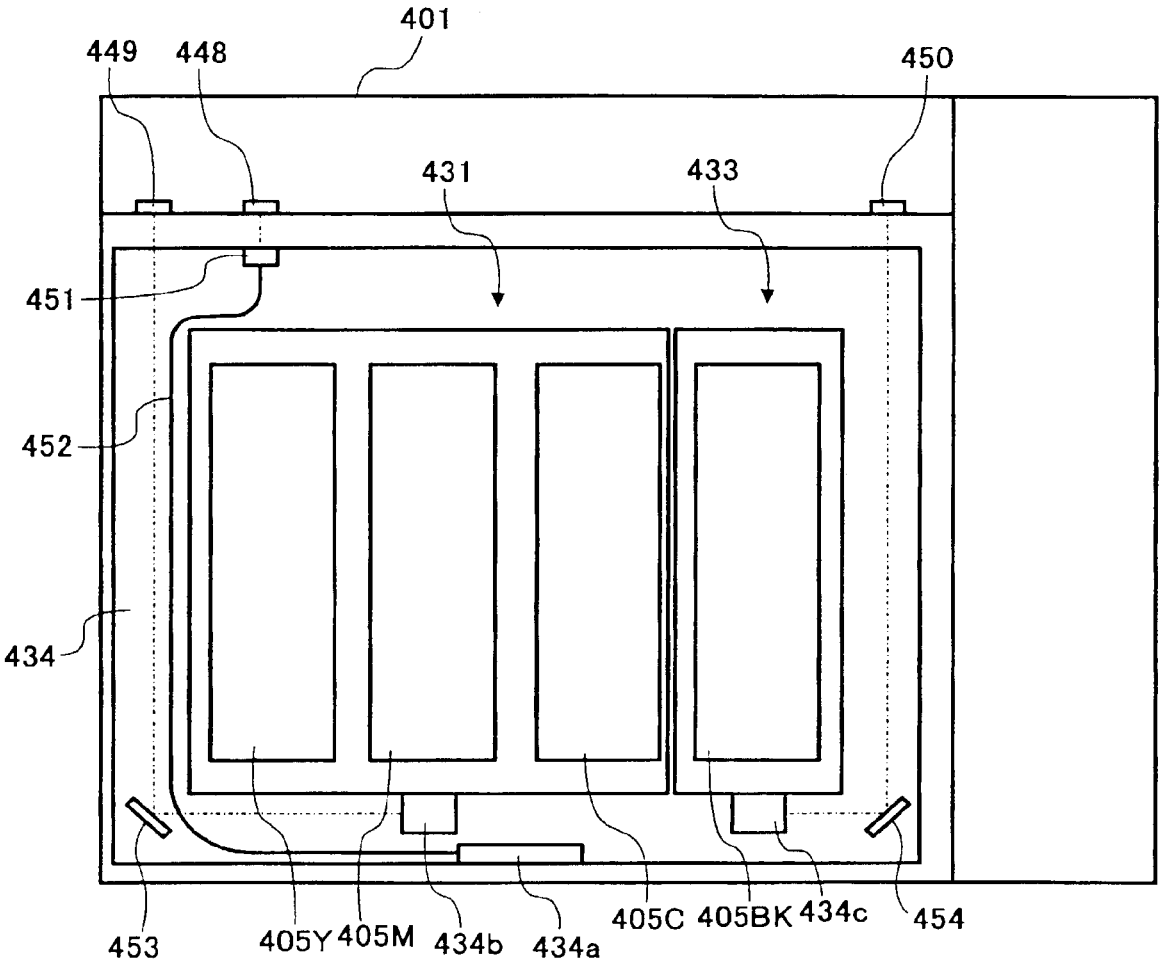
FIG. 50 is a broad plan view illustrating the photoreceptor units being removed from the tray.
Figure 51:
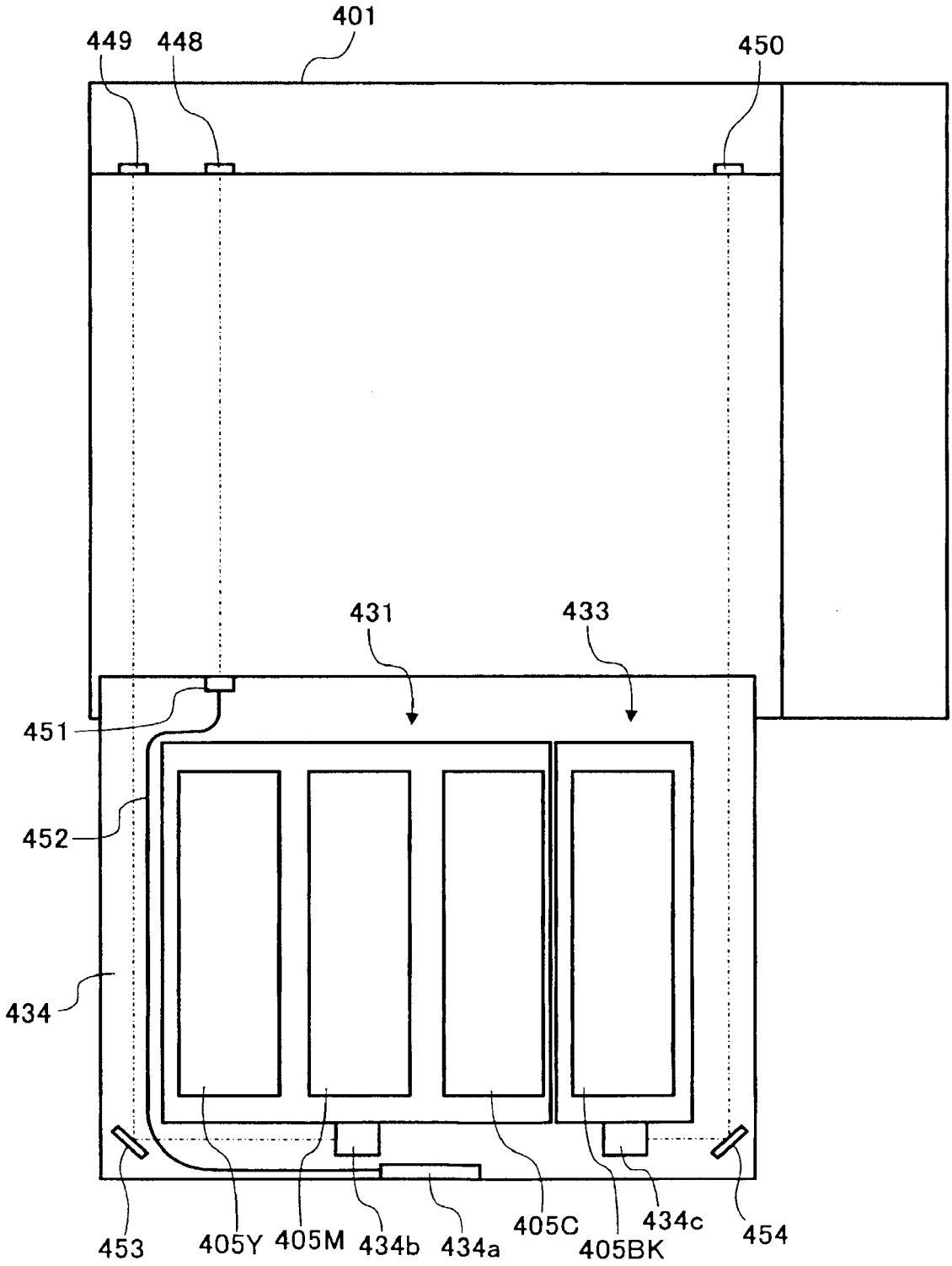
FIG. 51 is a horizontal cross sectional view illustrating the tray after being pulled out of the main chases.
Figure 52:
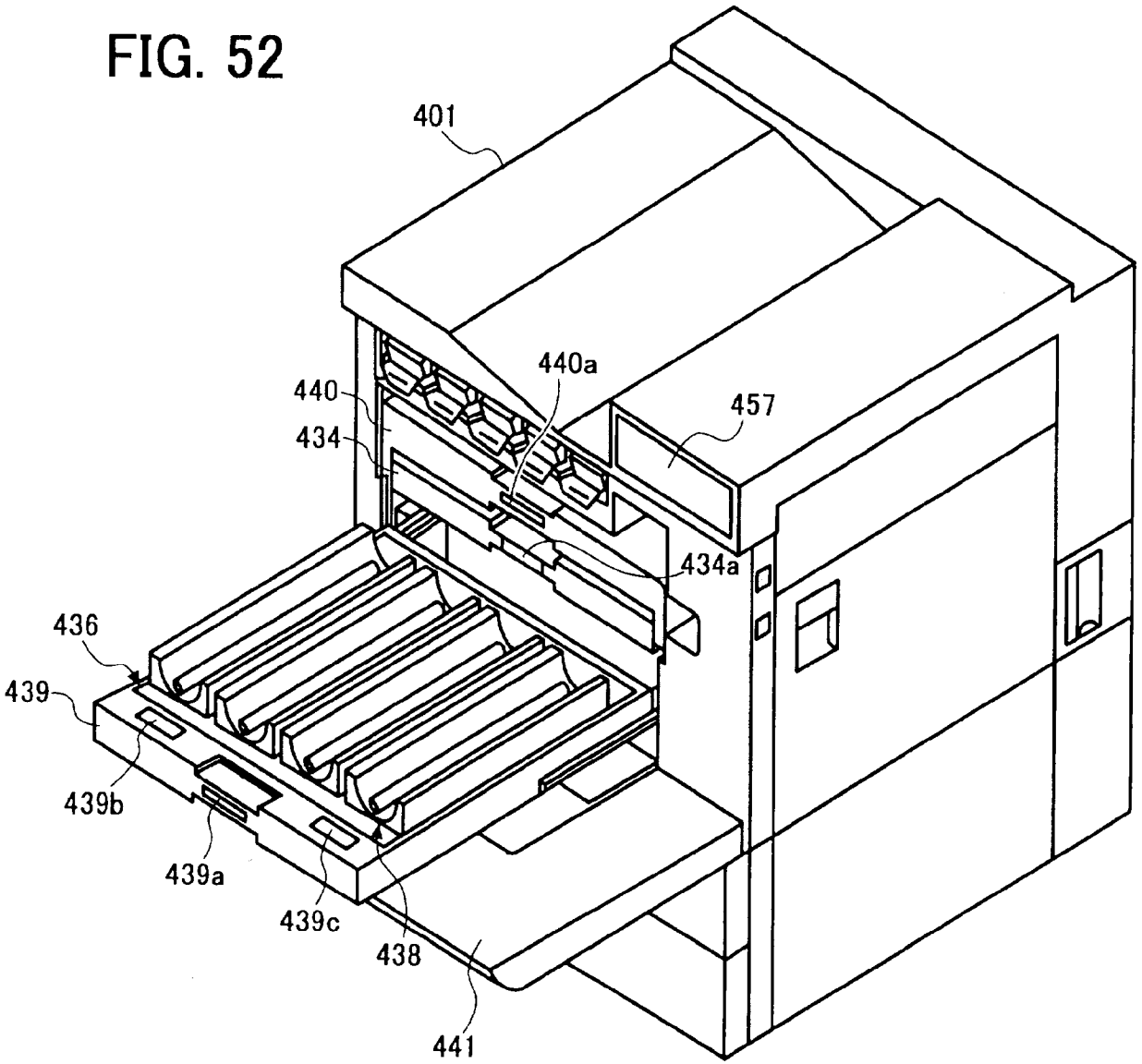
FIG. 52 is a perspective view illustrating a tray loaded with complex units being pulled out of the main chases.
Figure 53:
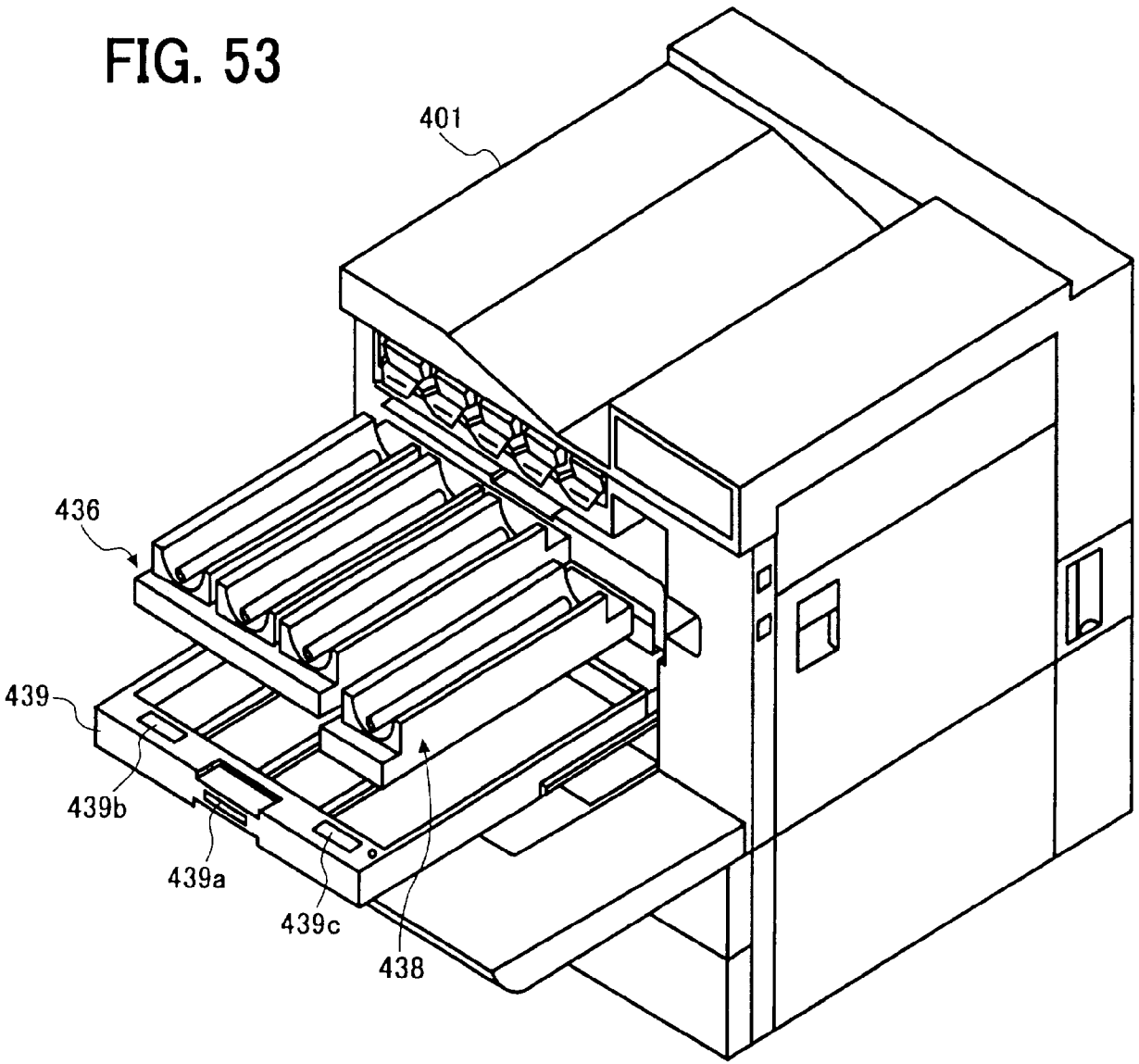
FIG. 53 is a perspective view illustrating the complex unit being removed from the tray.
Figure 54:
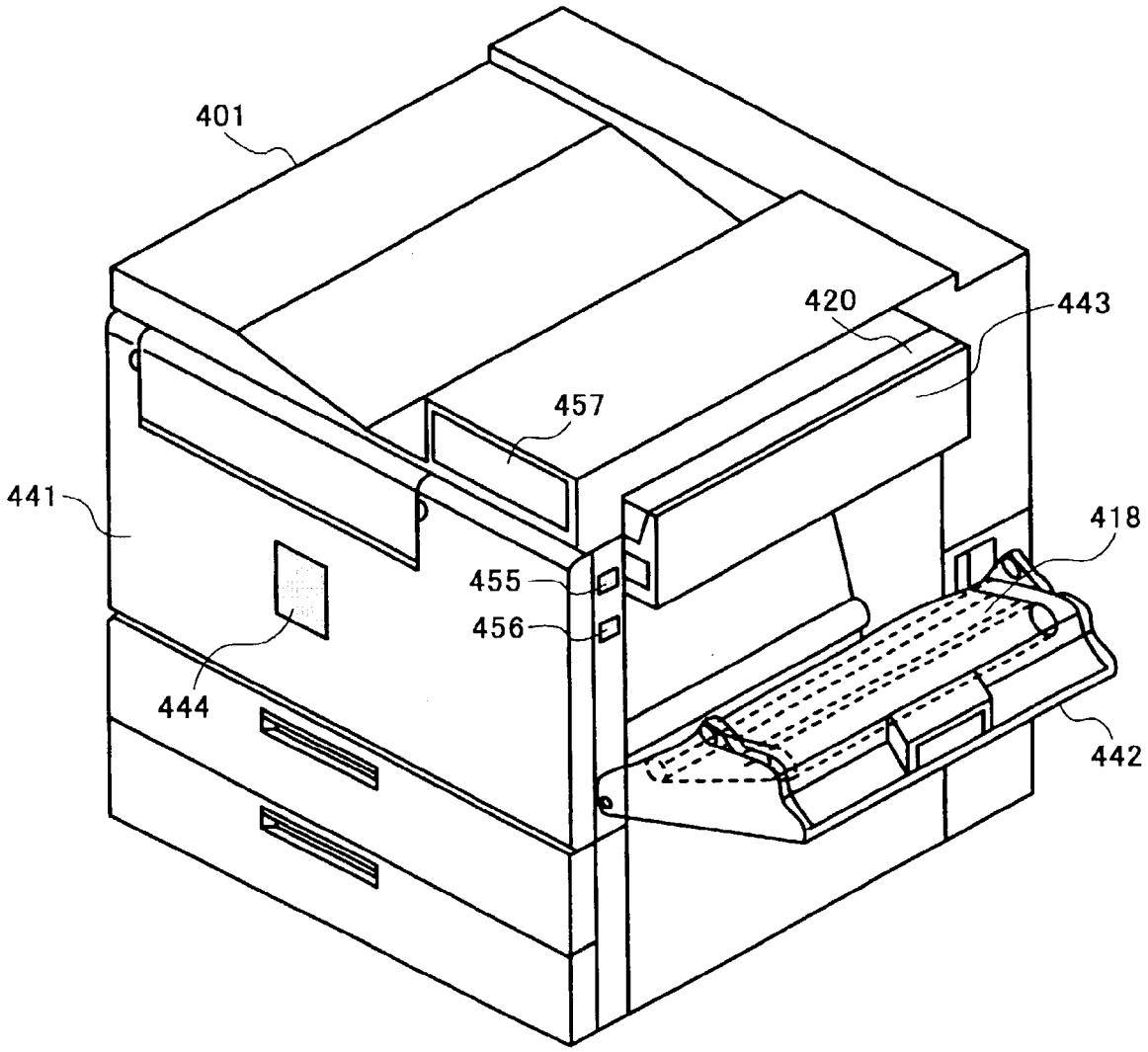
FIG. 54 is a perspective view illustrating a transfer belt as an operating subject being exposed after opening a side cover, and also illustrating a fixing unit as another operating subject being exposed after opening a fixer cover.

FIG. 44 is a perspective view prepared for illustrating photoreceptor units (color and black photoreceptor units) to be subjected to maintenance work and/or parts exchange operation, FIG. 45 another perspective view illustrating composite units (color and black composite units) to be subjected to maintenance work and/or parts exchange operation, FIG. 46 still another view illustrating a frontal holding cover in its opened status, FIG. 47 another view illustrating a holding cover being opened, FIG. 48 another view illustrating a tray loaded with photoreceptor units being pulled out of the main chases, FIG. 49 another view illustrating the photoreceptor unit being removed from the tray, FIG. 50 a broad plan view illustrating the photoreceptor units being removed from the tray, FIG. 51 a horizontal cross sectional view illustrating the tray after being pulled out of the main chases, FIG. 52 a perspective view illustrating a tray loaded with complex units being pulled out of the main chases, FIG. 53 a perspective view illustrating the complex unit being removed from the tray, and FIG. 54 a perspective view illustrating a transfer belt as an operating subject being exposed after opening a side cover, and also illustrating a fixing unit as another operating subject being exposed after opening a fixer cover.

As described earlier, the image forming unit 402Y (402M, 402C and 402Bk) is formed including at least several image forming members such as photoreceptor 405Y (405M, 405C and 405Bk), charging roller 406Y (406M, 406C and 406Bk), developing unit 407Y (407M, 407C and 407Bk) and cleaning unit 408Y (408M, 408C and 408Bk).

Among the constituents of the image forming units 402Y, 402M and 402C for forming color images, photoreceptors 405Y, 405M and 405C for forming color images are now mounted in common on a loading frame 430 as shown in FIG. 44, whereby a color photoreceptor unit 431 is formed as a unit to be subjected to maintenance work and/or parts exchange operation.

In a similar manner, the photoreceptor 405Bk for forming black color images is mounted on another loading frame 432 as also shown in FIG. 44, whereby a black photoreceptor unit 433 is formed as another unit to be subjected to maintenance work and/or parts exchange operation.

Both color photoreceptor unit 431 and black photoreceptor unit 433 are loaded on a tray 434 (FIGS. 48 and 49) which is slidably provided either into or out of the main chases 401 (FIGS. 47 and 50). At the position for the tray 434 be taken out of the main chases 401 by siding movements, the color photoreceptor unit 431 and black photoreceptor unit 433 are designed to be detachable from the tray 434 (FIG. 49).

Among the constituents of the image forming units 402Y, 402M and 402C for forming color images, charging rollers 406Y, 406M and 406C, developing units 407Y, 407M and 407C, and cleaning units 408Y, 408M and 408C, are now mounted in common on a loading frame 430 as shown in FIG. 45, whereby a color composite unit 436 is formed as a unit to be subjected to maintenance work and/or parts exchange operation.

In a similar manner, the charging roller 406Bk, developing unit 407Bk and cleaning unit 408Bk are mounted in common on anther loading frame 437 as shown in FIG. 45, whereby a black composite unit 438 is formed as a unit to be subjected to maintenance work and/or parts exchange operation.

In addition, it may well be assumed in general that the durability is approximately equal each other for the charging rollers 406Y, 406M and 406C, developing units 407Y, 407M and 407C, and cleaning units 408Y, 408M and 408C, as the constituents of the image forming units 402Y, 402M and 402C for forming color images.

Furthermore, it may also be assumed that the durability is approximately equal each other for the charging roller 406Bk, developing unit 407Bk and cleaning unit 408Bk, as the constituents of the image forming unit 402Bk for forming black images.

Both color composite unit 436 and black composite unit 438 are loaded on a tray 439 which is slidably provided either into or out of the main chases 401 (FIG. 52). At the position for the tray 439 be taken out of the main chases 401 by siding movements, the color composite unit 436 and black composite unit 438 are designed to be detachable from the tray 439 (FIG. 52).

The intermediate transfer belt 404 is loaded on a tray 440 which is slidably provided either into or out of the main chases 401 in a similar manner to the trays 434 and 439. At the position for the tray 439 be slid out of the main chases 401, the intermediate transfer belt 404 is designed to be detachable from the tray 440.

On the frontal portion of the main chases 401, a front cover 441 is provided operably for swing open and close movements. In addition, a side cover 442 and a fixer cover 443 are operably provided on the side portions of the main chases 401. The front cover 441 and side cover 441 are each operable for swing open and close movements, while the fixer cover 443 is operable for slide movements.

A display unit 444 is provided on the front cover 441, approximately in the middle thereof, which houses there behind several units for the image forming apparatus such as, for example, an intermediate transfer belt 404, color photoreceptor unit 431, black photoreceptor unit 433, composite color unit 436, and composite black unit 438.

This display unit 444 is adapted to indicate thereon it is the front cover 441 in the present case that is identified to be opened since some need for a maintenance work and/or parts exchange operation is detected for at least one of the above noted units which are housed behind the front cover 41 in the image forming apparatus. The display unit 444 disclosed herein is formed as a rectangular opening covered with a transparent material.

On the upper portion of the frontal cover 41, a toner container cover 445 is provided operably for swing open and close movements, which houses a toner container loading unit 429 there behind.

In case at least one is depleted out of the toners contained in the toner containers 428, the toner containers 428 can be replaced after releasing open only the toner container cover 445 without opening the frontal cover 441.

A holding cover 446 is then provided, inside of the frontal cover 741, operably for swing open and close movements. Being swung to close, the holding cover 446 is adapted to lock the trays 434, 439 and 440 at the predetermined position.

On the holding cover 446, another display unit 447 is provided being adapted to indicate that the next cover to open is the holding cover 446 after opening the front cover 441 for a maintenance work and/or parts exchange operation. This display unit 447 is also formed as a rectangular opening, and situated so as to overlap with the display unit 444 when both holding cover 446 and frontal cover 441 are closed.

In front of the tray 434, a light emitting unit 434*a* is provided as still another display unit. The light emitting unit 434*a* is adapted to indicate that the next tray to be subjected to the pull-out operation is the tray 434 (i.e., the color photoreceptor unit 431 and black photoreceptor unit 433 are to be pulled out together with the tray 434, in case some maintenance work and/or parts exchange operation are required for the objects such as at least one of the above noted color photoreceptor unit 431 and black photoreceptor unit 433.

Furthermore, other light emitting units 434*b* and 434*c* are provided on the upper portion of the frontal side where these light emitting units are visually recognizable with ease when the tray 434 is pulled out of the main chases 401.

The light emitting unit 434*b* is adapted to indicate that it is the color photoreceptor unit 431 to be subjected to a maintenance work and/or parts exchange operation, while the light emitting unit 434*c* is for indicating the black photoreceptor unit 433 is to be subjected to the similar operation.

As illustrated in FIGS. 50 and 51, on the inward face of the rear side of main chases 401, light emitting device 448, 449 and 450 are provided, and a light collector 451 is provided on the tray 434 for receiving/collecting the light beams emanated from the light emitting source 448.

Between the light collector 451 and light emitting unit 434A, an optical fiber 452 is provided as an optical communication means for transmitting the light beams, which are emanated from the light emitting source 448 and received by light collector 451, to the light emitting units 434*a*.

A light reflecting unit 453 such as, for example, a mirror is provided for transmitting the light beams, emanated from the light emitting source 449, to the light emitting unit 434*b* between the light emitting source 449 and the light emitting unit 434*b*.

In addition, a further light reflecting unit such as, for example, a mirror is provided for transmitting the light beams emanated from the light emitting source 450 to the light emitting unit 434*c* between the light emitting device 450 to light emitting unit 434*c*.

When light beams are emanated from the light emitting source 448 is transmitted through the optical fiber 452, the light emitting unit 434*a* is herein adapted to further emanate the thus transmitted light beams forward from the main chases 401.

When light beams which are emanated from the light emitting sources 449 and 450 and then reflected by light reflecting units 453 and 454, respectively, are transmitted, the light emitting units 434*b* and 434*c* are adapted to further emanate the thus transmitted light beams upward from the main chases 401.

As shown in FIG. 51, the light emitting units 434*a*, 434*b* and 434*c* are adapted to respectively maintain the light 1*f* emanation there from, even when the tray 434 is pulled out from the chases 401. In addition, the color of respective light emitting sources 448, 449 and 450 can be arbitrarily selected by changing the color of LED's (light emitting diodes) utilized herein as the as respective light emitting sources.

In front of the tray 439, a light emitting unit 439*a* is provided as another display unit. The light emitting unit 439*a* is adapted to indicate that the tray to be subjected to the pull-out operation is the tray 439 (i.e., the composite color unit 436 and composite black unit 438 are to be pulled out together with the tray 439), in case some maintenance work and/or parts exchange operation are required for the objects such as at least one of the above noted composite color unit 436 and composite black unit 438.

Furthermore, other light emitting units 439*b* and 439*c* are provided on the upper portion of the frontal side where these light emitting units are visually recognizable with ease when the tray 439 is pulled out of the main chases 401.

The light emitting unit 439*b* is adapted to indicate that it is the composite color unit 436 to be subjected to a maintenance work and/or parts exchange operation, while the light emitting unit 439*c* is for indicating the composite black unit 433 is to be subjected to the similar operation.

In a similar manner shown in FIGS. 50 and 51, there provided within the main chases 401 are three light emitting sources for emanating light beams to be emitted from the light emitting units 439*a*, 439*b* and 439*c*, and optical communication means (e.g., a light reflecting unit such as a mirror and/or optical fiber) for transmitting the light beams, which are emanated from these three light emitting sources and transmitted to the light emitting units 439*a*, 439*b* and 439*c*, respectively.

Furthermore, another light emitting unit 440*a* is provided as a display unit in front of the tray 440. This light emitting unit 440*a* is adapted to indicate that the tray to be subjected to the pull-out operation is the tray 440 (i.e., the intermediate transfer belt 404 is to be pulled out together with the tray 440) in case some maintenance work and/or parts exchange operation are required.

In a similar manner shown in FIGS. 50 and 51, there provided within the main chases 401 are one light emitting source for emanating light beams to be emitted from the light emitting unit 440*a* and optical communication means (e.g., a light reflecting unit such as a mirror and/or optical fiber) for transmitting the light beams emanated from the light emitting sources to the light emitting unit 440*a*.

The trays 434, 439 and 440 are arranged as three-storied. Being provided on the frontal portions of the trays 434, 439 and 440, respectively, the light emitting units 434*a*, 439*a* and 440*a*, are situated so as to face to the display unit 447 for the holding cover 446 and the display unit 444 for frontal cover 441, when the trays 434, 439 and 440 are slid into the stored position in the main chases and the both holding cover 446 and frontal cover 441 are swung to closed position.

Light emitting units 455 and 456 are provided as display units on the sideboard of the main chases 401, on which both fixer cover 443 and side cover 442 are mounted, and also at the locations which are each close to, and in the vicinity of the fixer cover 443 and the side cover 442, respectively.

The light emitting unit 455 is adapted to indicate that the part to be subjected to the pull-out operation is the fixer cover 443 in case some maintenance work and/or parts exchange operation are required for the fixing unit 420; while the light emitting unit 456 is adapted to indicate that the part to be subjected to the pull-out operation is the side cover 442 in case some maintenance work and/or parts exchange operation are required for the transfer belt 418.

The fixing unit 420 is detachably provided inside the fixer cover 443, while the transfer belt 418 is also detachably provided inside the side cover 442.

The light emitting units 455 and 456 each have similar structures as those of light emitting units 434*a*, 434*b* and 434*c*, and are provided with light emitting sources and optical communication means for emanating light beams through the light emitting units 455 and 456 in a manner similar to that shown in FIG. 50.

Furthermore, the color image formation apparatus disclosed herein is additionally provided with a control unit (not shown) including at least a microcomputer.

The control unit is adapted to control several operations or operation steps such as the operation of image forming in the image forming unit 402; transferring toner images to intermediate transfer belt 404, transfer belt 418, or copy sheets S; transporting the copy sheets S; conveying toner particles from toner container 428; light emission from light emitting sources 448, 449 and 450, and so on.

These controls are carried out on the basis of several pieces of information such as, for example, image data transmitted from a personal computer, input data supplied through a keyboard (not shown) provided on the control panel 457 on the frontal portion of the main chases 401, the results from the detection by a variety of sensing devices mounted inside the color image forming apparatus, and the number of copy sheet counts supplied by a sheet counter.

In addition, the color image formation apparatus is further provided with several means for properly implementing the above noted control, such as, for example, detection means and display means.

The detection means is adapted for properly detecting the need for a maintenance work and/or parts exchange operation for respectively objects (such as the intermediate transfer belt 404, transfer belt 418, fixing unit 420, black photoreceptor unit 433, color photoreceptor unit 431, composite color unit 436 and composite black unit 438.

As other examples with the detection means, there may be cited are the occurrence of jammed paper sheets of paper, which can be found by detecting the passage of a sheet S with an upstream detector but not with a downstream detector even after a certain period of time; and the finding of the deadline for replacing a certain object, which can be found by comparing the number of sheets copied to a predetermined number.

The display means is adapted for carrying out necessary display steps of properly activating at least one of the light emitting sources 448, 449 and 450 on the basis of the detection results so as to indicate at least one of respective objects (such as the intermediate transfer belt 404, transfer belt 418, fixing unit 420, color photoreceptor unit 431, black photoreceptor unit 433, composite color unit 436 and composite black unit 438, for which a maintenance work and/or parts exchange operation become needed.

For forming color images with the present structure of the color image formation apparatus, toner images in respective colors are formed at respective color image forming units 402Y, 402M, 402C and 402Bk, to be subsequently transferred in a superposed manner to the intermediate transfer belt 404 as full color images. The thus formed color images are then transferred at the proper transfer position by means of transfer roller 418 on a copy sheet S which is separated and supplied from a copy sheet cassette 414. (It may be noted the above description is applied for forming the images on one side of the sheet.)

At the intermediate transfer belt 412, the surface thereof is cleaned by a cleaning unit 414, whereby the transfer belt 412 is prepared for the next copying cycle steps.

In case of the occurrence of jammed paper sheets of paper or finding the deadline for replacing a certain object, a specific object situated at the location at which the jammed paper sheets occurred, or another specific object for which its deadline for replacing is met, can be detected by the present detection means.

In case the detection results be obtained by the detection means such that a maintenance work and/or parts exchange operation become necessary for at least a certain specified object, the representation corresponding to the detection results (in alphanumeric and/or picture images) is displayed on the operation panel 457, and necessary displays (i.e., light emission) are carried out for respective display units corresponding to the specified object.

When the need for a maintenance work and/or parts exchange operation is found by the detection means for the color photoreceptor unit 431, the representation corresponding to the detection results is displayed on the operation panel 457, and light emitting sources 448 and 449 are activated.

Being the light emitting source 448 activated, light beams emanated from the source 448 are received and collected by the light collector 451, and then transmitted to the light emitting units 434*a* by way of an optical fiber, to thereby the light emitting unit 434*a* be turned on.

In contrast, being the light emitting source 449 activated, light beams emanated from the source 449 are reflected by light reflecting unit 453, and then transmitted to the light emitting unit 434*b*, to thereby the light emitting unit 434*b* be turned on.

Figure 41:
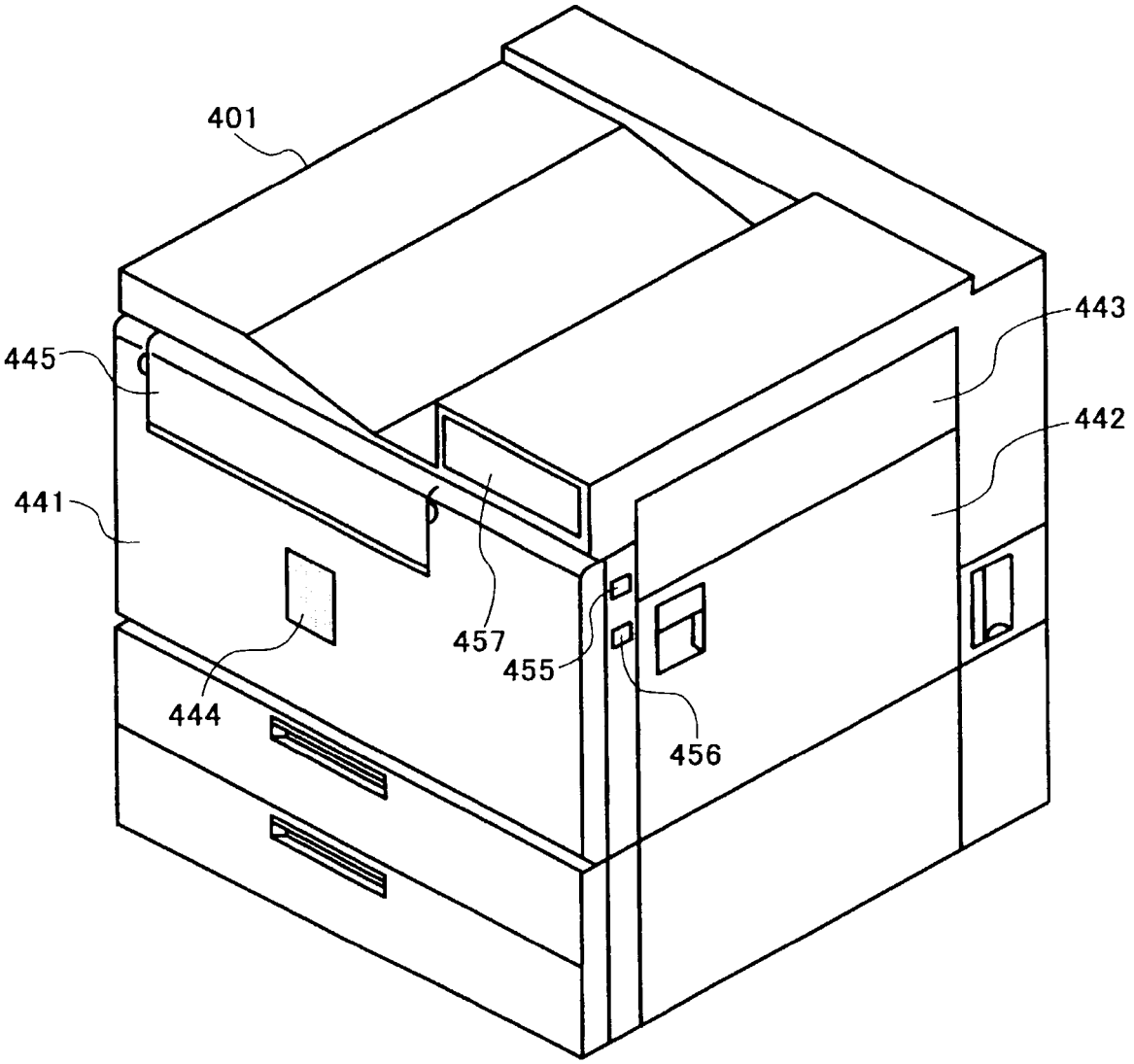
FIG. 41 is a perspective view illustrating the structure of a color image forming apparatus provided with display devices according to another embodiment disclosed herein.
Figure 42:
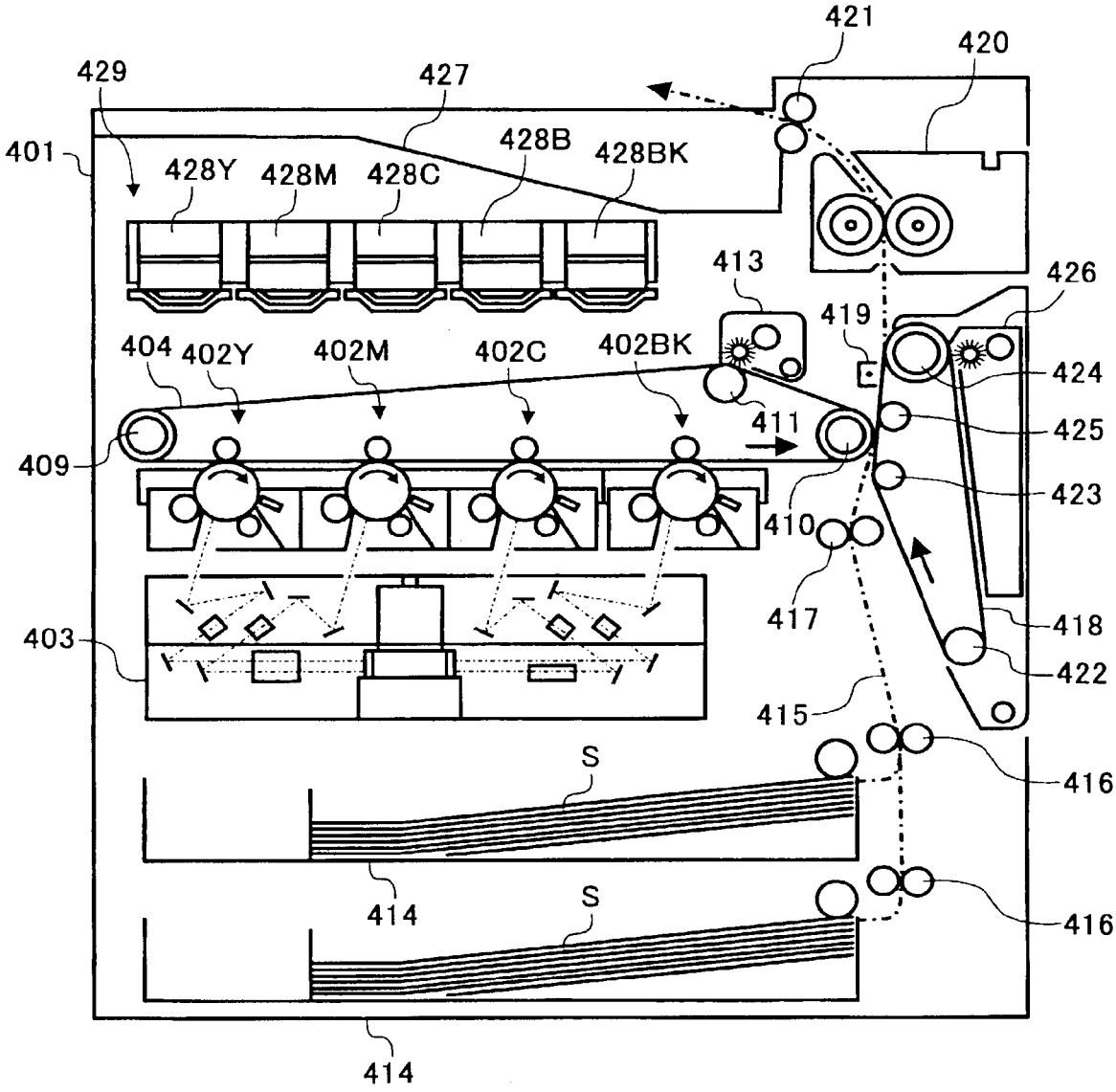
FIG. 42 is a perspective view illustrating the structure of the color image forming apparatus of FIG. 41.
Figure 43:
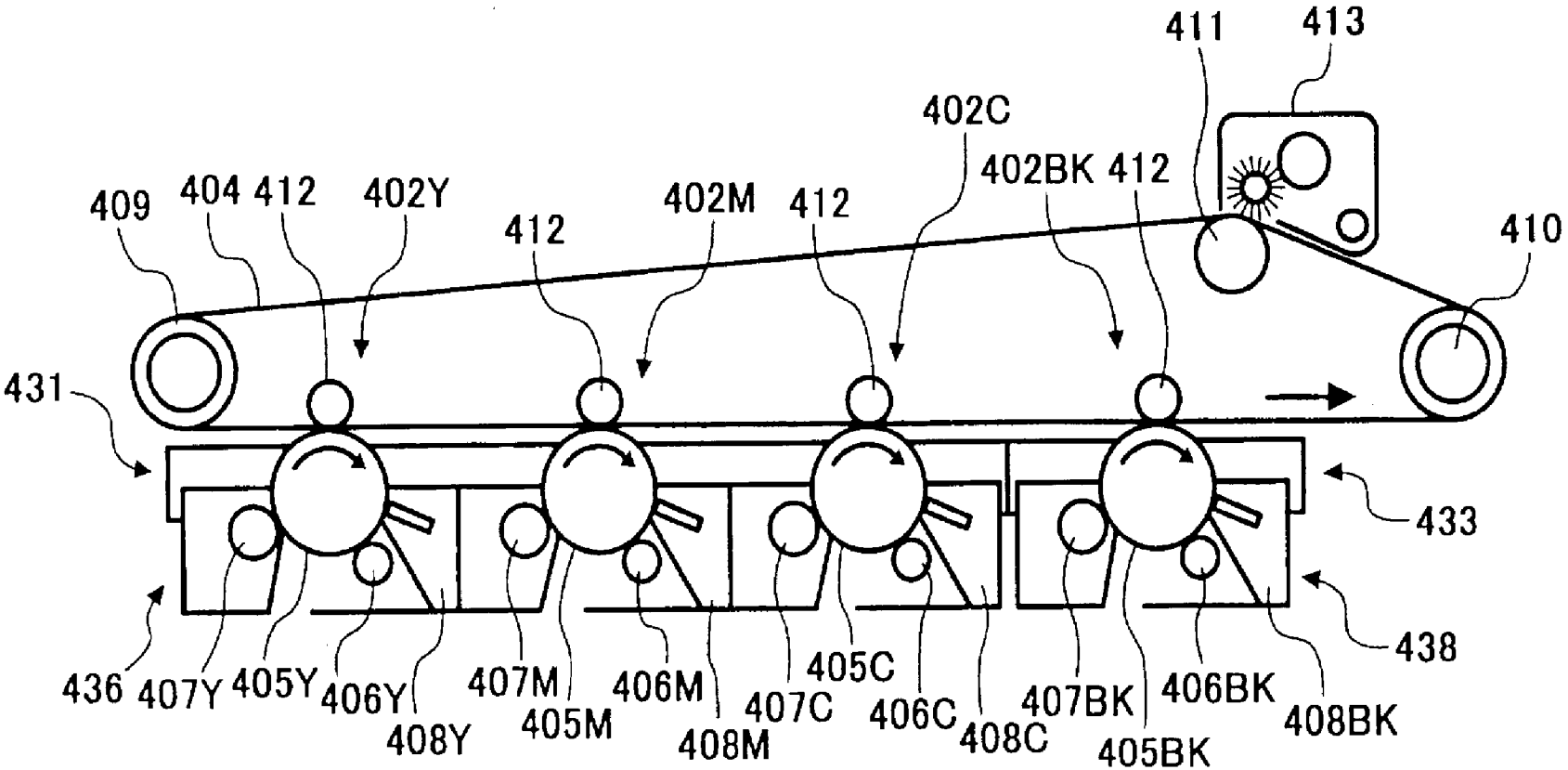
FIG. 43 is an enlarged view illustrating the portion of image forming units included in the color image forming apparatus of FIG. 41.

During the color image formation apparatus in operation with its frontal cover 441 closed, as shown in FIG. 41, the light emitting sources 448 and 449 are activated and then the light emitting units 434*a* and 434*b* are turned on.

Although the light beams from the light emitting unit 434*b* are not visible from the outside of the frontal cover 441, the light beams from the unit 434*a* can be recognized visually since they penetrate through both display unit 447 formed on the holding cover 446 and display unit 444 formed on the frontal cover 441.

The light emission from the display unit 444 is adapted to indicate or instruct that the cover to be opened is the frontal cover 441, and then a user releases the cover 441 to open according to the instruction.

When the frontal cover 441 opened as shown in FIG. 46, the holding cover 446 is exposed and the display unit 447 can be recognized visually since the light beams from the light emitting unit 434*a* illuminate the unit 447. The light emission from the display unit 447 is adapted to instruct that the cover to be opened next is the holding cover 446, and a user releases the holding cover 446 to open according to the instruction.

When the holding cover 446 is open as shown in FIG. 47, the frontal faces of respective trays 434, 439 and 440 are exposed, and the light emission from the light emitting unit 434*a* mounted on the frontal portion of the tray 434 can be recognized visually.

The light emission from the light emitting unit 434*a* is adapted to instruct that the object, for which some maintenance work and/or parts exchange operation presently needed, is at least one of the color photoreceptor unit 431 and black photoreceptor unit 433, which are both held on the tray 434. According to the instruction, a user now releases the tray 434 by pulling out of the main chases 401.

When the tray 434 is pulled out as shown in FIG. 48, the light emission from the light emitting unit 434*b* mounted on the frontal upper portion of the tray 434 can be recognized visually, and it can be confirmed clearly that the object, for which some maintenance work and/or parts exchange operation presently needed, is the color photoreceptor unit 431.

According to this instruction, as shown in FIG. 49, the color photoreceptor unit 431 is now taken out of the tray 434 to be subjected to maintenance work and/or parts exchange operation. (It may be added FIG. 49 illustrates the case where the black photoreceptor unit 433 is also removed together with the color photoreceptor unit 431.)

Therefore, when it is confirmed clearly that the object, for which some maintenance work and/or parts exchange operation presently needed, is the color photoreceptor unit 431, the maintenance work or parts exchange operation can be carried out according to the following steps.

Namely, releasing the frontal cover 441 open according to the instruction designated by the light emission from the display unit 444; releasing the holding cover 446 open according to the instruction by the display unit 447 which is now recognized visually after the frontal cover 441 is opened; pulling the tray 434 out of the main chases 401 according to the instruction by the light emitting units 434*a* which is recognized visually after the holding cover 446 is opened; removing the color photoreceptor unit 431 from the tray 434 according to the instruction by the light emitting units 434*b* which is recognized visually after the tray 434 is pulled out; and then the maintenance work and/or parts exchange operation can be carried out for the color photoreceptor unit 431.

Accordingly, a user can carry out with relative ease the maintenance work and/or parts exchange operation for the color photoreceptor unit 431 presently needed without possible undue mistakes in the order of operation steps.

When the object, for a maintenance work and/or parts exchange operation is need, is found as a composite black unit 438 by the detection means, the following display representations and operation steps corresponding thereto are carried out, which will be described herein below.

When the need for a maintenance work and/or parts exchange operation is found by the detection means for the composite black unit 438, the representation corresponding to the detection results is displayed on the operation panel 457, and a plurality of light emitting sources (not shown) are activated, and the light emitting units 439*a* and 439*c* are turned on.

During the color image formation apparatus in operation with its frontal cover 441 closed, as shown in FIG. 41, the light beams from the display unit 444 can be recognized visually since they penetrate through both display unit 447 formed on the holding cover 446 and display unit 444 formed on the frontal cover 441.

The light emission from the display unit 444 is adapted to instruct that the cover to be opened is the frontal cover 441, and then a user releases the cover 441 to open according to the instruction.

When the frontal cover 441 opened as shown in FIG. 46, the holding cover 446 is exposed and the display unit 447 can be recognized visually since the light beams emitted from the light emitting unit 439*a* penetrate through and illuminate the unit 447.

The light emission from the display unit 447 is adapted to instruct that the cover to be opened next is the holding cover 446, and a user releases the holding cover 446 to open according to the instruction.

When the holding cover 446 is open as shown in FIG. 47, the frontal faces of respective trays 434, 439 and 440 are exposed, and the light emission from the light emitting unit 439*a* mounted on the frontal portion of the tray 439 can be recognized visually.

The light emission from the light emitting unit 439*a* is adapted to instruct that the object, for which some maintenance work and/or parts exchange operation presently needed, is at least one of the composite color unit 436 and composite black unit 438, which are both held on the tray 439. According to the instruction, a user now releases the tray 439 by pulling out of the main chases 401.

When the tray 439 is pulled out as shown in FIG. 52, the light emission from the light emitting unit 439*c* mounted on the frontal upper portion of the tray 439 can be recognized visually, and it can be confirmed clearly that the object, for which some maintenance work and/or parts exchange operation presently needed, is the composite black unit 438.

According to this instruction, as shown in FIG. 53, the composite black unit 438 is now taken out of the tray 439 to be subjected to maintenance work and/or parts exchange operation. (It may be added FIG. 53 illustrates the case where composite color unit 436 is also removed together with the composite black unit 438.)

Therefore, when it is confirmed clearly that the object, for which some maintenance work and/or parts exchange operation presently needed, is the composite black unit 438, the maintenance work or parts exchange operation can be carried out according to the following steps.

Namely, releasing the frontal cover 441 open according to the instruction designated by the light emission from the display unit 444; releasing the holding cover 446 open according to the instruction by the display unit 447 which is now recognized visually after the frontal cover 441 is opened; pulling the tray 439 out of the main chases 401 according to the instruction by the light emitting units 439*a* which is recognized visually after the holding cover 446 is opened; removing the composite black unit 438 from the tray 439 according to the instruction by the light emitting units 439*c* which is recognized visually after the tray 439 is pulled out; and then the maintenance work and/or parts exchange operation can be carried out for the composite black unit 438.

Accordingly, a user can carry out with relative ease the maintenance work and/or parts exchange operation for the composite black unit 438 presently needed without possible undue mistakes in the order of operation steps.

When the object, for a maintenance work and/or parts exchange operation is need, is found as an intermediate transfer belt 404 by the detection means, the following display representations and operation steps corresponding thereto are carried out, which will be described herein below.

When the need for a maintenance work and/or parts exchange operation is found by the detection means for the intermediate transfer belt 404, the representation corresponding to the detection results is displayed on the operation panel 457, and a further light emitting source (not shown) is activated, and the light emitting unit 440*a* is turned on.

During the color image formation apparatus in operation with its frontal cover 441 closed, as shown in FIG. 41, the light beams from the display unit 444 can be recognized visually since they penetrate through both display unit 447 formed on the holding cover 446 and display unit 444 formed on the frontal cover 441.

The light emission from the display unit 444 is adapted to instruct that the cover to be opened is the frontal cover 441, and then a user releases the cover 441 to open according to the instruction.

When the frontal cover 441 opened as shown in FIG. 46, the holding cover 446 is exposed and the display unit 447 can be recognized visually since the light beams emitted from the light emitting unit 439*a* penetrate through and illuminate the unit 447.

The light emission from the display unit 447 is adapted to instruct that the cover to be opened next is the holding cover 446, and a user releases the holding cover 446 to open according to the instruction.

When the holding cover 446 is open as shown in FIG. 47, the frontal faces of respective trays 434, 439 and 440 are exposed, and the light emission from the light emitting unit 440*a* mounted on the frontal portion of the tray 440 can be recognized visually.

The light emission from the light emitting unit 440*a* is adapted to instruct that the object, for which some maintenance work and/or parts exchange operation presently needed, is the intermediate transfer belt 404 held on the tray 440. According to the instruction, a user now releases the tray 440 by pulling out of the main chases 401, and then carry out the maintenance work and/or parts exchange operation for the intermediate transfer belt 404.

Therefore, when it is confirmed clearly that the object, for which some maintenance work and/or parts exchange operation presently needed, is the intermediate transfer belt 404, the maintenance work or parts exchange operation can be carried out according to the following steps.

Namely, releasing the frontal cover 441 open according to the instruction designated by the light emission from the display unit 444; releasing the holding cover 446 open according to the instruction by the display unit 447 which is now recognized visually after the frontal cover 441 is opened; pulling the tray 440 out of the main chases 401 according to the instruction by the light emitting units 440*a* which is recognized visually after the holding cover 446 is opened; removing the intermediate transfer belt 404 from the tray 440; and then the maintenance work and/or parts exchange operation can be carried out for the intermediate transfer belt 404.

Accordingly, a user can carry out with relative ease the maintenance work and/or parts exchange operation for the intermediate transfer belt 404 presently needed without possible undue mistakes in the order of operation steps.

When the object, for a maintenance work and/or parts exchange operation is need, is found as a fixing unit 420 by the detection means, the following display representations and operation steps corresponding thereto are carried out by a user, which will be described herein below.

When the need for a maintenance work and/or parts exchange operation is found by the detection means for the fixing unit 420, the representation corresponding to the detection results is displayed on the operation panel 457, and a further light emitting source (not shown) is activated, and the light emitting unit 455 is turned on.

The light emission from the display unit 455 is adapted to instruct that the cover to be opened is the fixer cover 443 and that the object, for which some maintenance work and/or parts exchange operation presently needed, is the fixing unit 420.

The user can now pull out the fixer cover 443 according to the instruction, as shown in FIG. 54, and then the fixing unit 420 is removed from the fixer cover 443 to be subjected to the maintenance work and/or parts exchange operation presently needed.

Accordingly, the user can carry out with relative ease the maintenance work and/or parts exchange operation for the fixing unit 420 presently needed without possible undue mistakes in the order of operation steps.

When the object, for a maintenance work and/or parts exchange operation is need, is found as a transfer belt 418 by the detection means, the following display representations and operation steps corresponding thereto are carried out by a user, which will be described herein below.

When the need for a maintenance work and/or parts exchange operation is found by the detection means for the transfer belt 418, the representation corresponding to the detection results is displayed on the operation panel 457, and a further light emitting source (not shown) is activated, and the light emitting unit 456 is turned on.

The light emission from the display unit 456 is adapted to instruct that the cover to be opened is the side cover 442 and that the object, for which some maintenance work and/or parts exchange operation presently needed, is the transfer belt 418.

The user can now swing the side cover 442 open according to the instruction, as shown in FIG. 54, and then the transfer belt 418 is removed from the side cover 442 to be subjected to the maintenance work and/or parts exchange operation presently needed.

Accordingly, the user can carry out with relative ease the maintenance work and/or parts exchange operation for the transfer belt 418 presently needed without possible undue mistakes in the order of operation steps.

The apparatuses and process steps set forth in the present description may therefore be implemented using suitable host computers and terminals incorporating appropriate processors programmed according to the teachings disclosed herein, as will be appreciated to those skilled in the relevant arts.

Therefore, the present disclosure also includes a computer-based product which may be hosted on a storage medium and include instructions which can be used to program a processor to perform a process in accordance with the present disclosure. The storage medium can include, but is not limited to, any type of disk including floppy disks, optical disks, CD-ROMS, magneto-optical disks, ROMs, RAMs, EPROMs, EEPROMS, flash memory, magnetic or optical cards, or any type of media suitable for storing electronic instructions.

It is apparent from the above description including the examples the image forming apparatus disclosed herein can offer several advantages over similar known apparatuses.

For example, in the image forming apparatus provided with at least image bearing members, an image bearing member holding component for holding the plurality of image bearing members collectively, a plurality of image forming units for operating image forming steps onto each of the image bearing members, and an image forming unit holding component for holding the plurality of image forming units collectively, a contact/detach mechanism is further provided for carrying out the detaching movements of the image bearing member holding component in relation to the image forming unit holding component.

The image forming apparatus is also characterized for the plurality of image bearing members be held parallel to each other detachably on the image bearing member holding component, and for at least one of the image bearing member holding component and image forming unit holding component be each provided slidably out of the main chases of the image forming apparatus.

In addition, the image bearing member holding component and image forming unit holding component each include respective positioning parts for carrying out positioning one another by engaging the positioning part of the image forming unit holding component with that of image bearing member holding component.

Furthermore, the contact/detach mechanism carries out detachment movements through displacement of the image forming unit holding in relation to image bearing member holding component, and the direction of the displacement is vertical in relation to the image bearing member holding component.

Therefore, by providing a relatively simple, less expensive contact/detach mechanism for an image forming apparatus, undue effect from continual contact such as, for example, contact residual images can be obviated, and the workability on the apparatus for a maintenance and/or parts exchange by the user or service personnel can considerably improved. This also facilitates the handling a plurality of units simultaneously, when necessary, and helps reduce the frequency and/or labor hours for the handling the units.

At the same time, since the photoreceptor, for example, for forming black images is held as another unit separated from the color image forming unit including, the replacement can be carried out at proper timing individually one for the black photoreceptor and the other for the color photoreceptors, taking the durability into consideration for respective photoreceptors, the previously known difficulty, e.g., too early replacement of the latter, can be obviated. It is needles to add this replacement procedure can also be implemented for other members and units included in the image forming unit as described earlier in the text.

In another aspect, the image forming apparatus includes at least a display unit for indicating specific objects or the location thereof, a display unit provided at the locations of either a cover which is adapted to cover the objects to be subjected to parts exchange and/or maintenance operation; a detecting means for detecting the need for the parts exchange and/or maintenance operation for the objects, and a display means for instructing for both the display unit for indicating either the objects and the locations thereof, and the display unit provided at the locations of either the cover and corresponding thereto for indicating the cover covering the objects to be subjected to the parts exchange and/or maintenance operation, to thereby display pertinent information based on detection results on the objects detected by the detecting means.

Therefore, it becomes feasible in the image forming apparatus disclosed herein, for the display means to clearly display the location to be presently subjected to maintenance and/or parts exchange operation, and also to instruct proper operation steps and the sequence thereof, if necessary, in a manner clearly recognized and easily correlated to the actual parts in the image forming apparatus.

Obviously, additional modifications and variations of the present invention are possible in light of the above teachings. It is therefore to be understood that within the scope of the appended claims, the invention may be practiced otherwise than as specifically described herein.

This document claims priority and contains subject matter related to Japanese Patent Applications No. 2002-16417, 32210, 41595, 41596, 371550, 371685 and 376778, filed with the Japanese Patent Office on January 25, February 8, February 19, February 19, December 24, December 24 and December 26, all in 2002, respectively, the entire contents of which are hereby incorporated by reference.

What is claimed is:

1. An image forming apparatus, comprising:

a housing;

a plurality of image bearing members collectively arranged as an image bearing unit and adapted for bearing thereon electrostatic latent images corresponding to image data; and a plurality of image forming members provided in a circumference of said plurality of image bearing members and configured to selectively engage with the image bearing unit, the image bearing unit being configured to be removable from the housing separately from the plurality of image forming members.

2. The image forming apparatus according to claim 1, wherein at least two of the plurality of image forming members are arranged to perform a similar function and are collectively arranged as a movable image forming unit.

3. The image forming apparatus according to claim 2, wherein at least three of said plurality of image forming members are arranged to perform the similar function.

4. The image forming apparatus according to claim 1, wherein:

the plurality of image forming members includes a first set of image forming members arranged to perform a first function and a second set of image forming members arranged to perform a second function, the first set of image forming members is collectively configured as a first image forming unit, and the second set of image forming members is collectively configured as a second image forming unit, the first image forming unit being selectively detachable from the second image forming unit.

5. The image forming apparatus of claim 4, wherein, the image forming members of the first image forming unit are equally spaced apart by a first distance, and the image forming members of the second image forming unit are equally spaced apart by the first distance.

6. The image forming apparatus of claim 4, wherein, the first set of image forming members includes at least two charger rollers, and the second set of image forming members includes at least two developing rollers.

7. An image forming apparatus comprising:

a plurality of image forming subsystems, each having plural kinds of image forming members and each being configured to perform image formation; and at least two image forming units included in each of said plurality of image forming subsystems, each of said image forming units including a plurality of said image forming members having similar capability, and each of the image forming units being separately removable from the image forming apparatus.

8. The image forming apparatus according to claim 7, wherein:

said image forming units each includes at least three of said image forming members having similar capability.

9. The image forming apparatus according to claim 7, wherein:

each of said image forming members having similar capability included in said image forming units is situated approximately equally spaced from each other.

10. The image forming apparatus according to claim 7, wherein:

one of said image forming members is an image bearing member.

11. The image forming apparatus according to claim 7, comprising:

a further image forming subsystem configured to perform black image formation and provided separately from said plurality of image forming subsystems, the further image forming subsystem including plural kinds of image forming members having different capabilities, wherein the plurality of image forming subsystems are each configured to perform color image formation.

12. The image forming apparatus according to claim 7, wherein:

said at least two image forming units are each slidably removable from a main chases of said image forming apparatus.

13. The image forming apparatus according to claim 7, wherein:

said image forming members included in said image forming units are each provided to be replaceable individually.

14. The image forming apparatus according to claim 7, wherein:

said image forming members included in said image forming units are each provided to be replaceable as a unit.

15. The image forming apparatus of claim 7, wherein, one of the at least two image forming units includes at least two charger rollers, and another one of the at least two image forming units includes at least two developing rollers.

16. An image forming apparatus comprising:

a plurality of image forming units, each including a plurality of image forming members having a particular capability and each configured to be detachable from another image forming unit of image forming members having another capability.

17. The image forming apparatus according to claim 16, wherein:

said image forming members are each provided to be replaceable individually.

18. The image forming apparatus according to claim 16, wherein:

said image forming members are each provided to be replaceable as a unit.

19. The image forming apparatus of claim 16, wherein the plurality of image forming units includes, a first image forming unit including at least two charger rollers, and a second image forming unit including at least two developing rollers.

20. An image forming apparatus, comprising:

a plurality of image bearing members;

an image bearing member holding component for holding said plurality of image bearing members collectively;

a plurality of image forming units for operating image forming steps onto each of said image bearing members;

an image forming unit holding component for holding said plurality of image forming units collectively; and a contact/detach mechanism for carrying out detaching movements, within said image forming apparatus, of said image bearing member holding component in relation to said image forming unit holding component.

21. The image forming apparatus according to claim 20, wherein:

said plurality of image bearing members are held parallel to each other detachably on said image bearing member holding component.

22. The image forming apparatus according to claim 20, wherein:

at least one of said image bearing member holding component and said image forming unit holding component is each provided slidably out of a main chases of said image forming apparatus.

23. The image forming apparatus according to claim 20, wherein:

said image bearing member holding component and said image forming unit holding component each include respective positioning parts for carrying out positioning one in relation to another by engaging said positioning part of said image forming unit holding component with that of image bearing member holding component.

24. The image forming apparatus according to claim 20, wherein:

said contact/detach mechanism carries out detachment movements through displacement of said image forming unit holding in relation to said image bearing member holding component.

25. The image forming apparatus according to claim 24, wherein:

a direction of said displacement is vertical in relation to said image bearing member holding component.

26. The image forming apparatus according to claim 20, further comprising:

a second image bearing member provided in common for being transferred by images born by said plurality of image bearing members;

a second image bearing member holding component for holding said second image bearing member; and a second contact/detach mechanism for carrying out detaching movements, within said image forming apparatus, of said second image bearing member holding component in relation to said image bearing member holding component.

27. The image forming apparatus according to claim 26, further comprising:

a linkage mechanism for carrying out detaching movements of both said image forming unit holding component in relation to said image bearing member holding component and said second image bearing member holding component in relation to said image bearing member holding component, simultaneously.

28. The image forming apparatus according to claim 26, wherein:

at least one of said image forming unit holding component and said second image bearing member holding component is each provided slidably out of a main chases of said image forming apparatus.

29. The image forming apparatus according to claim 26, wherein:

said image bearing member holding component, said image forming unit holding component, and said second image bearing member holding component each include respective positioning parts for carrying out positioning in relation to each other by engaging said positioning parts of said image forming unit holding component and said second image bearing member holding component with said positioning part of said image bearing member holding component.

30. The image forming apparatus according to claim 26, wherein:

said second contact/detach mechanism carries out detachment movements through displacement of said image forming unit holding and second image bearing member holding component in relation to said image bearing member holding component.

31. The image forming apparatus according to claim 30, wherein:

a direction of said displacement is vertical in relation to said image bearing member holding component.

32. The image forming apparatus according to claim 26, further comprising:

a third image bearing member provided for being transferred by images born by said second image bearing member; and a third image bearing member holding component for holding said third image bearing member, wherein:

said second and third image bearing member holding components each include respective positioning parts for carrying out positioning in relation to one another by engaging said positioning part of said third image forming unit holding component with that of said second image bearing member holding component.

33. The image forming apparatus according to claim 20, wherein:

said detaching movements are carried out at least immediately after completing image forming process steps.

34. An image forming apparatus, comprising:

a plurality of image bearing members;

an image bearing member holding component for collectively holding said plurality of image bearing members with a certain degree of positional allowance;

a plurality of image forming units for operating image forming steps onto each of said image bearing members; and an image forming unit holding component for holding said plurality of image forming units collectively, wherein:

said plurality of image bearing members are each positioned in relation to a main chases of said image forming apparatus after placing said image bearing member holding component at a predetermined location in said main chases, and said plurality of image forming units held on said image forming unit holding component are each subsequently positioned in relation to said plurality of image bearing members positioned previously.

35. The image forming apparatus according to claim 34, further comprising:

an image bearing member holding component restricting member for placing said plurality of image bearing members at respective predetermined locations in said main chases;

an image bearing member positioning mechanism for positioning said plurality of image bearing members, placed at respective predetermined locations on said image bearing member holding component, in relation to said main chases; and an image forming unit positioning mechanism for positioning said plurality of image forming units held on said image forming unit holding component in relation to said plurality of image bearing members.

36. The image forming apparatus according to claim 34, further comprising:

a contact/detach mechanism for carrying out detaching movements, within said image forming apparatus, of said image bearing member holding component in relation to said image forming unit holding component.

37. The image forming apparatus according to claim 34, wherein:

said plurality of image bearing members are held parallel to each other detachably on said image bearing member holding component.

38. The image forming apparatus according to claim 34, wherein:

said plurality of image bearing members are detachably mounted from above on said image bearing member.

39. The image forming apparatus according to claim 34, wherein:

at least one of said second image bearing member holding component and said image forming unit holding component is each provided slidably out of a main chases of said image forming apparatus.

40. The image forming apparatus according to claim 34, further comprising:

a second image bearing member provided in common for being transferred by images born by said plurality of image bearing members; and a second image bearing member holding component for holding said second image bearing member, wherein:

said second image bearing member held on said second image bearing member holding component are each subsequently positioned in relation to said plurality of image bearing members previously positioned.

41. The image forming apparatus according to claim 40, further comprising:

a second image bearing member positioning mechanism for positioning said second image bearing member held on said second image bearing member holding component in relation to said image bearing member holding component previously positioned.

42. The image forming apparatus according to claim 40, further comprising:

a second contact/detach mechanism for carrying out detaching movements, within said image forming apparatus, of said second image bearing member holding component in relation to said image bearing member holding component.

43. The image forming apparatus according to claim 42, further comprising:

a linkage mechanism for carrying out detaching movements of both said image forming unit holding component in relation to said image bearing member holding component, and said second image bearing member holding component in relation to said image bearing member holding component, simultaneously.

44. The image forming apparatus according to claim 40, wherein:

at least one of said second image bearing member holding component, said image forming unit holding component and said second image bearing member holding component is each provided slidably out of a main chases of said image forming apparatus.

45. The image forming apparatus according to claim 44, wherein:

contact/detach movements are carried out in a same direction for said image bearing member, said image forming unit and said second image bearing member, held on said image bearing member holding component, said image forming unit holding component and said second image bearing member holding component, respectively.

46. The image forming apparatus according to claim 45, wherein:

sliding-out movements are carried out horizontally for said image bearing member holding component, said image forming unit holding component and said second image bearing member holding component; and contact/detach movements are carried out vertically for said image bearing member, said image forming unit and said second image bearing member.

47. The image forming apparatus according to claim 40, further comprising:

a third image bearing member provided for being transferred by images born by said second image bearing member; and a third image bearing member holding component for holding said third image bearing member, wherein:

said second and third image bearing member holding components each include respective positioning parts for carrying out positioning in relation to one another by engaging said positioning part of said third image forming unit holding component with that of said second image bearing member holding component.

48. An image forming apparatus, comprising:

an image bearing unit including at least a plurality of image bearing members adapted for bearing electrostatic latent images corresponding to image data;

an image bearing member holding component for holding said plurality of image bearing members collectively;

a plurality of image forming units each including at least a plurality of image forming members for operating image forming steps onto each of said image bearing members; and an image forming unit holding component for holding said plurality of image forming units collectively, wherein a contact/detach mechanism is provided for carrying out detaching movements, within said image forming apparatus, of said image bearing member holding component in relation to said image forming unit holding component.

49. The image forming apparatus according to claim 48, wherein:

each of said image forming members having similar capability included in said plurality of image forming units is situated approximately equally spaced each other.

50. The image forming apparatus according to claim 48, wherein:

said at least two image forming units are each slidably provided out of a main chases of said image forming apparatus.

51. The image forming apparatus according to claim 48, wherein:

said image forming members included in said image forming units are each provided to be replaceable individually.

52. The image forming apparatus according to claim 48, wherein:

said image forming members included in said image forming units are each provided to be replaceable as a unit.

53. The image forming apparatus according to claim 52, wherein:

a direction of said displacement is vertical in relation to said image bearing member holding component.

54. The image forming apparatus according to claim 48, wherein:

at least one of said image bearing member holding component and said image forming unit holding component is each provided slidably out of a main chases of said image forming apparatus.

55. The image forming apparatus according to claim 48, wherein:

said image bearing member holding component and said image forming unit holding component each include respective positioning parts for carrying out positioning one in relation to another by engaging said positioning part of said image forming unit holding component with that of image bearing member holding component.

56. The image forming apparatus according to claim 55, further comprising:

a linkage mechanism for carrying out detaching movements of both said image forming unit holding component in relation to said image bearing member holding component and said second image bearing member holding component in relation to said image bearing member holding component, simultaneously.

57. The image forming apparatus according to claims 55, wherein:

at least one of said image forming unit holding component and said second image bearing member holding component is each provided slidably out of a main chases of said image forming apparatus.

58. The image forming apparatus according to claim 55, wherein:

said image bearing member holding component, said image forming unit holding component, and said second image bearing member holding component each include respective positioning parts for carrying out positioning in relation to each other by engaging said positioning parts of said image forming unit holding component and said second image bearing member holding component with said positioning part of said image bearing member holding component.

59. The image forming apparatus according to claim 48, wherein:

said contact/detach mechanism carries out detachment movements through displacement of said image forming unit holding in relation to said image bearing member holding component.

60. The image forming apparatus according to claim 48, further comprising:

a second image bearing member provided in common for being transferred by images born by said plurality of image bearing members;

a second image bearing member holding component for holding said second image bearing member; and a second contact/detach mechanism for carrying out detaching movements, within said image forming apparatus, of said second image bearing member holding component in relation to said image bearing member holding component.

61. An image forming apparatus, comprising:

an image bearing unit including at least a plurality of image bearing members adapted for bearing electrostatic latent images corresponding to image data;

an image bearing member holding component for holding said plurality of image bearing members collectively;

a plurality of image forming units each including at least a plurality of image forming members for operating image forming steps onto each of said image bearing members; and an image forming unit holding component for holding said plurality of image forming units collectively, wherein:

said plurality of image bearing members are each positioned in relation to a main chases of said image forming apparatus after placing said image bearing member holding component at a predetermined location in said main chases, and said plurality of image forming units held on said image fanning unit holding component are each subsequently positioned in relation to said plurality of image bearing members positioned previously.

62. The image forming apparatus according to claim 61, wherein:

each of said image forming members having similar capability included in said plurality of image forming units is situated approximately equally spaced each other.

63. The image forming apparatus according to claim 61, wherein:

said at least two image forming units are each slidably provided out of a main chases of said image forming apparatus.

64. The image forming apparatus according to claim 61, wherein:

said image forming members included in said image forming units are each provided to be replaceable individually.

65. The image forming apparatus according to claim 61, wherein:

said image forming members included in said image forming units are each provided to be replaceable as a unit.

66. The image forming apparatus according to claim 61, further comprising:

an image bearing member holding component restricting member for placing said plurality of image bearing members at respective predetermined locations in said main chases;

an image bearing member positioning mechanism for positioning said plurality of image bearing members, placed at respective predetermined locations on said image bearing member holding component, in relation to said main chases; and an image forming unit positioning mechanism for positioning said plurality of image forming units held on said image forming unit holding component in relation to said plurality of image bearing members.

67. The image forming apparatus according to claim 61, further comprising:

a contact/detach mechanism for carrying out detaching movements, within said image forming apparatus, of said image bearing member holding component in relation to said image forming unit holding component.

68. The image forming apparatus according to claim 61, wherein:

said plurality of image bearing members are held parallel to each other detachably on said image bearing member holding component.

69. The image forming apparatus according to claim 61, wherein:

said plurality of image bearing members are detachably mounted from above on said image bearing member.

70. The image forming apparatus according to claim 61, wherein:

at least one of said second image bearing member holding component and said image forming unit holding component is each provided slidably out of a main chases of said image forming apparatus.

71. The image forming apparatus according to claim 61, further comprising:

a second image bearing member provided in common for being transferred by images born by said plurality of image bearing members; and a second image bearing member holding component for holding said second image bearing member, wherein:

said second image bearing member held on said second image bearing member holding component is subsequently positioned in relation to said plurality of image bearing members previously positioned.

72. The image forming apparatus according to claim 71, further comprising:

a second image bearing member positioning mechanism for positioning said second image bearing member held on said second image bearing member holding component in relation to said image bearing member holding component previously positioned.

73. The image forming apparatus according to claim 71, further comprising:

a second contact/detach mechanism for carrying out detaching movements, within said image forming apparatus, of said second image bearing member holding component in relation to said image bearing member holding component.

74. The image forming apparatus according to claim 69, further comprising:

a linkage mechanism for carrying out detaching movements of both said image forming unit holding component in relation to said image bearing member holding component and said second image bearing member holding component in relation to said image bearing member holding component, simultaneously.

75. The image forming apparatus according to claim 73, wherein:

at least one of said second image bearing member holding component, said image forming unit holding component and said second image bearing member holding component is each provided slidably out of a main chases of said image forming apparatus.

76. An image forming apparatus, comprising:

a housing:

an image bearing unit including a plurality of image bearing member means for bearing thereon electrostatic latent images corresponding to image data; and image forming member means for selectively engaging with the image bearing unit and for performing different image forming functions, the image forming member means being provided in a circumference of said plurality of image bearing member means, and the image bearing unit being configured to be removable from the housing separately from the image forming member means.

77. The image forming apparatus according to claim 76, wherein:

the image forming member means includes a first set of image forming members collectively arranged as an image forming unit that is configured to be separately removed from the housing.

78. The image forming apparatus according to claim 77, wherein:

image forming member means includes at least three image forming members having similar capability and collectively arranged as an image forming unit that is configured to be separately removed from the housing.

79. The image forming apparatus according to claim 76, wherein:

said image forming member means includes a plurality of image forming units, each having multiple image forming members of similar capability, the image forming members of one of the plurality of image forming units being spaced apart from one another by a first distance, and the image forming members of another one of the plurality of image forming units being spaced apart from one another by the first distance.

80. An image forming apparatus comprising:

a plurality of image forming subsystem means for performing image formation, each image forming subsystem having plural kinds of image forming member means for performing specific image forming functions; and at least two image forming unit means included in each of said plurality of image forming subsystem means, each image forming unit means including a plurality of said image forming member means having similar capability, and each of the image forming unit means being separately removable from the image forming apparatus.

81. The image forming apparatus according to claim 80, wherein:

at least one of the image forming unit means includes at least three of said image forming member means having similar capability.

82. The image forming apparatus according to claim 80, wherein:

said image forming member means having similar capability included in said image forming unit means is situated approximately equally spaced from each other.

83. The image forming apparatus according to claim 80, wherein:

one of said image forming member means is an image bearing member means.

84. The image forming apparatus according to claim 80, comprising:

a further image forming subsystem means for performing black image formation provided separately from said plurality of image forming subsystem means and including plural kinds of image forming member means having different capabilities, the plurality of image forming subsystem means also for performing color image formation.

85. The image forming apparatus according to claim 80, wherein:

said at least two image forming unit means are each slidably removable from a main chases of said image forming apparatus.

86. The image forming apparatus according to claim 80, wherein:

said image forming member means included in said image forming unit means are each provided to be individually replaceable.

87. The image forming apparatus according to claim 80, wherein:

said image forming member means included in said image forming unit means are each provided to be replaceable as a unit.

88. An image forming apparatus, comprising:

a plurality of image bearing member means;

an image bearing member holding component means for holding said plurality of image bearing member means collectively;

a plurality of image forming unit means for operating image forming steps onto each of said image bearing member means;

an image forming unit holding component means for holding said plurality of image forming unit means collectively; and a contact/detach mechanism means for carrying out detaching movements, within said image forming apparatus, of said image bearing member holding component means in relation to said image forming unit holding component means.

89. The image forming apparatus according to claim 88, wherein:

said plurality of image bearing member means are held parallel to each other detachably on said image bearing member holding component means.

90. The image forming apparatus according to claim 88, wherein:

at least one of said image bearing member holding component means and said image forming unit holding component means is each provided slidably out of a main chases of said image forming apparatus.

91. The image forming apparatus according to claim 88, wherein:

said image bearing member holding component means and said image forming unit holding component means each include respective positioning part means for carrying out positioning one in relation to another by engaging said positioning part means of said image forming unit holding component means with that of image bearing member holding component means.

92. The image forming apparatus according to claim 88, wherein:

said contact/detach mechanism means carries out detachment movements through displacement of said image forming unit holding means in relation to said image bearing member holding component means.

93. The image forming apparatus according to claim 92, wherein:

a direction of said displacement is vertical in relation to said image bearing member holding component means.

94. The image forming apparatus according to claim 88, further comprising:

a second image bearing member means provided in common for being transferred by images born by said plurality of image bearing member means;

a second image bearing member holding component means for holding said second image bearing member means; and a second contact/detach mechanism means for carrying out detaching movements, within said image forming apparatus, of said second image bearing member holding component means in relation to said image bearing member holding component means.

95. The image forming apparatus according to claim 94, further comprising:

a linkage mechanism means for carrying out detaching movements of both said image forming unit holding component means in relation to said image bearing member holding component means and said second image bearing member holding component means in relation to said image bearing member holding component means, simultaneously.

96. The image forming apparatus according to claim 94, wherein:

at least one of said image forming unit holding component means and said second image bearing member holding component means is each provided slidably out of a main chases of said image forming apparatus.

97. The image forming apparatus according to claim 94, wherein:

said image bearing member holding component means, said image forming unit holding component means, and said second image bearing member holding component means each include respective positioning part means for carrying out positioning in relation to each other by engaging said positioning part means of said image forming unit holding component means and said second image bearing member holding component means with said positioning part means of said image bearing member holding component means.

98. The image forming apparatus according to claim 94, wherein:

said second contact/detach mechanism means carries out detachment movements through displacement of said image forming unit holding means and second image bearing member holding component means in relation to said image bearing member holding component means.

99. The image forming apparatus according to claim 98, wherein:

a direction of said displacement is vertical in relation to said image bearing member holding component means.

100. The image forming apparatus according to claim 94, further comprising:

a third image bearing member means provided for being transferred by images born by said second image bearing member means; and a third image bearing member holding component means for holding said third image bearing member means, wherein:

said second and third image bearing member holding component means each include respective positioning parts for carrying out positioning in relation to one another by engaging said positioning part means of said third image forming unit holding component means with that of said second image bearing member holding component means.

101. An image forming apparatus, comprising:

a plurality of image bearing member means;

an image bearing member holding component means for collectively holding said plurality of image bearing member means with a certain degree of positional allowance;

a plurality of image forming unit means for operating image forming steps onto each of said image bearing member means; and an image forming unit holding component means for holding said plurality of image forming unit means collectively, wherein:

said plurality of image bearing member means are each positioned in relation to a main chases of said image forming apparatus after placing said image bearing member holding component means at a predetermined location in said main chases, and said plurality of image forming unit means held on said image forming unit holding component means are each subsequently positioned in relation to said plurality of image bearing member means positioned previously.

102. The image forming apparatus according to claim 101, further comprising:

an image bearing member holding component restricting member means for placing said plurality of image bearing member means at respective predetermined locations in said main chases;

an image bearing member positioning mechanism means for positioning said plurality of image bearing member means, placed at respective predetermined locations on said image bearing member holding component means, in relation to said main chases; and an image forming unit positioning mechanism means for positioning said plurality of image forming unit means held on said image forming unit holding component means in relation to said plurality of image bearing member means.

103. The image forming apparatus according to claim 101, further comprising:

a contact/detach mechanism means for carrying out detaching movements, within said image forming apparatus, of said image bearing member holding component means in relation to said image forming unit holding component means.

104. The image forming apparatus according to claim 101, wherein:

said plurality of image bearing member means are held parallel to each other detachably on said image bearing member holding component means.

105. The image forming apparatus according to claim 101, wherein:

said plurality of image bearing member means are detachably mounted from above on said image bearing member means.

106. The image forming apparatus according to claim 101, wherein:

at least one of said second image bearing member holding component means and said image forming unit holding component means is each provided slidably out of a main chases of said image forming apparatus.

107. The image forming apparatus according to claim 101, further comprising:

a second image bearing member means provided in common for being transferred by images born by said plurality of image bearing member means; and a second image bearing member holding component means for holding said second image bearing member means, wherein:

said second image bearing member means held on said second image bearing member holding component means are each subsequently positioned in relation to said plurality of image bearing member means previously positioned.

108. The image forming apparatus according to claim 107, further comprising:

a second image bearing member means positioning mechanism for positioning said second image bearing member means held on said second image bearing member holding component means in relation to said image bearing member holding component means previously positioned.

109. The image forming apparatus according to claim 107, further comprising:

a second contact/detach mechanism means for carrying out detaching movements, within said image forming apparatus, of said second image bearing member holding component means in relation to said image bearing member holding component means.

110. The image forming apparatus according to claim 109, further comprising:

a linkage mechanism means for carrying out detaching movements of both said image forming unit holding component means in relation to said image bearing member holding component means, and said second image bearing member holding component means in relation to said image bearing member holding component means, simultaneously.

111. The image forming apparatus according to claim 107, wherein:

at least one of said second image bearing member holding component means, said image forming unit holding component means and said second image bearing member holding component means is each provided slidably out of a main chases of said image forming apparatus.

112. The image forming apparatus according to claim 111, wherein:

contact/detach movements are carried out in a same direction for said image bearing member means, said image forming unit means and said second image bearing member means, held on said image bearing member holding component means, said image forming unit holding component means and said second image bearing member holding component means, respectively.

113. The image forming apparatus according to claim 112, wherein:

sliding-out movements are carried out horizontally for said image bearing member holding component means, said image forming unit holding component means and said second image bearing member holding component means; and contact/detach movements are carried out vertically for said image bearing member means, said image forming unit means and said second image bearing member means.

114. The image forming apparatus according to claim 107, further comprising:

a third image bearing member means provided for being transferred by images born by said second image bearing member means; and a third image bearing member holding component means for holding said third image bearing member means, wherein:

said second and third image bearing member holding component means each include respective positioning part means for carrying out positioning in relation to one another by engaging said positioning part means of said third image forming unit holding component means with that of said second image bearing member holding component means.

115. An image forming apparatus, comprising:

an image bearing unit means including at least a plurality of image bearing member means adapted for bearing electrostatic latent images corresponding to image data;

an image bearing member holding component means for holding said plurality of image bearing member means collectively;

a plurality of image forming unit means each including at least a plurality of image forming member means for operating image forming steps onto each of said image bearing member means; and an image forming unit holding component means for holding said plurality of image forming unit means collectively, wherein a contact/detach mechanism means is provided for carrying out detaching movements, within said image forming apparatus, of said image bearing member holding component means in relation to said image forming unit holding component means.

116. The image forming apparatus according to claim 115, wherein:

each of said image forming member means having similar capability included in said plurality of image forming unit means is situated approximately equally spaced each other.

117. The image forming apparatus according to claim 115, wherein:

said at least two image forming unit means are each slidably provided out of a main chases of said image forming apparatus.

118. The image forming apparatus according to claim 115, wherein:

said image forming member means included in said image forming unit means are each provided to be replaceable individually.

119. The image forming apparatus according to claim 115, wherein:

said image forming member means included in said image forming unit means are each provided to be replaceable as a unit.

120. The image forming apparatus according to claim 119, wherein:

a direction of said displacement is vertical in relation to said image bearing member holding component means.

121. The image forming apparatus according to claim 115, wherein:

at least one of said image bearing member holding component means and said image forming unit holding component means is each provided slidably out of a main chases of said image forming apparatus.

122. The image forming apparatus according to claim 115, wherein:

said image bearing member holding component means and said image forming unit holding component means each include respective positioning part means for carrying out positioning one in relation to another by engaging said positioning part means of said image forming unit holding component means with that of image bearing member holding component means.

123. The image forming apparatus according to claim 122, further comprising:

a linkage mechanism means for carrying out detaching movements of both said image forming unit holding component means in relation to said image bearing member holding component means and said second image bearing member holding component means in relation to said image bearing member holding component means, simultaneously.

124. The image forming apparatus according to claim 122, wherein:

at least one of said image forming unit holding component means and said second image bearing member holding component means is each provided slidably out of a main chases of said image forming apparatus.

125. The image forming apparatus according to claim 122, wherein:

said image bearing member holding component means, said image forming unit holding component means, and said second image bearing member holding component means each include respective positioning parts for carrying out positioning in relation to each other by engaging said positioning part means of said image forming unit holding component means and said second image bearing member holding component means with said positioning part means of said image bearing member holding component means.

126. The image forming apparatus according to claim 115, wherein:

said contact/detach mechanism means carries out detachment movements through displacement of said image forming unit holding means in relation to said image bearing member holding component means.

127. The image forming apparatus according to claim 115, further comprising:

a second image bearing member means provided in common for being transferred by images born by said plurality of image bearing member means;

a second image bearing member holding component means for holding said second image bearing member means; and a second contact/detach mechanism means for carrying out detaching movements, within said image forming apparatus, of said second image bearing member holding component means in relation to said image bearing member holding component means.

128. An image forming apparatus, comprising:

an image bearing unit means including at least a plurality of image bearing member means adapted for bearing electrostatic latent images corresponding to image data;

an image bearing member holding component means for holding said plurality of image bearing member means collectively;

a plurality of image forming unit means each including at least a plurality of image forming member means for operating image forming steps onto each of said image bearing member means; and an image forming unit holding component means for holding said plurality of image forming unit means collectively, wherein said plurality of image bearing member means are each positioned in relation to a main chases of said image forming apparatus after placing said image bearing member holding component means at a predetermined location in said main chases, and said plurality of image forming unit means held on said image forming unit holding component means are each subsequently positioned in relation to said plurality of image bearing member means positioned previously.

129. The image forming apparatus according to claim 128, wherein:

each of said image forming member means having similar capability included in said plurality of image forming unit means is situated approximately equally spaced each other.

130. The image forming apparatus according to claim 128, wherein:

said at least two image forming unit means are each slidably provided out of a main chases of said image forming apparatus.

131. The image forming apparatus according to claim 128, wherein:

said image forming member means included in said image forming unit means are each provided to be replaceable individually.

132. The image forming apparatus according to claim 128, wherein:

said image forming member means included in said image forming unit means are each provided to be replaceable as a unit.

133. The image forming apparatus according to claim 128, further comprising:

an image bearing member holding component restricting member means for placing said plurality of image bearing member means at respective predetermined locations in said main chases;

an image bearing member positioning mechanism means for positioning said plurality of image bearing member means, placed at respective predetermined locations on said image bearing member holding component means, in relation to said main chases; and an image forming unit positioning mechanism means for positioning said plurality of image forming unit means held on said image forming unit holding component means in relation to said plurality of image bearing member means.

134. The image forming apparatus according to claim 128, further comprising:

a contact/detach mechanism means for carrying out detaching movements, within said image forming apparatus, of said image bearing member holding component means in relation to said image forming unit holding component means.

135. The image forming apparatus according to claim 128, wherein:

said plurality of image bearing member means are held parallel to each other detachably on said image bearing member holding component means.

136. The image forming apparatus according to claim 128, wherein:

said plurality of image bearing member means are detachably mounted from above on said image bearing member means.

137. The image forming apparatus according to claim 128, wherein:

at least one of said second image bearing member holding component means and said image forming unit holding component means is each provided slidably out of a main chases of said image forming apparatus.

138. The image forming apparatus according to claim 128, further comprising:

a second image bearing member means provided in common for being transferred by images born by said plurality of image bearing member means; and a second image bearing member holding component means for holding said second image bearing member means, wherein:

said second image bearing member means held on said second image bearing member holding component means is subsequently positioned in relation to said plurality of image bearing member means previously positioned.

139. The image forming apparatus according to claim 138, further comprising:

a second image bearing member positioning mechanism means for positioning said second image bearing member means held on said second image bearing member holding component means in relation to said image bearing member holding component means previously positioned.

140. The image forming apparatus according to claim 138, further comprising:

a second contact/detach mechanism means for carrying out detaching movements, within said image forming apparatus, of said second image bearing member holding component means in relation to said image bearing member holding component means.

141. The image forming apparatus according to claim 140, further comprising:

a linkage mechanism means for carrying out detaching movements of both said image forming unit holding component means in relation to said image bearing member holding component means and said second image bearing member holding component means in relation to said image bearing member holding component means, simultaneously.

142. The image forming apparatus according to claim 138, wherein:

at least one of said second image bearing member holding component means, said image forming unit holding component means and said second image bearing member holding component means is each provided slidably out of a main chases of said image forming apparatus.

143. An image forming apparatus comprising:

a housing;

at least two photoreceptors collectively arranged as an image forming unit that is selectively removable from the housing; and at least two developing units configured to engage with the image forming unit and configured to deliver toner to the at least two photoreceptors.

144. The image forming apparatus of claim 143, wherein the at least two developing units are collectively arranged as a second forming unit that is selectively removable from the housing and selectively attachable to the image forming unit.

145. The image forming apparatus of claim 143, further comprising:

at least two charging rollers collectively arranged as a second image forming unit that is selectively removable from the housing and selectively attachable to the image forming unit.

146. A method for handling components of an image forming apparatus including an image forming unit and an image bearing unit, comprising:

detaching the image bearing unit from the image forming unit, the image bearing unit including at least two image bearing members, and the image forming unit including at least two image forming members; and removing at least one of the image bearing unit and the image forming unit from a housing of the image forming apparatus.

147. The method of claim 146, further comprising:

supporting the image bearing unit with a first holding component; and supporting the image forming unit with a second holding component, wherein detaching includes moving the first holding component and the second holding component away from one another.

148. The method of claim 147, wherein detaching further includes activating a contact/detach mechanism to move the first holding component and the second holding component away from one another.

149. The method of claim 147, wherein removing includes sliding at least one of the first holding component and the second holding component from the housing.

150. The method of claim 146, wherein removing includes sliding at least one of the image bearing unit and the image forming unit from the housing.

151. The method of claim 146, further comprising:

arranging the image bearing unit as at least three image bearing members rotatably fixed to a first holding case; and arranging the image forming unit as at least three image forming members fixed to a second holding case.

152. The method of claim 146, further comprising:

arranging the at least image forming members as at least two developing units.

153. The method of claim 146, further comprising:

arranging the at least image forming members as at least two charging rollers.

* * * * *